US005915691A

United States Patent [19]

Deguchi et al.

[11] Patent Number: 5,915,691

[45] Date of Patent: Jun. 29, 1999

[54] DOCUMENT FEEDER AND COVER FOR AN IMAGE FORMING APPARATUS

[75] Inventors: Masanobu Deguchi, Kashiba; Takahiro Fukunaga, Sakurai; Masakiyo Okuda, Ikoma-gun; Junichi Kajiwara, Tenri; Yukinari Sato, Soraku-gun; Michiyuki Suzuki, Yamatokoriyama; Shinji Kato, Osaka; Kiwamu Morita, Tondabayashi; Michiaki Nishimura, Yoshino-gun; Hideaki Hagihara, Nara; Souichi Takata, Kitakatsuragi-gun, all of Japan

[73] Assignee: Sharp Kabushiki Kaisha, Osaka, Japan

[21] Appl. No.: 08/919,362

[22] Filed: Aug. 28, 1997

Related U.S. Application Data

[63] Continuation of application No. 08/543,480, Oct. 16, 1995, abandoned.

[30] Foreign Application Priority Data

| | | | |
|---|---|---|---|
| Oct. 17, 1994 | [JP] | Japan | 6-250905 |
| Feb. 27, 1995 | [JP] | Japan | 7-038705 |
| Mar. 1, 1995 | [JP] | Japan | 7-041647 |
| Apr. 27, 1995 | [JP] | Japan | 7-103650 |
| Aug. 14, 1995 | [JP] | Japan | 7-207083 |

[51] Int. Cl.[6] ..... B65H 7/02

[52] U.S. Cl. ..... 271/265.01; 271/272; 271/902; 399/380

[58] Field of Search ..... 271/3.01, 265.01, 271/273, 274, 265.02, 902, 272; 399/371, 380

[56] References Cited

U.S. PATENT DOCUMENTS

| | | | |
|---|---|---|---|
| 5,005,052 | 4/1991 | Watanabe et al. | 399/380 X |
| 5,064,182 | 11/1991 | Tokutsu | 399/371 X |
| 5,130,807 | 7/1992 | Tanabe | 399/371 X |
| 5,332,205 | 7/1994 | Chung et al. | 271/265.01 X |

FOREIGN PATENT DOCUMENTS

| | | |
|---|---|---|
| 5-8886 | 1/1993 | Japan . |
| 6-67497 | 3/1994 | Japan . |

*Primary Examiner*—Boris Milef

[57] ABSTRACT

A document feeder includes: a document detecting device arranged on the top of the copier body, for detecting a document inserted from the outside; a feed roller arranged adjacent to the document detecting device, on the top of the copier body, for feeding an inserted document into a space between the original table and the original cover, in response to the detection of a document by the document detecting device; and an original cover lifting device arranged on the top of the copier body, for lifting the original cover to create a gap between the original table and the original cover, in response to the detection of a document by the document detecting device. Alternatively, the feed roller further has a rotary cam on its shaft, so that the cam rotates to lift the original cover up as the feed roller rotates in the document feeding direction. Then, after the document is fed in place, the feed roller is reversely rotated in a constant time, whereby the document cover is sunk to press the document onto the original table.

79 Claims, 29 Drawing Sheets

DOCUMENT FEEDER AND COVER FOR AN IMAGE FORMING APPARATUS

This application is a continuation of application Ser. No. 08/543,480 filed on Oct. 16, 1995, which is incorporated herein by reference and now abandoned.

BACKGROUND OF THE INVENTION (1) Field of the Invention

The present invention relates to a preferable document feeder attached to an image forming apparatus such as copiers and the like. More specifically, the present invention is directed to an image forming apparatus equipped with a document feeder which automatically feeds an original document inserted from the outside to deliver it to an image forming station in an image forming apparatus and automatically discharges the document outside after a predetermined process is effected inside the image forming apparatus.

(2) Description of the Prior Art

In an image forming apparatus such as copiers, a copy document is placed on a transparent original table and then covered by an original cover. Then, as the operator starts the copying switch, a duplicated image of the original placed is reproduced on a sheet of paper as is conveyed in a proper manner.

In this case, if the copy original is of sheet-like material, it is troublesome to handle the document manually and place it on the original table. To deal with this, some copiers have an automatic document feeder on the top of the original table. That is, this document feeder has a document tray on which sheet-like original documents are placed and automatically delivers the sheet document by means of a paper feeding means. The document feeder successively feeds original documents placed on the document tray, one by one, from the topmost or lowermost sheet, in accordance with instructions from the copier body and delivers it to a station where the original is exposed to light. After the exposure, the feeder discharges the original to a document discharging tray. Since the document feeder is thus constructed, the apparatus becomes markedly large-sized and expensive.

Hence, when the automatic document feeder is attached to the copier body, the cost naturally becomes increased. In a case where one or some documents are to be copied, the use of automatic document feeder, rather takes time for copying a first document because the operator should set the document or documents on the document tray and then wait for the operation to start until both the copier and the document feeder become ready to make synchronism with one another. Accordingly, the automatic document feeder takes as much time as operator's manual handling of documents, if the number of documents to be copied is few.

Accordingly, in order to effect reduction in cost and other purpose, an automatic document feeder as shown in FIG. 1 has been proposed in Japanese Patent Application Laid-Open Hei 6 No.67,497. This document feeder has two exposure portions, or includes, in addition to a typical original table on which a document is placed and exposed to light to effect image forming, a separate exposure station to which a sheet original is inserted and conveyed one by one. In the figure, the document feeder designated at 102 is attached to an original cover 126 pivotably supported by a shaft 125, and includes: a document tray 130 utilizing the top face of the original cover 126; a drawing roller 131 for pulling a document D from the document tray 130; a feed roller 132; a guide plate 133 for guiding the document D to an exposure portion A on one side of an exposure glass 120; and a discharging roller 136 for conveying the original D from the exposure portion A.

In this arrangement, as the document feeder 102 starts to operate, a document D is fed from the document tray 130 and conveyed by a platen roller 134 and a driven roller 137 as nipped between the rollers. Then, the document D are passed through the discharging roller 136 and discharged to the output tray 135. In the meantime, in an optical system 121, a copy lamp 122 is moved right below the platen roller 134 and positioned at that place while the document D is moved through the exposure area A on the exposure glass 120 and copied.

In a normal copying operation where a document D is placed on the transparent original table 120 for image exposure and scanned by moving the optical system 121 along the exposure glass 120 to make a copy, the copy lamp 122 and the like are driven in response to a copy start signal to a position where exposure is to be made and then starts scanning in an exposure area B from the left to the right in the figure to complete a copy.

In the above document feeder disclosed in Japanese Patent Application Laid-Open Hei 6 No.67,497, since the original cover over the exposure glass serving as an original table is used to deliver documents successively to the exposure station, the cost can be more or less reduced.

Nevertheless, since the different exposure area A is provided separately from the normal exposure area B so that the document from the document feeder is exposed in the exposure area A, the optical system must be controlled to move from the exposure position where the document is conveyed to the exposure position where the document is placed on the original table 120. Accordingly, the document feeder of this type also becomes complicated in structure and large-sized as the conventional automatic document feeder. Further, the document feeder requires both the document tray and the discharge tray for conveying documents from the former to the latter. In this respect, the document feeder is the same as the conventional automatic document hander, resulting in increased cost for that part.

SUMMARY OF THE INVENTION

It is therefore an object of the present invention to provide a document feeder having a simple structure, down-sized, reduced in cost and still having good operating performances. The present invention is to provide a document feeder which is convenient, in particular, for effecting copying operation of a single, or some or several documents and is able to convey a document to an exposure position where a document is placed when a manual operation is to be made.

A second object of the invention is to provide a document feeder which includes an original cover pressing a document onto an original table and a mechanism for lifting the original cover up when a document is conveyed to an exposure position, whereby a document can be reliably conveyed, and can be pressed against the original table after the document is placed on the document table.

A third object of the invention is to provide a document feeder for an image forming apparatus having a linking mechanism which enables a document feeding means disposed on the original cover side to be linked with a diving means on the image forming apparatus side, whereby a driving force from the apparatus body side can be transmitted to the document feeding means on the original cover side.

A fourth object of the invention is to provide a document feeder capable of realizing reliably guidance and delivery of a document into a gap between an original cover and an original table in an image forming apparatus.

The present invention has been achieved to attain the above objects, and the gist of the invention are summarized as follows:

In accordance with a first aspect of the invention, a document feeder for use in an image forming apparatus includes: an original table having an original document placed thereon and exposing the original image to light; and an original cover hinged pivotably on one side thereof to be opened and closed for pressing a document onto the original table, and the document feeder comprises: document detecting means disposed on the top surface of the image forming apparatus body, for detecting a document inserted from the outside; a feed roller disposed adjacent to the document detecting means, on the top surface of the apparatus body, for feeding an inserted document into a space between the original table and the original cover, in response to the detection of a document by the document detecting means; and original cover lifting means disposed on the top surface of the apparatus body, for lifting the original cover to create a gap between the original table and the original cover, in response to the detection of a document by the document detecting means.

A second aspect of the invention is characterized in that, in the first configuration, the image forming apparatus further includes a control panel having top and front plates disposed on the top and front faces of the image forming apparatus body, and the document feeder is constructed such that the original detecting means, the feed roller and the original cover lifting means are formed on the top plate of the control panel.

A third aspect of the invention is characterized in that, in the first configuration, when the document detecting means detects that the document has passed therethrough in conveying the document, the feed roller stops turning with the rear end of the document nipped thereby.

A fourth aspect of the invention is characterized in that, in the third configuration, when the document is discharged, the feed roller stops turning with the front end of the document nipped thereby.

In accordance with a fifth aspect of the invention, a document feeder for use in an image forming apparatus includes: an original table having an original document placed thereon and exposing the original image to light; and an original cover hinged pivotably on one side thereof to be opened and closed for pressing a document onto the original table, and the document feeder comprises: feeding means disposed at a position where a document feeding port is formed between the original cover in its closing position and the top surface of the image forming apparatus body, for feeding an inserted document toward the original table; detecting means disposed before the feeding means for detecting an inserted document; controlling means controlling the operation of the feeding means in response to the detection by the detecting means so as to control insertion and discharge of an inserted document; and lifting means in link with the rotation of the feeding means so as to lift the original cover up from the original table, forming a gap.

A sixth aspect of the invention resides in that a document feeder according to the fifth configuration, further include: a rotational member which is disposed rotatably relative to the original cover and can be rotated between a first position over the original cover and a second position over the top plate of the image forming apparatus body, the rotational member serves as guiding means for guiding an inserted document toward the feeding means when placed in the second position; and a linking mechanism for linking the feeding means with driving means in the image forming apparatus body when the rotational member is placed in the second position for guiding a document.

Seventh and eighth aspects of the invention reside in that a document feeder according to the fifth and sixth configurations, respectively, is constructed so that the lifting mechanism lifts the original cover when the feeding means rotates in a forward direction to deliver the document, and cancels the lifted state of the original cover and allows the original cover to press itself against the original table when the feeding means is driven in the reverse direction.

Ninth through twelfth aspects of the invention reside in that a document feeder according to the fifth through eighth configurations, respectively, is constructed so that a bent portion is formed in the original cover to create an inclined clearance between the original cover and the original table, on the side to which a document is conveyed by the feeding means.

In the thus comprised configuration of the invention, the original cover is manually opened and closed relative to the original table to allow the user to place a document on the original table and perform an image forming operation. In addition to this, it is possible to utilize the document feeder, in order to automatically deliver documents onto the original table. Specifically, with the original cover closed over the original table, as a document is inserted into the document feeding port where the feed roller is disposed, this operation moves the document detecting lever, whereby the inserted document is detected. In response to the detection, the document feed roller starts turning in the forward direction to convey the document onto the original table. At that moment, although the original cover is in close contact with the original table by the weight thereof, the lifting mechanism is moved in link with the rotation of the feed roller to lift the original cover by a gap 'd' from the original table. This operation can be done in such a manner that a rotary cam provided on the shaft of the feed roller turns in link with the feed roller and a part of the rotary cam abuts the top plate of the image forming apparatus body to thereby raise the original cover. Accordingly, the original cover is spaced by the gap 'd' from the original table, whereby the inserted document is conveyed onto the original table by the rotation of the feed roller. At that time, the document is gradually conveyed onto the original table as being guided by the inner side of the original cover.

The conveyance by the rotation of the feed roller is helped by the rotational member as a document guide which is rotated from a retracted position where the rotational member is typically served as a document stocker. As the rotational member is set in place, the feed roller is made to link with the driving means provided on the image forming apparatus side. That is, when the rotational member is retracted as the original stocker and the document feeder is unused, the feed roller will not be activated even if the detecting lever is operated. Accordingly, even if the feed roller is provided on the original cover side, the apparatus can be handled safely and there is no need for providing driving means of the feed roller on the original cover side.

After the document is fed by the feed roller, the feed roller is rotated in the reverse direction. This reverse rotation causes the lifting mechanism to cancel the lifted state of the original cover. Specifically, since the rotary cam which rotates in link with the rotation of the feed roller for lifting up the original cover is reversely rotated, the rotary cam is displaced from its abutting position where one part of the rotary cam abuts the top plate of the image forming apparatus body, to thereby cancel the lifted state of the original cover. Consequently, the original cover sinks to come in pressure contact with the original table due to its weight. Accordingly, if the sheet document fed has more or less wrinkles and irregularity, these can be smoothed out to thereby bring the document with wrinkles and irregularity corrected, in close contact with the original table. Therefore, it is possible to create an image output free from shadows due to wrinkles and irregularity on the original document.

Further, since an inclined surface is formed on the inner side of the original cover on the feeding side of documents to create a wider clearance from the original table; when the gap 'd' created by the lifting mechanism is set up slightly greater than the thickness of documents, it is possible to prevent a document from becoming stuck on its front end with the original cover, whereby the conveyance can be done without disturbance. Specifically, it is possible to prevent the document from being stuck when the front end of the document enters the gap 'd', therefore smooth guidance of the document into the gap 'd' can be established.

When the feed roller is adapted to stop its rotation with the rear end of the document nipped thereby, it is possible to automatically discharge the document by reversely rotating the feed roller. Further, when the discharging distance of the document by the reverse rotation of the feed roller is set up to be shorter than that at the feeding operation, the feed roller will stop with the front end of the document nipped thereby. Accordingly, it is possible to prevent the document from falling down.

DESCRIPTION OF THE PREFERRED EMBODIMENTS

Figure 1:
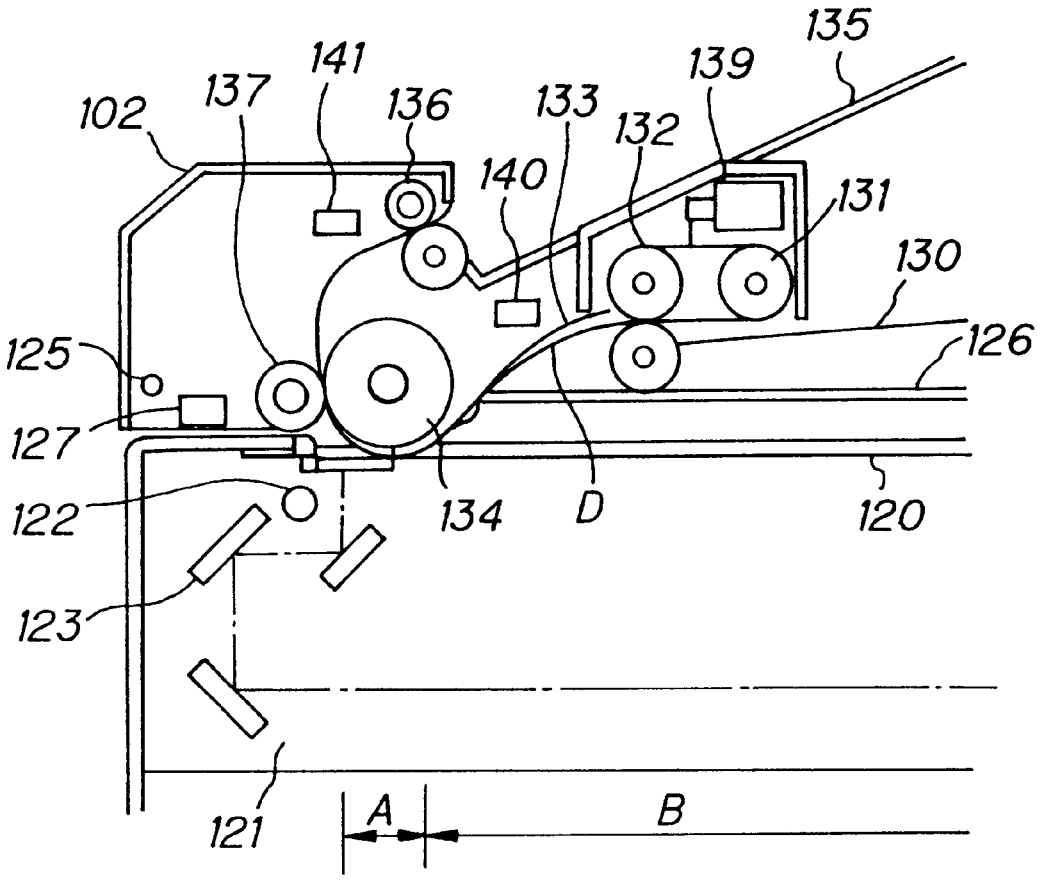
FIG. 1 PRIOR ART
FIG. 1 is a constructional view showing a prior art document feeder.
Figure 2:
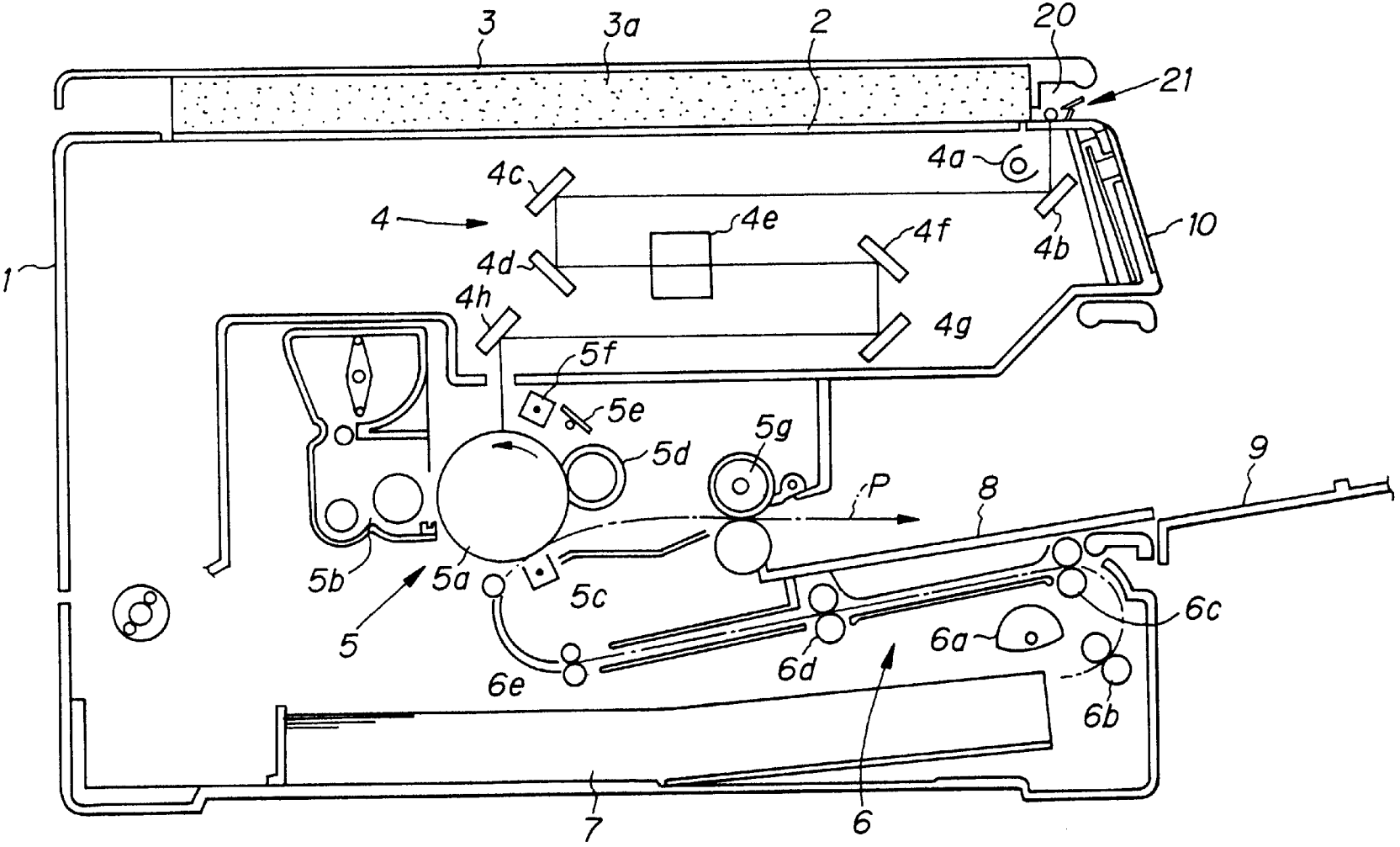
FIG. 2 is an overall constructional view showing a copier equipped with a document feeder in accordance with the present invention.

A first embodiment of the present invention will be described with reference to the accompanying drawings. FIG. 2 is an overall constructional view of a copier equipped with a document feeder of the present invention. The copier includes: an original table glass 2 on top of an appliance body 1; an original cover 3 over the original table glass 2; and an optical system 4 under the original table glass 2. The original cover 3 is to press an original document placed on the original table glass 2 and has a document pressing mat 3*a* attached to the undersurface thereof.

The optical system 4 includes: an exposure lamp 4*a* for light-scanning the document placed on the original table glass 2; mirrors 4*b*, 4*c* and 4*d* for leading reflected light from the original; a lens 4*e* for enlarging the reflected light having passed through the mirrors 4*b* to 4*d*; and mirrors 4*f*, 4*g* and 4*h* for leading the enlarged reflected light to the exposure point on the surface of a photoreceptive drum 5*a* positioned in a central part of the appliance.

Provided around the photoreceptive drum 5*a* are a developing unit 5*b*, a transfer charger 5*c*, a cleaning unit 5*d*, an eraser lamp 5*e* and a main charger 5*f* in that order. A fixing roller 5*g* is disposed in a position apart from the photoreceptive drum 5*a*. All the units are the elements constituting a copy processing system 5.

An electrostatic latent image formed on the exposure point on the surface of the photoreceptive drum 5*a* is developed into a toner image in the developing unit 5*b*. The toner image is transferred to a copy sheet P by means of a transfer charger 5*c* and then fixed on the copy sheet by the fixing roller 5*g*. The copy sheet P is conveyed by a paper feeding system 6 to be described hereinbelow.

Provided in the bottom of the appliance body 1 is a paper storage 7. A feed roller 6*a* is disposed above the paper storage 7 in the front part (right side in the figure) of the appliance body. Copy sheets P stored in the paper storage 7 are fed by the feed roller 6*a*, one by one, from the topmost of the stack, and then conveyed to a paper stop roller 6*e* by means of feed rollers 6*b*, 6*c* and 6*d*. These rollers 6*a* through 6*e* constitute a paper feeding system 6 for feeding the copy sheet P to the photoreceptive drum 5*a*.

The copy sheet P conveyed to the paper stop roller 6*e* is delivered toward the photoreceptive drum 5*a* in synchronization with the timing of the scan by the exposure lamp 4*a*. Then, a toner image is transferred to the sheet P by the transfer charger 5*c*. The sheet P with the toner image transferred is fixed by the fixing roller 5*g*. The copy sheet P with the toner image fixed by the fixing roller 5*g* is then discharged to the paper discharging guide 8 and stacked onto the feeder output tray 9.

Figure 3:
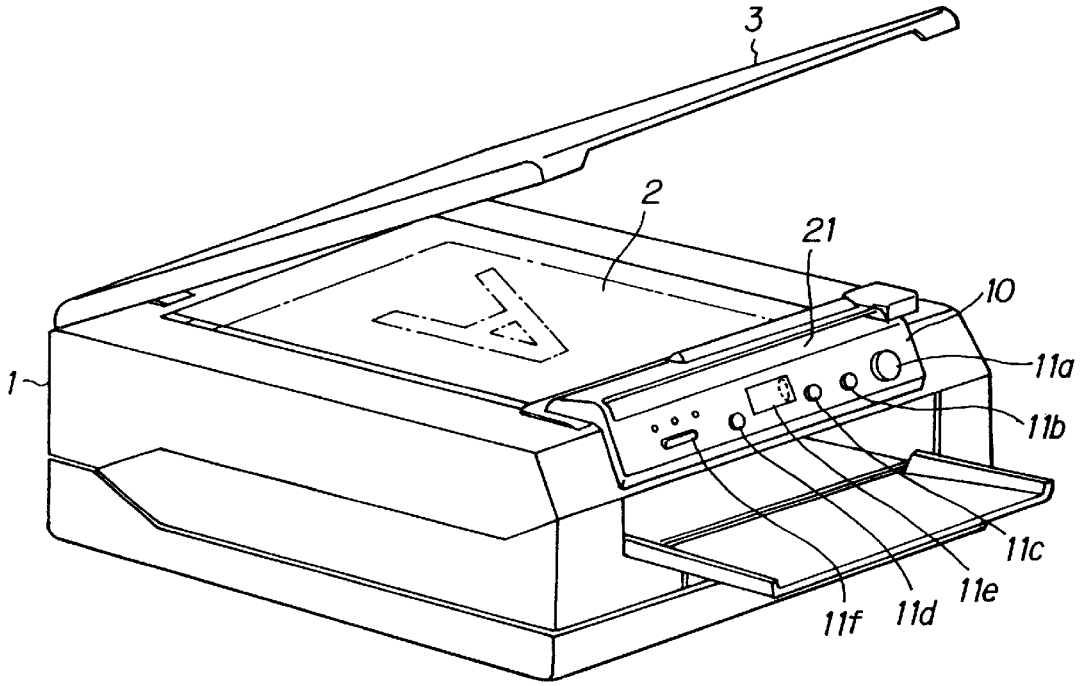
FIG. 3 is a perspective appearance view showing the copier shown in FIG. 2.

A control panel 10 is provided on the front side (right side in the figure) of the appliance body 1 above the opening portion of the paper discharging guide 8. As shown in an appearance perspective view of FIG. 3 and an enlarged structural view in FIG. 4, the control panel 10 includes a copy button 11*a*, a clear key 11*b*, a copy number setup key 11*c* and 11*d*, a copy number indicator 11*e* and an exposure adjusting key 11*f* for adjusting the contrast of the copy. All these elements are disposed on an inverted L-shaped, front panel 10*a*. A document feeder 20 of the invention is disposed on the top plate 10*b*.

The document feeder 20 is disposed in front of the document pressing mat 3*a* under a front grip portion of the original cover 3. This document hander 20 includes: a document feeding port 21 through which original documents are inserted; a document detecting lever 22 which is pressed up by the document inserted to turn on a document detecting switch; and a feed roller 23 for feeding the inserted document onto the original table glass 2.

Figure 4:
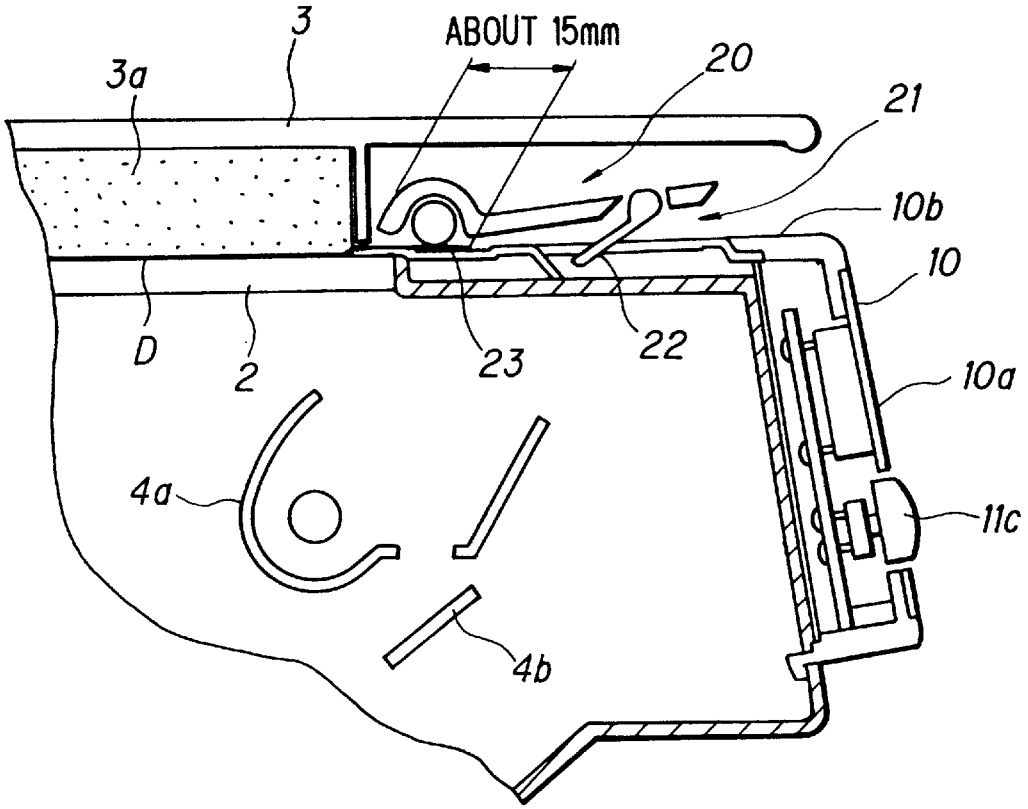
FIG. 4 is a constructional view showing an embodiment of a document feeder in accordance with the present invention.
Figure 5:
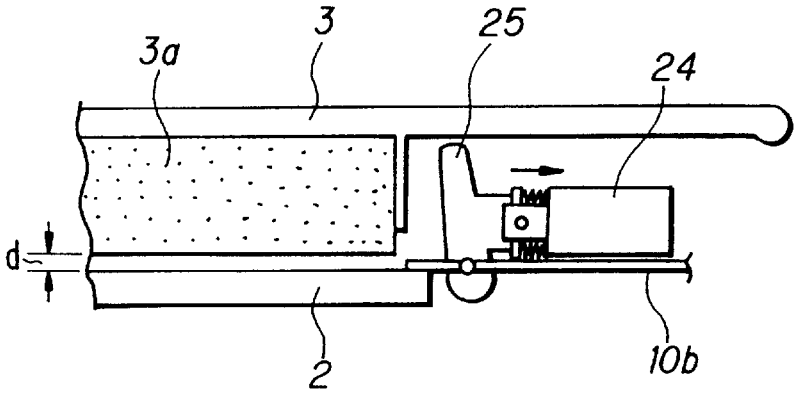
FIG. 5 is a constructional view showing a part of a document feeder of the present invention.

On the rear side in FIG. 4, a solenoid 24 having a moving piece 25 as an original cover raising means is disposed, as shown in FIG. 5, in order to move the original cover 3 up and create a clearance 'd' between the original table glass and the document pressing mat 3*a*. In the above configuration, a means for turning on the document detecting switch should not be limited to the document detecting lever 22. In place of the lever 22, a light sensor may be used.

Figure 6:
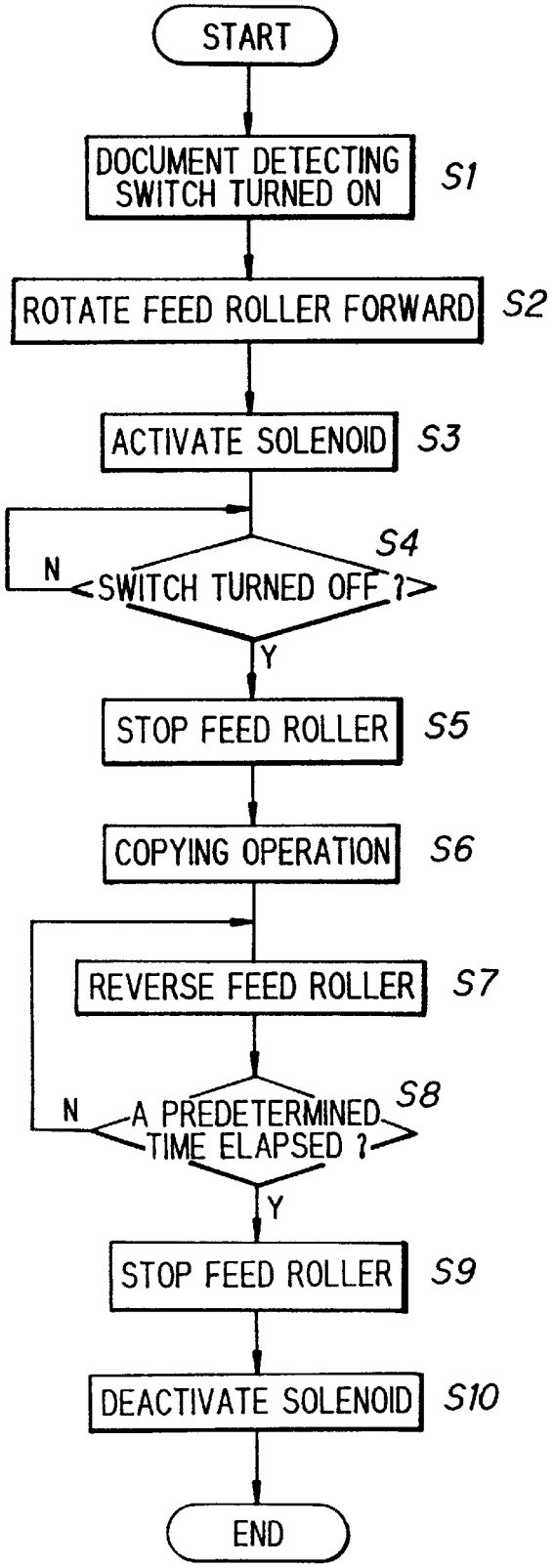
FIG. 6 is a flowchart for illustrating the operation of the document feeder of the invention.
Figure 7:
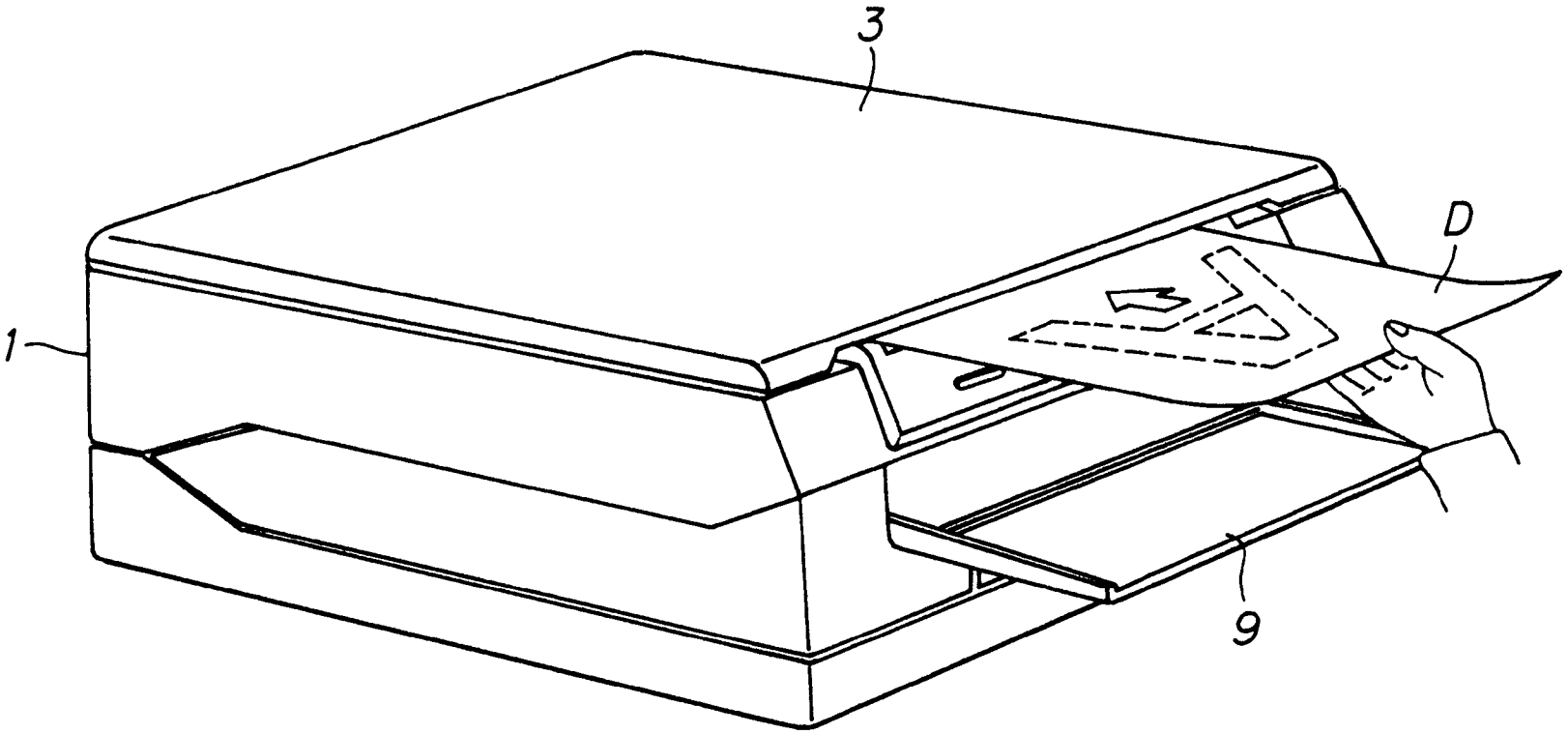
FIG. 7 is a view showing a used state of the copier equipped with a document feeder of the invention.

Referring next to a flowchart shown in FIG. 6, the operation of the document feeder 20 and the copier body will be described. As shown in FIG. 7, as a document D is inserted from the document feeding port 21 with the original cover 3 closed, the detecting lever 22 is moved up by the document D to turn on the document detecting switch (Step S1).

When the document detecting switch is activated, the feed roller 23 starts to rotate in the forward direction (Step S2). In time with this movement, the solenoid 24 is activated to raise the original cover 3 to create a gap between the original table glass 2 and the document pressing mat 3*a* (Step S3). This movement allows the document D to be inserted onto the original table glass 2 without friction. In this insertion, the undersurface of the original cover 3 serves as a document guide. The clearance should preferably be 0.1 mm or more since a typical sheet of paper is 0.08 mm thick.

When the document D goes through the detecting lever 22, the document detecting switch is turned off (Step S4). This deactivates the feed roller 23 (Step S5) and therefore the document D stops with its rear end nipped by the feed roller 23.

Then, as the document D is automatically fed onto the original table glass 2, the copier enters the copying operation in the same manner as the copy button 10*a* is pressed. That is, the copier starts to effect copying process from the exposure to discharging the copied sheet (Step S6).

In the above case, since the copying operation is performed with the rear end of the document D nipped by the feed roller 23, the document D is positioned in a place deviated about 15 mm, as shown in FIG. 4, from where the document is to be placed when the document feeder 20 is not used. In order to cancel this deviation, in this embodiment, the operating timing of the paper stop roller 6*e* is adjusted appropriately so that the front end of the document D may correspond to that of the copy paper.

Figure 8:
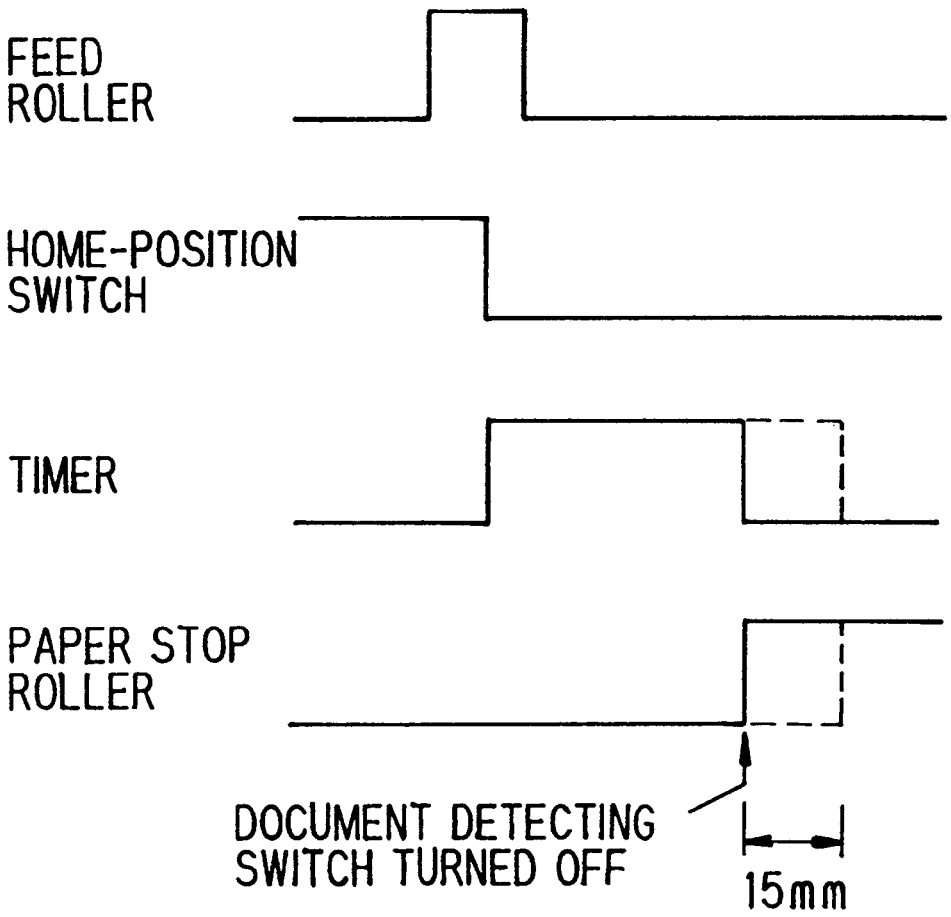
FIG. 8 is a timing chart for illustrating the operation of a document feeder of the invention.

Specifically, the situation when the document detecting switch is activated, is equivalent to the situation when the copy button 11*a* is pressed. Therefore, as the document detecting switch is turned on, the rollers 6*a* through 6*d* in the paper feeding system 6 start to rotate and the copy sheet is fed from the paper storage 7 and then is stopped by the paper stop roller 6*e*. When the home-position switch of the optical system 4 is turned off, a timer is made to start. With reference to the time when the document detecting switch is changed over from the turn-on to the turn-off, the paper stop roller 6*e* is activated earlier by a time equivalent to a paper feed distance of about 15 mm than in the normal using state where the document feeder is not used. Thus, the front ends of the document D and the copy paper may coincide with one another. The timing chart of this method is shown in FIG. 8.

As the copying operation at Step S6 is completed, the feed roller 23 turns in the reverse direction (Step S7) to discharge the document D to the document feeding port 21. In order to realize easy handle of document, the discharging operation is performed by memorizing the rotating time of the feed roller 23 when the document D is inserted and measuring a setup time which is a little shorter (by a time equivalent to about 10 mm in feed distance) than the memorized time (Step S8) and stopping the reverse rotation of the feed roller 23 after the passage of the thus setup time (Step S9). Accordingly, the document D stops at a position where the end of the document D is nipped by the feed roller 23 so as not to fall for easy pickup.

In the above embodiment, although the description was made for the case where one copy is to be made, it is possible to set up the copier so that the document D is discharged after a designated number of copies (set by copy number setup keys 11*c* and 11*d*) are produced as usually done in the copier.

Further, it is also possible to repeat copying operation of the discharged document D. That is, if, without removing the discharged document D, the copy button 11*a* is re-pressed in a state where the rear end of the copy sheet is nipped by the paper stop roller 6*e*, the discharged document is fed again to repeat the convey and discharge operation, thus making it possible to produce a plurality of copies.

In accordance with the invention, since the document feeder is provided on the top of the appliance body, specifically on the top of the original table, the device can be reduced in volume to one fifth or less as compared to the conventional document feeder that is integrated with the original cover, making it possible to realize a great reduction in cost. Since the document feeding port is provided above the control panel on the front side, this configuration allows the user to handle the copier from the front, resulting in markedly improved handling performances.

Further, if the document feeder of the invention is provided for a copier having a copy-sheet output port under the control panel, the original document and the copy sheet are simultaneously discharged from the upper and lower portions of the control panel, respectively. Accordingly, the operating performances can be markedly improved when the user mainly uses the copier for copying one or several documents.

A second embodiment of the invention will be explained with reference to the drawings.

Figure 9:
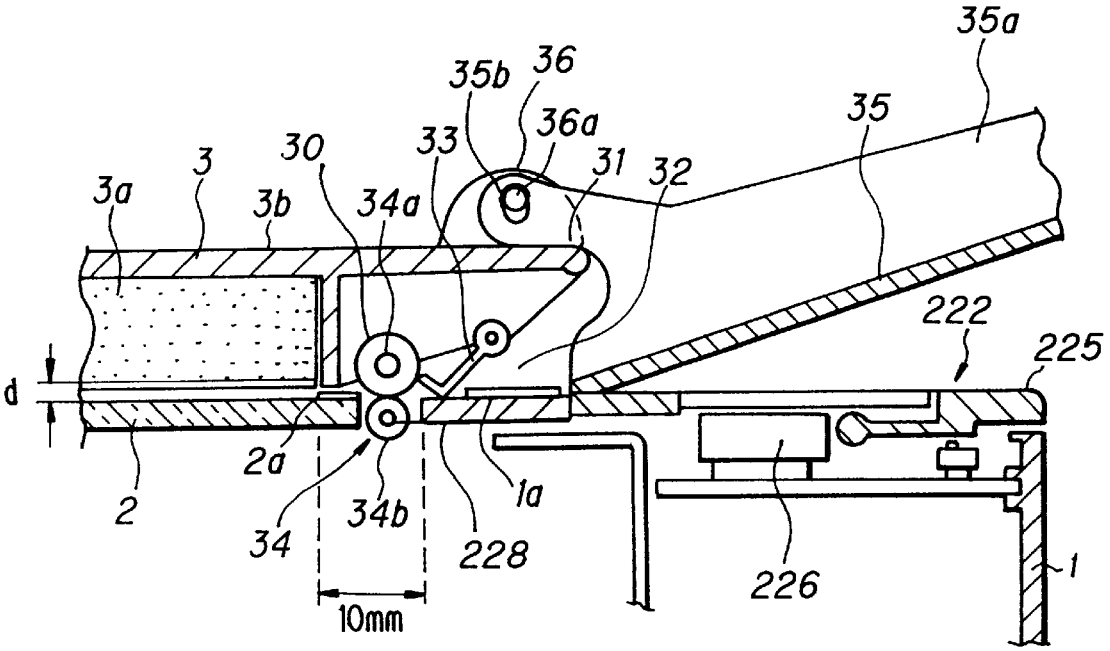
FIG. 9 is a sectional view showing essential components constituting a document feeder equipped in one embodied apparatus of the invention.
Figure 10:
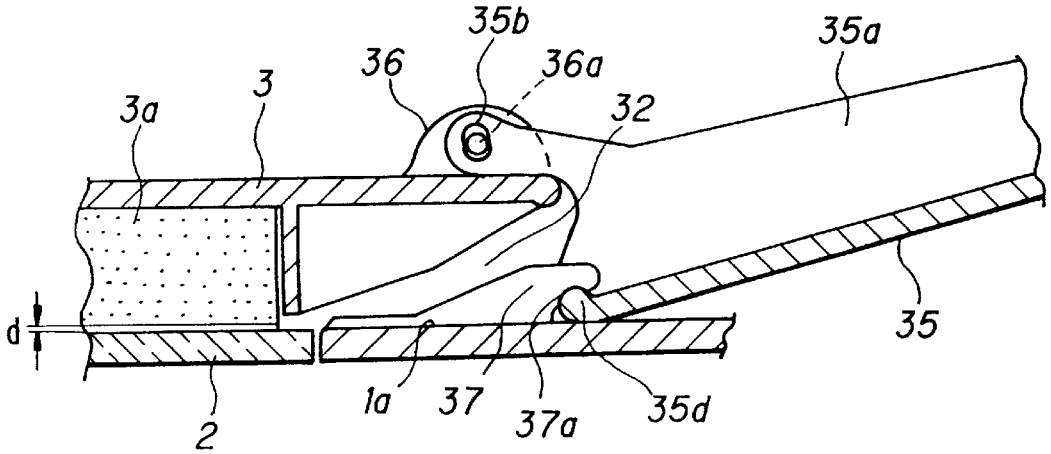
FIG. 10 is a sectional view showing a mechanism and state of lifting an original cover from an original table in a document feeder provided in an embodied apparatus of the invention.
Figure 11:
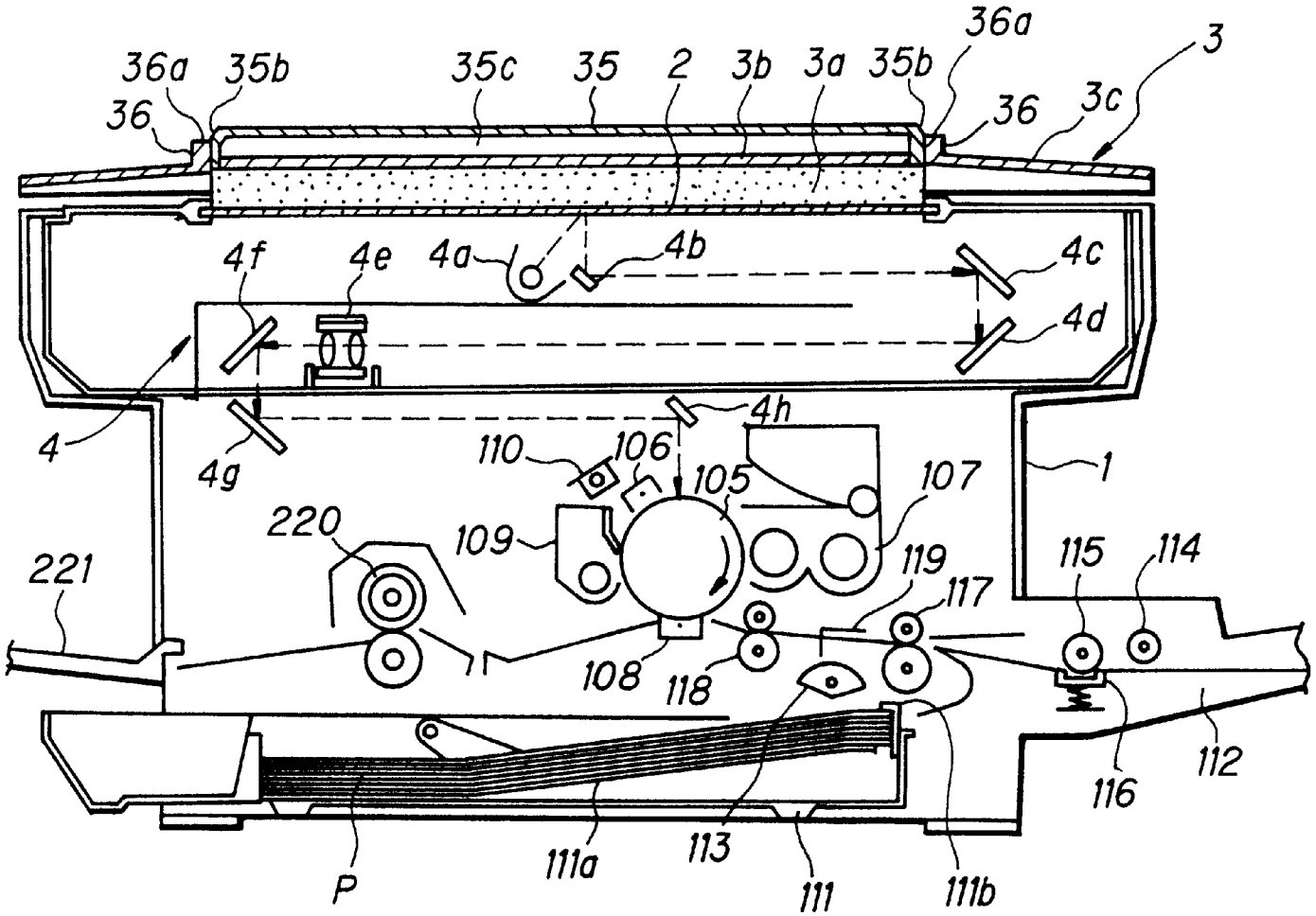
FIG. 11 is a schematic sectional view showing an internal structure of a copier as an image forming apparatus including a document feeder of the invention.
Figure 12:
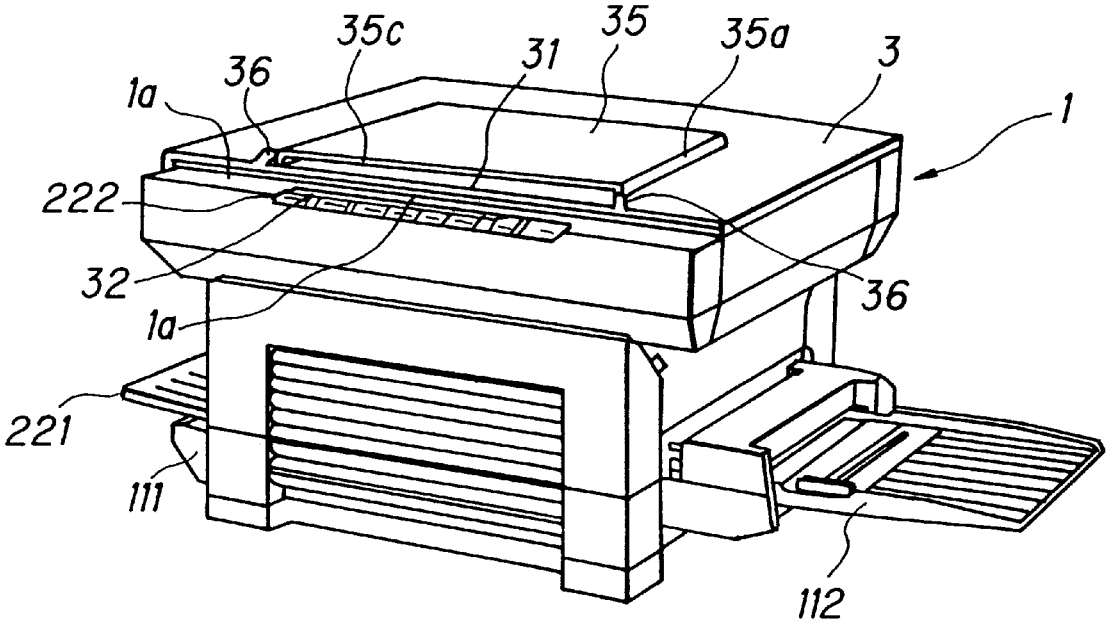
FIG. 12 is a perspective view showing an appearance of a copier as an image forming apparatus including a document feeder of the invention.

FIGS. 9 and 10 are sectional views showing a document feeder of the invention when it is in operation. FIGS. 11 and 12 show an image forming apparatus equipped with a document feeder of the invention; specifically, FIG. 11 is a sectional view showing the internal structure of the copier and FIG. 12 is a perspective appearance view.

Referring first to FIGS. 11 and 12, the copier includes: an original table 2 for image exposure, of a transparent glass, disposed on a copier body designated at 1; and an original cover 3 disposed over the original table 2 and pivoted on one side in the rear part in the figure so as to be opened and closed. An optical system 4 is disposed inside the copier body 1 under the original table 2. The original cover 3 is to press the document placed on the original table glass 2 against the surface of the original table and is composed of an outer plate 3*b* formed of a relatively hard plastic resin and a document pressing mat 3*a* formed of a relatively soft material and attached inside the outer plate on the side facing the original table.

The optical system 4 includes: an exposure lamp 4*a* for light-scanning the document placed on the original table glass 2; mirrors 4*b*, 4*c* and 4*d* for leading reflected light from the original; a lens 4*e* for converging the reflected light having passed through the mirrors 4*b* to 4*d*; and mirrors 4*f*, 4*g* and 4*h* for leading the thus converged reflected light to the exposure point on the surface of a drum-type photoreceptor 105 positioned in a central part of the appliance. Particularly, the exposure lamp 4*a* and the reflecting mirror 4*b* are supported by a first moving member while the mirrors 4*c* and 4*d* are supported by a second moving member. The two moving members are moved in parallel with the original table 2, right and left in the figure. Specifically, the second moving member is driven at a half speed as fast as the first moving member moves. With this configuration, it is possible to pick up an image on the document placed on the original table 2 and guide the light image to be focused in a desired magnification onto the surface of the photoreceptor 105.

The aforementioned photoreceptor 105 is to form an image of the original placed on the original table 2. Provided around the photoreceptor are a main charger 106 for uniformly charging the photoreceptor surface, a developing unit 107 for developing an electrostatic latent image after exposure with colored toner, a transfer unit 108 for transferring the thus formed toner image onto a sheet material conveyed in time, a cleaning unit 109 for removing residual toner on the drum after the transfer, and an erasing lamp 110 for making the surface potential of the photoreceptor uniform for a next process. All the units are disposed around the photoreceptor 105, in the order of the description and constitutes an image processing system for image forming.

Separately from the above image processing system for image forming, a feeding system is provided inside the copier. The feeding system is to deliver a sheet of paper to the transfer station where toner image is transferred to the paper by the transfer unit 109 and peel off the paper with the toner image transferred, from the drum and discharge the paper outside the copier body. This feeding system comprises: a paper feeding port for feeding sheets of paper; a conveying portion for conveying the fed sheet to the aforementioned transfer station; and a paper discharging portion for discharging the paper with toner image transferred to the outside of the copier body.

The above paper feeding port includes: a paper holding portion (paper cassette) 111 detachably disposed on the bottom of the copier body 1; and a bypass feed tray 112 projected outside from the copier body 1 for manual insertion of paper.

Provided over the front (right in the figure) end portion of the paper holding portion 111 is a substantially semicircular feed roller 113, which delivers copy sheets P held in the paper holding portion 111, one by one from the topmost. Particularly, the paper holding portion 111 comprises: a rotating member 111*a* rotatably holding sheets P on the upper face thereof; unillustrated springs to urge the rotating member upward; and separating claws 111*b* for allowing sheets to be delivered one by one, and constructed so that the separating claws 111*b* regulates the topmost position of the sheets accommodated in a predetermined height.

The bypass feed tray 112 has a paper feeding means to successively deliver sheets one by one in response to the paper feed instruction. This paper feeding means comprises: a feed roller 114 for drawing one or more sheets placed on the tray 112; and a delivering means composed of a delivering roller 115 and a separating member 116 for preventing two sheets from being delivered at the same time.

The conveying portion for conveying the sheet delivered through the paper feeding port of the above structure includes a pair of feed rollers 117 and 118. Provided on the downstream side (with respect to the sheet feed direction) of the feed roller 117 is a paper stopper plate 119, which temporarily stops the sheet conveyed by the feed roller 117. This paper stopper plate 119 is to start conveying the delivered sheet so that the front end of the sheet is adjusted with the front end of the toner image formed on the photoreceptor 105. That is, the paper stopper plate 119 is moved to open the feed passage in conformity with the rotational position of the photoreceptor 105, whereby the thus freed sheet is conveyed to the transfer station by the feed roller 117 and the conveyer roller 118 placed immediately before the transfer station. Thus, these components constitute the paper conveying portion for conveying the copy sheet P to the transfer station which is opposed to the photoreceptor 105.

The sheet P passing through the transfer station is peeled off from the surface of the photoreceptor 105 and then lead to pass through a heat-fixing unit 220 which is disposed in the feed passage before the outside of the copier. This heat-fixing unit 220 is composed of a pair of rollers, that is, a heat-roller and a pressing roller which is pressed against the heat roller. The heat-fixing unit 220 conveys the sheet P as pressing it so that the unfixed toner image is fused by heat and fixed to the sheet. The sheet having passed through the heat-fixing unit 220 is discharged to the output tray 221 detachably disposed at the discharge port formed in the copier body 1. Thus, the paper discharging portion after the transfer is constructed.

The copier shown in FIG. 11 operates as follows: An image on the original document placed on the original table 2 is light-projected by the optical system 4, onto the photoreceptor 105 which has been uniformly charged by the main charger 106. The light projection of the original image creates an electrostatic latent image on the photoreceptor. The static latent image is then visualized into a toner image. This toner image is electrostatically transferred to the copy sheet being delivered in time by the above-described paper feeding system. The sheet with the toner image transferred is then delivered to the heat-fixing unit 220 where the toner image is fixed to the sheet as the sheet being conveyed. Then, the copy sheet P is finally discharged to the output tray 221.

Figure 13:
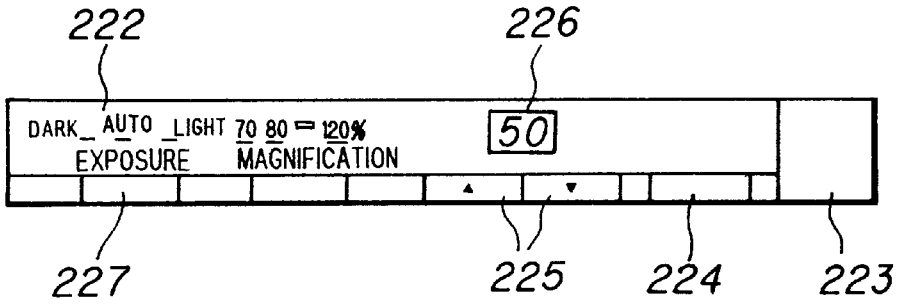
FIG. 13 is a plan view showing an example of a control panel used in an embodied apparatus of the present invention.

Provided below the original cover 3 on the front top of the thus configurated copier body 1 is a control panel 222 as shown in FIG. 12. This control panel 222 includes, as detailedly shown in FIG. 13, a copy button 223, a clear key 224, copy number setup keys 225, a copy number display portion 226, an exposure adjusting key 227 for adjusting whiteness and darkness of copy, and the like.

Meanwhile, the document feeder of the invention includes, as shown in FIGS. 9 and 10, the original cover 3, a part of the original cover and original feed rollers etc., disposed between the control panel 222 and the original cover 3. For example, a document feeder 30 comprises: a document feeding port 32 through which original documents are inserted; a document detecting lever 33 which is pressed up by the document inserted to turn on a document detecting switch; and feed roller unit 34 for feeding the inserted document onto the original table glass 2.

The aforementioned document feeding port 32 is positioned between a grip portion 31 of the original cover 3 and flat portion of a top outer plate 1*a* of the copier body 1 for mounting the original table 2 of the copier body 1. The feed roller unit 34 is disposed between the original table 2 and the control panel 222 in the flat portion of the top outer plate 1*a* of the copier body 1. The feed roller unit 34 is composed of a feed (driving) roller 34*a* disposed above for driving and a roller 34*b* below. The lower roller 34*b* is rotatably supported by a distal end of a leaf spring fixed at the other end to the upper frame and the like, disposed under the outer plate 1*a* so that the roller 34*b* comes into pressure contact with the feed (driving) roller 34*a*. The lower roller 34*b* may be provided on the copier body in such a manner, in place of being supported by the leaf spring, that the roller 34*b* is brought into pressure contact with the feed (driving) roller 34*a* by providing a spring or the like which urges the roller shaft upward.

The feed (driving) roller 34*a* of the above feed roller unit 34 is rotatably supported on the original cover side by a rotational shaft while rotational force is transmitted to the shaft from an unillustrated motor disposed in a site in the original cover 3.

The detecting switch as well as the detecting lever 33 for detecting an inserted document into the feed area toward the feed roller unit 34 also is disposed on the original cover side. When the original cover 3 is closed (or placed in the pressing state) over the original table 2, the detecting lever 33 is placed in an unillustrated depressed portion formed in the top outer plate 1*a* of the copier body. When a document is inserted, the lever 33 is lifted up above the outer plate 1*a*. This movement activates or turns on the document detecting switch, to thereby recognize the document. Particularly, if the lower roller 34*b* also is disposed on the original cover side, it is possible to easily provide the document feeder, even for a copier with no document feeder, by replacing the original cover 3.

As to the feed roller unit 34, although the feed (driving) roller 34*a* is, in particular, disposed on the original cover side, it is also possible to provide it for the copier body side like the lower roller 34*b*. In such a case, in order for the feed (driving) roller 34*a* not to become an obstacle when a document is manually placed onto the original table 2 with the original cover 3 opened and closed, the feed (driving) roller 34*a* should be capped by a separate covering member having an opening port on the document-inserting side thereof so as to allow the document to be inserted. Despite that the covering member protrudes more or less in the front portion above the original table 2, this arrangement allows the feed roller unit 34 to be accommodated inside, preventing the operator from jeopardy when placing documents. This configuration enables the switch and detecting lever 33 for document detection to be housed inside the covering member, simplifying the structure of the original cover 3.

Meanwhile, a document pressing mat 3*a* of a soft material such as sponge etc., is provided on the inner side of the original cover and usually comes in close contact with the surface of the original table 2, by the self-weight. Hence, even if the document being inserted is conveyed by the feed roller unit 34, the document can not be inserted into between the document pressing mat 3*a* and the original table 2, but will be stopped and become stuck. Accordingly, it is necessary to lift the original cover 3 up to create such a gap between the original table 2 and the document pressing mat 3*a* as to allow the document to pass therethrough.

As a configurational example of the lifting mechanism for lifting the original cover 3 up in accordance with the invention, the mechanism is adapted to link with the movement of the feed roller 34*a*. That is, when a document is conveyed to the original table 2 by the feed roller unit 34, the original cover 3 is lifted up from the original table 2, and after the document is set in place, the raised position of the original cover 3 is canceled by reversing the feed roller 34*a* in a limited period of time, whereby the original cover 3 is brought into close contact with the original table 2.

Before explaining the lifting mechanism of the invention, description will be made about a configuration where a document stocker 35 provided as a rotational member over the original cover 3 is used as a guide for document conveyance. The document stocker 35 is rotatably provided on a pair of pivots 36*a* formed on pivot supporters 36 provided for the grip portion 31 on the front part of the outer plate of the original cover 3. Therefore, the document stocker 35 has a bending portion 35*a* disposed on both sides and the rear side to define a space for accommodating documents etc., between the top face of the original cover 3 and itself. Formed on the front side of the stocker 35 is an opening 35*c* from which documents etc., are inserted into the top surface of the original cover 3. A pair of elongate pivot holes 35*b* are formed in the front part of the bending portion 35*a* on both sides of the stocker 35. The aforementioned pivots 36*a* are inserted into these holes 35*b* so that the document stocker 35 can rotate. Both the pivots 36*a* formed on the pivot supporters 36 provided on the front side of the outer plate 3*b* of the original cover 3 are fitted into these pivot holes 35*b*. Particularly, when the outer plate of the original cover 3 is made of a resilient material such as resins etc., it is possible to fit the pivots into the pivots holes by utilizing the resiliency. More specifically, the pivots 36*a* can be mated with the pivoting holes 35*b* by warping the bending portion 35 around the pivoting holes 35*b* so that the distance between the pivot holes 35*b* may become shorter than that of the pivots 36*a* on both the pivot supporters 36*b* and aligning pivots with respective holes and then releasing the deformation. Accordingly, the pivots 36*a* are fitted into respective pivot holes 35*b* so that the document stocker 35 is rotatably supported relative to the original cover 3.

Thus, the document stocker 35 is pivoted. When the document stocker 35 is placed over the original cover 3, a space is formed by the top face of the original cover 3 and the bending portion 35*a* of the document stocker 35, so as to allow documents and any other necessary articles to be accommodated therein. This document stocker 35 is constructed in such a size as to accommodate originals having a maximum size, especially, maximum width, capable of being copied, as shown in FIG. 11.

As stated above, the document stocker 35 can also be used as the document placing guide when copying is effected using the document feeder 30. For this purpose, the stocker 35 is pivoted up to the top position of the outer plate 1*a* of the copier body side and kept in a slanting position. To maintain this position, a pair of catching members 37 are provided, as shown in FIG. 10, in the corresponding positions to the pivot holes 35*b*. The catching member 37 protrudes in some degree toward the control panel 222 and has a hook portion 37*a* crooked more or less in the lower part thereof.

In position with the catching members 37, a pair of engaging portion 35*d* are formed on the side of the document stocker 35 to engage with the catching member 37. The engaging portions 35*d* are formed in the vicinity of the front part of the opening 35*c* of the document stocker 35, especially near the pivots 35*b*. Each engaging portion 35*d* has a projected form so as to be fitted into the hook portion 37*a*. Thus, the catching members 37 and the engaging portions 35*d* constitute an engaging mechanism for using the document stocker 35 as the document guide.

When the document stocker 35 which is placed over the original cover 3 as shown in FIGS. 11 and 12 is rotated to this side until the document stocker 35 is positioned over the control panel 222, the one end portion of the document stocker 35 abuts the flat surface of the outer plate 1*a* so that the document stocker 35 may not make a further rotation. In this condition, the projected, engaging portions 35*d* of the document stocker 35 are engaged into the aforementioned catching members 37. At the moment, the pivots 36*a* of the original cover 3 are fitted into the elongate pivot holes 35*b* of the document stocker 35. Accordingly, the pivots 36*a* of the original cover 3 are slid down by the weight of the original cover 3, so that the original cover 3 remains in close contact with the surface of the original table 2. That is, even if the document stocker 35 is rotated, the original cover 3 remains at a closely contacted state by the weight thereof.

Next, description will be made on the mechanism for lifting the original cover 3 from the original table 2 when the document stocker 35 is in the rotated position for guiding inserted documents.

Figure 14:
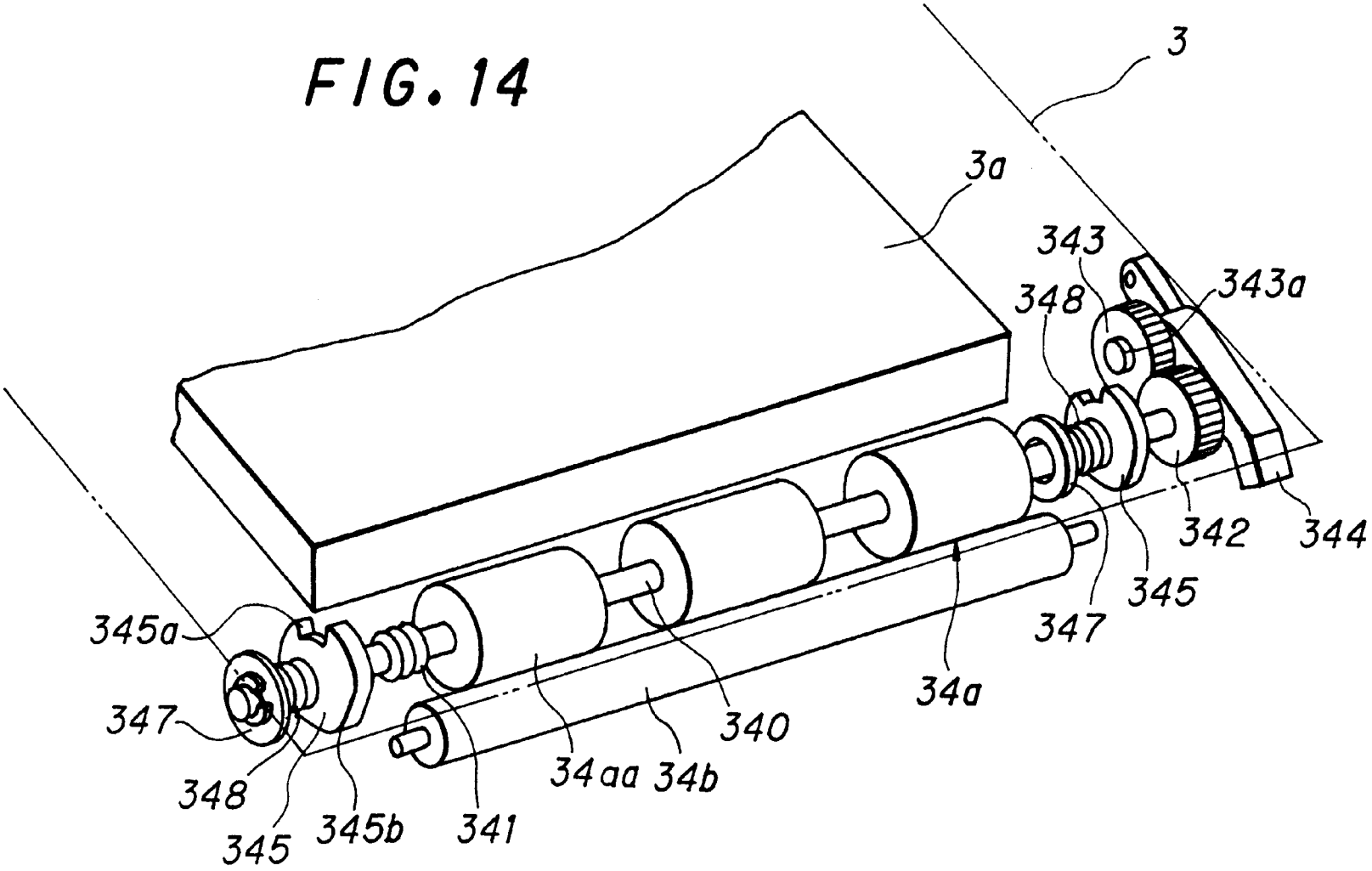
FIG. 14 is a perspective view showing in detail, a lifting mechanism of the invention, specifically, a mechanism of lifting an original cover in link with the operation of a document feeding means, with part of the original cover unshown.

FIG. 14 is a perspective view showing a lifting mechanism in a state where the outer plate 3*b* of hard material as a constituent of the original cover 3 is removed. In the figure, the feed roller 34*a* of the feed roller unit 34 has a plurality of feed roller elements 34*aa* attached on a shaft 340 which is supported rotatably by a bearing 341 attached on the side wall of the outer plate 3*b* of the unillustrated original cover 3.

A driven gear 342 for rotating the feed roller 34*a* is fixed to one end of the shaft 340. The rotating force is transmitted through a transmission gear 343 meshing the driven gear 342. The transmission gear 343 is rotated by rotational force transmitted from an unillustrated driving motor and rotatably supported by linking lever 344 as a driving linkage, which is pivotable on a shaft 343*a*. That is, when, for example, this linking lever 344 is moved down, the gear 343 will mesh a driving gear linked with the unillustrated driving motor.

Figure 15:
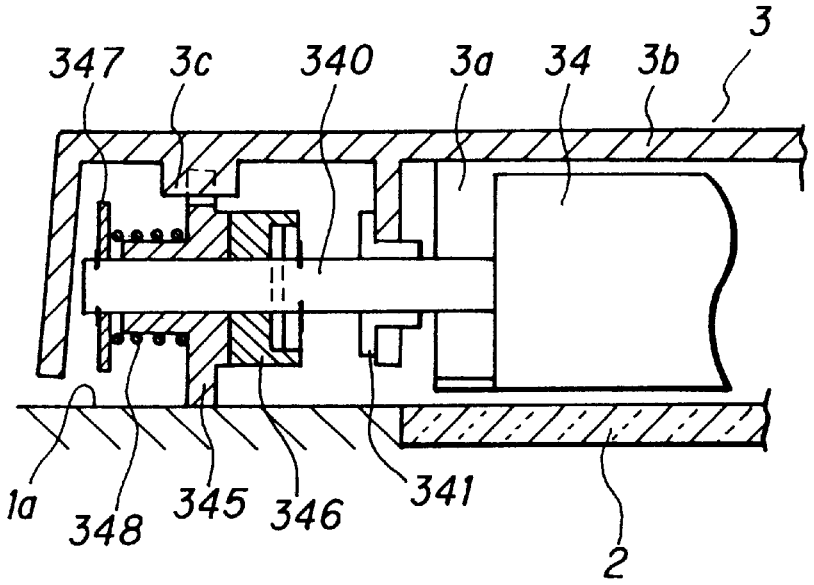
FIG. 15 is a sectional view showing a relation between a rotary cam and an original cover for a lifting mechanism of lifting an original cover in accordance with the invention.

A pair of rotary cams 345 for lifting the original cover 3 are rotatably provided near both ends on the shaft 340. This rotary cam 345, as shown in FIG. 15, is disposed between a frictional member 346 affixed to the shaft 340 by a pin etc., and a stopper 347 prevented from falling out by an E-ring while a coil spring 348 is interposed between the stopper 347 and the cam 345 so as to urge the cam 345 against the frictional member 346. Accordingly, the rotary cam 345 is rotated by the rotation of the feed roller 34*a*, but if any constraining force acted on the rotary cam 345 exceeds the frictional force caused by the coil spring 348 between the frictional member 346 and the cam 345, the cam 345 will not rotate but stop at the position even if the shaft 340 is driven.

Figure 16:
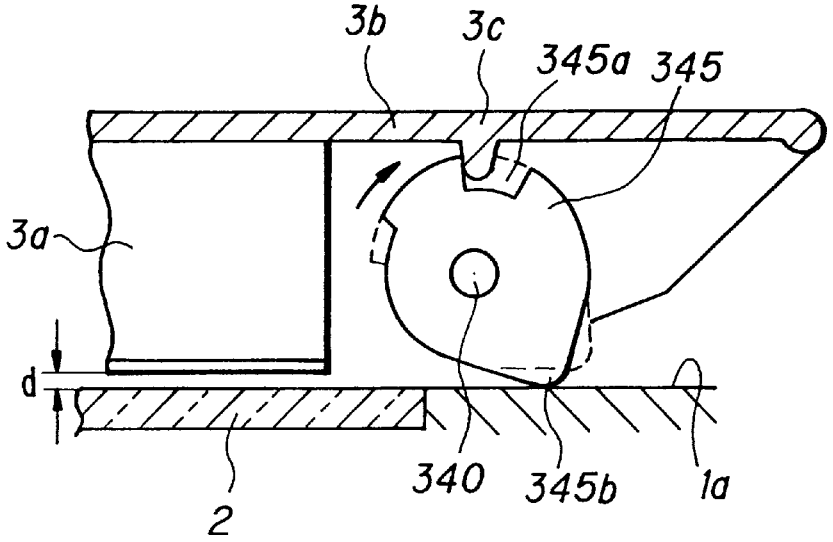
FIG. 16 is a sectional view showing a mechanism of lifting an original cover and a method of lifting an original cover from an original table in link with the movement of a feeding means.

The rotary cam 345 has a recess 345*a* on the peripheral side facing the outer plate 3*b* of the original cover 3, as shown in FIG. 16. A projection 3*c* is formed on the under-surface of the outer plate 3*b* in a corresponding position to the recess 345*a*. This projection 3*c* is to stop the rotary cam 345 as catching the recess 345*a*. In particular, when each side edge of the recess 345 abuts the projection 3*c*, the rotation of the cam 345 is constrained, so that the cam idles relative to the shaft 340. A lifting projection 345*b* for lifting the original cover 3 is formed on the rotary cam 345 in a position corresponding to the top outer plate 1*a* of the copier body.

In this arrangement, as the feed roller 34*a* rotates, the rotary cam 345 provided on the shaft 340 is linked with the frictional member 346 by the frictional force and rotated likewise. When one side edge of the recess 345*a* of the rotary cam 345 is caught by the projection 3*c* of the original cover 3 as shown in FIG. 16, the rotation of the cam stops and the feed roller 34*a* idly rotates alone. At that moment, the lifting projection 345*b* of the rotary cam 345 abuts the top outer plate 1*a* of the copier, as indicated by a solid line in FIG. 16, whereby the original cover 3 is lifted upward from the original table 2. In this case, the original cover 3 is able to move upward since the pivots 36*a* on the original cover 3 move elongate slots of the pivot holes 35*b* of the document stocker 35. Thus, the original cover 3 is lifted from the original table 2 to create a gap 'd'.

In contrast, as the feed roller 34*a* is rotated in the reverse direction, the rotary cam 345 also rotates similarly since the cam 345 is not restricted to rotate in that direction. When the other side edge of the recess 345*a* of the rotary cam 345 abuts the projection 3*c* (a state as indicated by a broken line in FIG. 16), the rotation is stopped. In this state, the lifting projection 345*b* of the rotary cam 345 is displaced from the top outer plate 1*a* as indicated by broken line in FIG. 16, the lifting state in which the original cover 3 is raised is canceled, so that the original cover 3 falls toward the original table 2 due to self-weight to come in close contact therewith.

Figure 17:
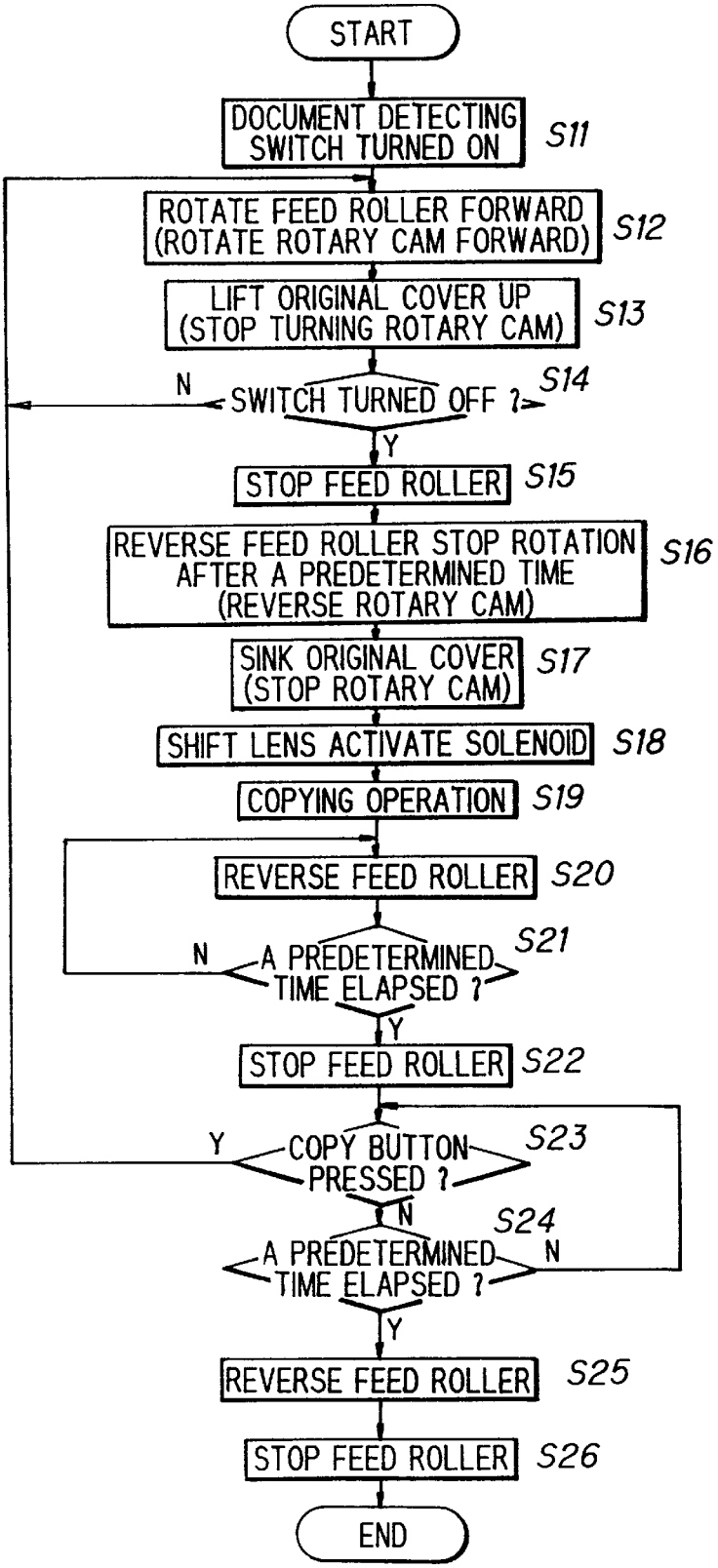
FIG. 17 is a flowchart showing the operation of controlling image forming and control of a document feeder of the invention.

Referring next to a flowchart shown in FIG. 17, the operation of the copier and the document feeder 30 of the invention will be explained. FIGS. 11 and 12 show a state where the original cover 3 is closed with the document stocker 35 positioned over the original cover 3. From this setting, the document stocker 35 is rotated to be opened. By this operation, the hook portion 37*a* of the catching member 37 meshes the engaging member 35*c*, as shown in FIGS. 9 and 10, so that the document stocker 35 is kept inclined to serve as the guide for guiding inserted documents toward the feed roller unit 34. In this case, the document pressing mat 3*a* of the original cover 3 is in close contact with the original table 2 due to the weight itself. This condition is shown FIG. 10.

In the above setting, when a document D is inserted along the upper surface of the document stocker 35 from the document feeding port 32, the document D raises the detecting lever 33, to thereby turn the document detecting switch on (Step S11).

At the time of inserting the document, if, for example the left edge of the original table 2 in FIG. 11 is assumed to be a referenced position for the placement of the document, the left side of the bending portion 35*a* of the document stocker 35 is adapted to coincide to the referenced position, whereby it is possible to use the bending portion 35*a* to guide the front part of the document. By this arrangement, it is possible to deliver the document to the original table 2 in place with its front side aligned with the referenced position.

As the document detecting switch is activated through the detecting lever 33 by the inserted document, the feed roller 34*a* starts to rotate in the forward direction or in the document feeding direction (in the clockwise direction in FIG. 9) (Step S12), the document D is fed into a space between the document pressing mat 3*a* and the original glass table 2. At this moment, the rotary cam 345 is similarly rotated as the feed roller 34*a* rotates, as shown in FIGS. 14 through 16. As a result, the lifting projection 345*b* of the rotary cam 345 abuts the top outer plate 1*a* of the copier, to thereby raise the original cover 3 upward (Step S13).

Accordingly, a gap 'd' is formed between the pressing mat 3*a* of the original cover 3 and the original table 2 as shown in FIG. 9. Then, the document being conveyed by the feed roller 34*a* is delivered out toward the original table 2. In this case, the opposed face of the document pressing mat 3*a* to the original table 2 serves as a document guide. The gap 'd' is preferably 0.1 mm or more by considering that a typical paper sheet is about 0.08 mm thick. The clearance 'd' can easily be adjusted by specifying the shape of the lifting projection 345*b* of the rotary cam 345.

The rotation of the rotary cam 345 stops as the recess 345*a* is caught by the projection 3*c* of the original cover 3, whereas the feed roller 34*a* continues to rotate in the forward direction (S13).

Thereafter, when the rear end of the document D goes through the detecting lever 33 and the document detecting switch turns off (Step S14), the feed roller 34*a* stops turning (Step S15) while the rear end of the document D is kept nipped by the feed roller 34*a*.

As the automatic feeding of the document D to the original table 2 is thus completed, the original cover 3 is pressed onto the original table 2 in order to remove wrinkles and irregularity of the document. To achieve this, the feed roller 34*a* is reversed in a limited period of time. This period is to allow the rotary cam 345 so that the recess 345*a* of the rotary cam 345 catches the projection 3*c* of the original cover 3 and the cam lifting projection 345*b* is displaced from the outer plate 1*a* of the copier body. By this rotation, the rotary cam 345 is reversed until the recess 345*a* is caught by the projection 3*c* while the lifting projection 345*b* is displaced from the top outer plate 1*a*. In this condition, the feed roller 34*a* stops rotating and the pressing mat 3*a* pressing the document against the original table 2 because the original cover 3 falls due to the weight thereof (S17).

After the completion of the above operation, the copier starts to perform the same copying operation as will be effected when the copy button 223 is pressed, whereby the copier effects reproducing procedures from the exposure to the discharge of copy paper (Step S19). In this case, the copying operation is carried out with the rear end of the document D nipped by the feed roller 34*a*. Therefore, the placement of the document differs by, for example, about 10 mm, as shown in FIG. 9, from the position where the usual operation is done without using the document feeder 30. Since the rear end of the document is kept nipped by the feed roller 34*a*, the difference is the distance between the nipped edge and one reference side of the original table 2. To cancel this difference, in this embodiment, the lens 4*e* in the optical system is shifted from a referenced position so that the center of the document D may coincide with the that of the copy sheet.

Specifically, the copier is constructed so that activation of the document switch may start the same copying operation as is effected when the copy button 223 is pressed. Accordingly, with no pressing of the copying button 223, insertion of a document turns the original detecting switch on, to thereby start the copying operation. Before the activation of the copying operation, the lens 4*e* is shifted by about 5 mm by means of an unillustrated solenoid or motor for lens-shifting, so that the nipped document D may be image-formed on the photoreceptor 105 with the focused image of the edge shifted by 10 mm. Accordingly, it is possible to make the focused image on the photoreceptor coincide with the feed reference position of the copy sheet delivered as usual (Step S18). For this purpose, the lens 4*e* is provided so as to be able to move in the direction perpendicular to the optical axis (in the forward and rearward directions in FIG. 9). When copying operation is done by automatic document handling, the copier is so set up that the lens 4*e* is shifted about 5 mm toward the front side in FIG. 11, or rightward in FIGS. 9 or 10.

In this case, the undersurface of the supporting frame of the original table 2, in particular, the region around the nipped portion of the document where the light is illuminated by the optical system should preferably be white, since the reflected light from this area is projected on the photoreceptor 105. If this area has a dark color, toner would be adhered onto the corresponding area and transferred to the copy sheet, resulting in formation of a black strip.

In this condition, copying operation is effected in Step S19. After the completion of the process, the feed roller 34*a* is turned in the reverse direction by the driving motor (Step S20), the document D is delivered out toward the document feeding port 32. This discharge is performed by previously memorizing the rotating time of the feed roller 34*a* when the document D is inserted and measuring a setup time which is a little shorter (by a time equivalent to about 10 mm in feed distance) than the memorized time (Step S21) and stopping the reverse rotation of the feed roller 34*a* after the passage of the thus setup time (Step S22).

Accordingly, the document D stops at a position where the end of the document D is nipped in some degree by the feed roller 34*a*. In this condition, if another copy is wanted and the system recognizes that the copy button is pressed within a predetermined period (for example, 2 seconds) after the feed rollers stopped (S23), the feed roller 34*a* starts turning in the forward direction (S12) and the same copying operation as mentioned above restarts, followed by the repetition of the aforementioned procedures.

Thus, it is possible to take a multiple number of copies. After the predetermined time passed (S24), the feed roller 34*a* is again reversed (S25) and stopped after the predetermined period of time (S26), whereby the document D is discharged to the document stocker 35. It is noted that if the number of copies for a document is specified previously, it is possible to easily obtain a required number of copies in a single operation.

As has been described, duplication of a single document is performed using the document feeder 30. If two or more documents are to be copied, the operator should put the finished document onto the top flat face of the original cover 3 and insert a next sheet document into the document feeding port 32 to effect a similar copying operation to thereby obtain desired copies.

In accordance with this embodiment, the document is fed in a direction perpendicular to the direction in which copy sheets are conveyed. Accordingly, since copying is effected with one side edge of the document nipped, the centers of the copy sheet and the document will not coincide with one another. To avoid this situation, the focusing lens is moved in the direction perpendicular to the optical axis of the lens, whereby the centers of the document and the copy sheet are made coincident.

Nevertheless, it is also possible to convey the document in the same direction as the copy sheet is conveyed. That is, for example, the original cover 3 is hinged on the right side in FIG. 11 while a document feeding port may be formed on the opposite side to the hinged portion. The other components may be configurated in the same manner as described above. In this case, the document is exposed to light with the rear end of the document nipped 10 mm, for example, the front end of the image formed on the photoreceptor is positioned different by 10 mm from the front end of the copy sheet conveyed. To cancel this discrepancy can be easily done by effecting control of driving so as to make the timing of delivering the copy sheet, earlier by a time equivalent to about 10 mm in feed distance.

In the configurations described above in which the image of the document is directly projected to the photoreceptor, the deviation of centers between the document and the copy sheet or the difference of the front end of the sheet from that of the image formed is unavoidable. This can be dealt with by using a digital image forming apparatus in which the image of a document placed is picked up digitally so that the picked up data is written onto the photoreceptor with laser beams. In such an image forming apparatus, the aforementioned center difference between the document and the copy sheet or the positional deviation between the copy sheet and the formed image can be modified or corrected when illumination of laser beams is to be done. That is, partial image area which is of the original but is not placed on the original table 2 is assumed to be plain area, whereby the total image containing the plain area may and should be written in on the photoreceptor 105 by laser illumination. To pick up an image digitally, a typical process is effected as follows: That is, a CCD or the like should be disposed after the focusing lens 4*e*. The picked up image data from the document by the CCD is A/D converted to be stored. Then, the laser beams modulated based on the stored digital image data are illuminated on the photoreceptor 105, whereby a static latent image corresponding to the image of the document can be created with dots.

As described heretofore, the document feeder 30 of this embodiment can be constructed by the simple means, so that it is possible to markedly contribute to reducing the cost. In the above embodiment, since the lifting mechanism for creating a gap 'd' between the original cover 3 and the original table 2 is configured by a linking device that utilizes the driving force of the feed roller 34*a* for conveying documents, there is no need for any special driving means. Particularly, at the timing when the document is inserted, the original cover 3 is lifted up by the gap 'd' from the original table 2. Accordingly, no particular means is needed for taking the timing of lifting up the original cover 3 while it is possible to reliably deliver the original to the original table 2.

Further, since the original cover 3 can be brought into pressure contact with the original table 2 after a document is placed therebetween, this pressure is able to eliminate wrinkles and irregularity of the sheet document, whereby it is possible to obtain clear image output free from shadows due to wrinkles etc.

In the case where the document is discharged, the document is pressed against the original table 2 by the mat 3*a* of the original cover 3 with the pressure of the weight of the original cover. However, since one end of the document is nipped by the feed roller 34*a*; if the conveying force by the feed roller 34*a* is greater than the pressing force, it is possible to easily discharge the original even if the document is pressed.

In the above description, although the document guide for the document feeder is formed to also serve as a document stocker for holding documents, the document guide may be formed by a mere rotating member, separately from the document stocker 35. However, since, in the above embodiment, the document stocker 35 has both functions, it is advantageous that the part can be used as a storage if the document feeder is not used.

Although the embodiment of the invention is constructed so that the document stocker 35 is rotated to be utilized as the document guide so as to provide an easy feeding of the document, the provision of the document stocker 35 is not the requisite composing element of the present invention. That is, as long as the document can be placed on the top outer plate 1*a* and inserted into the feed roller unit 34 while one edge of the document is regulated by a guide in correspondence with the referenced position of the original table 2, it is possible to easily insert the document along the referenced position, without using the document stocker 35.

Meanwhile, as described heretofore, in order to drive the feed roller 34*a*, the driven gear 342 is rotated through the transmission gear 343. In this case, a motor as a driving means is provided on the original cover side and the rotation of the motor is transmitted to the transmission gear 343. However, since the driving means is provided for the original cover 3 side, the original cover 3 becomes heavy. Accordingly, a great force is required to open and close the cover 3.

When the discharging operation of the document is done; if the original cover 3 is heavy, an increased discharging force is required, thus needing an increased driving force. Further, since it is necessary to obtain a power source for driving the driving means from the copier body side, power cables etc., for that purpose must be connected to the pivoting original cover 3. The provision of the interconnection poses extremely troublesome problems such as electrically insulating performances and tolerance of the cable due to the pivoting movement of the cover 3.

To solve the above problems, it becomes important to obtain a transmitting means from the copier body side, in place of providing a motor as a driving means on the original cover side. The linking mechanism for the driving means will be now described with reference to FIGS. 18 and 19.

As described heretofore, the linking lever 344 rotated on the shaft 340 of the feed roller 34*a* is connected at its end to a spring 349 whose other end is connected to the underside of the hard outer plate 3*b* of the original cover 3. That is, the linking lever 344 is rotationally urged all the time in the clockwise direction in FIG. 14 by the urging force of the spring 349. This linking lever 344 is disposed on one side portion of the original cover 3, where the lever will not interfere with the conveyed documents.

The transmission gear 343, which is rotatably attached to the linking lever 344 and in mesh with the driven gear 342, is arranged facing a driving gear 350 provided on copier body side, in such a manner as to be engaged with the gear 350 when the original cover 3 is laid over the original table 2. The driving gear 350 is rotated by a transmitted rotational force through a clutch etc., from an unillustrated driving motor on the copier body side and is engaged with the aforementioned transmission gear 343. This gear 350, in particular, is disposed below the level of the top outer plate 1*a* and an opening 1*b* is formed on the outer plate 1*a* in such a position as to allow the gear 350 to be exposed outside. The transmission gear 343 is arranged so as to be able to mesh the driving gear 350 through the opening 1*b*.

Since the linking lever 344 is rotationally urged upward by the spring 349, the transmission gear 343 will not be in mesh with the driving gear 350 even if the original cover 3 is laid over the original table 2. In other words, the transmission gear 343 is kept away from the driving gear 350 (In the state shown in FIG. 19).

The means linking the transmission gear 343 with the driving gear 350 uses the aforementioned document stocker 35; that is, the two gears are linked each other when the document stocker 35 is used as the document guide. To attain this linkage, the linking lever 344 has a projecting portion 344*a* on the opposite side of the spring 349 while an engaging portion 35*e* is formed in the bending portion 35*a* of the document stocker 35. These two elements, i.e., the projecting portion 344*a* and the engaging portion 35*e* are provided to be engaged.

Particularly, when the document stoker 35 is rotated on the way to the outer plate 1*a* of the copier body, the engaging portion 35*e* engages with projecting portion 344*a* of the linking lever 344 in such a manner as to raise the portion 344*a* from the lower position. This movement causes the linking lever 344 to rotate on the shaft 340 of the feed roller 34*a* counterclockwise in FIG. 19, opposing the urging force of the spring 349. At the same time, the transmission gear 343 rotatably disposed on the linking lever 344 is lowered toward the driving gear 350 on the copier body side, so that the two gears mesh together. Thus, the driving gear 350 transmits the driving force from the driving motor to the gear 342 through rotation controlling means such as a clutch and the like, whereby the feed roller 34*a* is rotated.

Thus, the rotation of the feed roller 34*a* causes the rotary cam 345 to rotate, whereby the original cover 3 is lifted up from the original table 2 by the gap 'd'. The driving gear 350 is controlled on its rotating direction by means of the above-mentioned clutches and the like so as to rotate the feed roller 34*a* in the forward direction or in the reverse direction.

Figure 18:
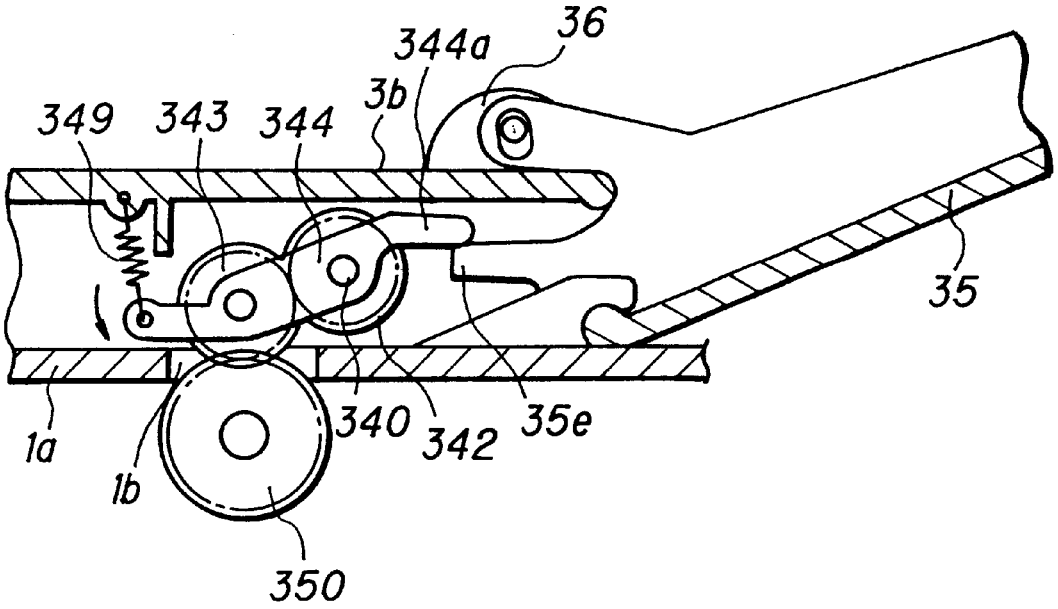
FIG. 18 is a sectional view showing an example of a transmitting mechanism in its linked state for transmitting rotational force to a feeding means constituting a document feeder of the invention.
Figure 19:
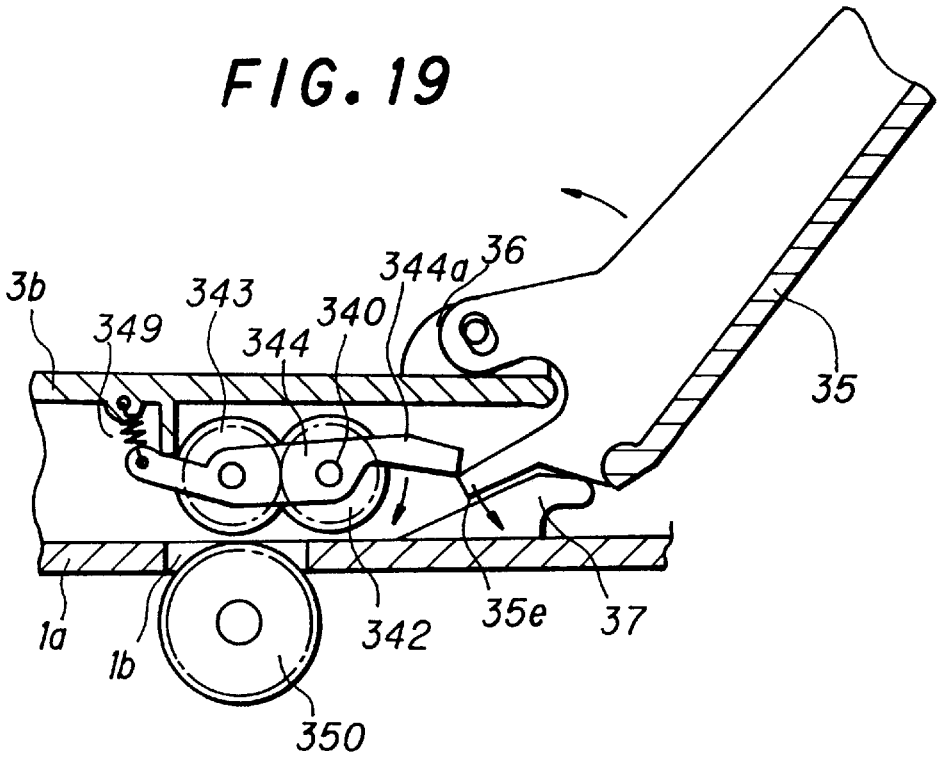
FIG. 19 is a sectional view showing an example of a transmitting mechanism in its unlinked state for transmitting rotational force to a feeding means constituting a document feeder of the invention.

Accordingly, when the document feeder 30 is used to automatically deliver a sheet document to the original table 2 for copying operation, the document stocker 35 is rotated from the position shown in FIG. 11 to the position shown in FIG. 18, whereby the driven gear 342 for driving the feed roller 34 is linked through the transmission gear 343 with the driving gear 350 provided on the copier body side. In consequence, the feed roller 34*a* is driven in accordance with the rotation of the driving gear 350. In this condition, if the document detecting switch detects a document inserted (ON) by means of the detecting lever 33, the detection signal is sent to the copier body. This activates the driving gear 350 to thereby rotate the driven gear 342 and therefore the feed roller 34*a*. Then, as the document is set on the original table 2, the driving gear 350 is stopped.

When the document feeder 30 is not used, the document stocker 35 is rotated in the direction of arrow shown in FIG.

19, to be set in the position shown in FIG. 11. In this state, the driven gear 342 of the feed roller 34*a* is separated from the driving gear 350 so that the feed roller 34*a* cannot turn.

In the arrangement thus configured, since there is no need for providing a driving motor on the side of the original cover 3 in order to drive the feed roller 34*a*, it is possible to use the driving motor disposed on the copier body side. Accordingly, the document feeder 30 provided on the side of the original cover 3 requires fewer components, thus reducing the weight of the original cover 3 itself. This allows the operator to easily open and close the original cover 3 in the manual operation, thus facilitating the placement of the document onto the original table 2. On the other hand, when the document feeder 30 is used, the weight of the original cover 3 is reduced. Therefore, the document can be discharged enough easily with a less discharging force, even in the state where the original cover 3 is pressed against the original table 2.

When the document is delivered to the original table 2; suppose that the pressing mat 3*a* of the original cover 3 is spaced by the gap 'd' from the original table 2 in the entire area, the document might become stuck in the inserting port and jammed when the front end of the document is introduced into the gap 'd'. That is, if the clearance 'd' is very small, the risk of jamming becomes high, whereas the document can be conveyed in a good condition as being guided by the document mat 3*a*, so that the document can be delivered onto the original table 2 as wrinkles and irregularity on the document being corrected. In contrast, if the clearance 'd' is large, the risk of jamming becomes extremely low, but the document fluctuates as being conveyed with wrinkles and irregularity uncorrected, then is pressed by the original cover 3 without irregularity and wrinkles eliminated. The possibility of the resulting image containing shadows becomes very high.

Figure 20:
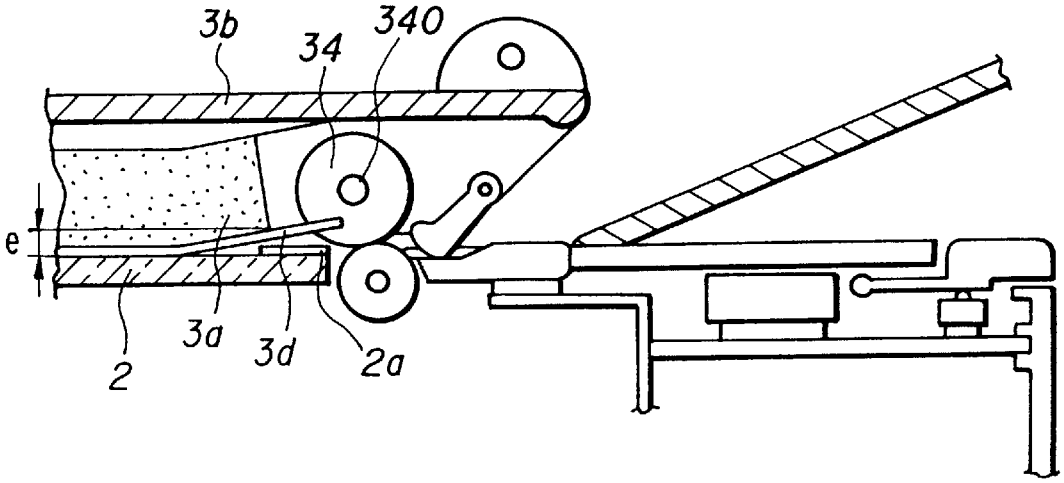
FIG. 20 is a sectional view showing an example of a configuration for establishing reliable insertion of a document in a document feeder of the invention.

FIG. 20 shows a configuration to solve the above problems. In the figure, a white sheet 3*d* to be adhered to the document pressing mat 3*a* on the document inserting side is extended toward the feed roller 34*a* while being inclined to make a large clearance 'e' between the original table 2 and itself. This clearance 'e' does not cause any adverse effect when the document is pressed against the original table 2, as long as the position of the clearance is made corespondent with a reference edge area 2*a* for regulating the one side of the document. More specifically, the image on the reference edge area 2*a* will not be duplicated and image forming is effected on the right side (in FIG. 20) of the reference edge area 2*a*. Even with the clearance 'e' created in this area, the document in this area will not be pressed, so that any problems such as swelling of the document will not occur.

Figure 21:
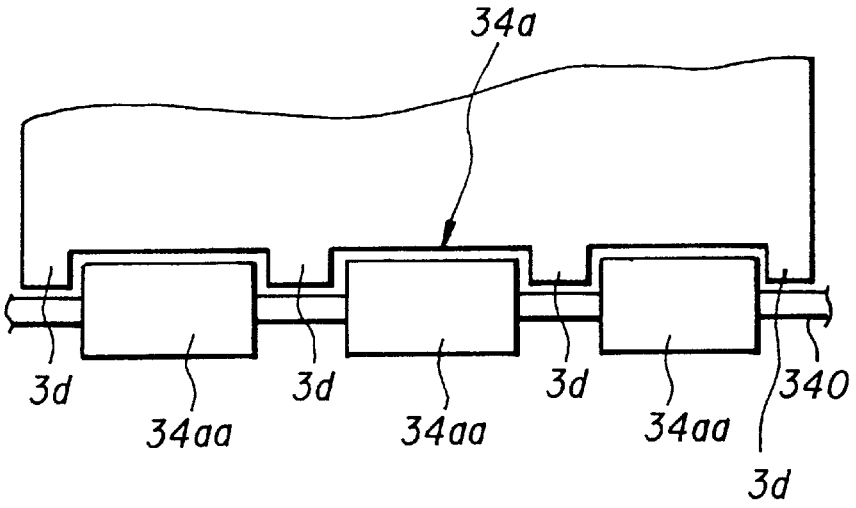
FIG. 21 is a plan view showing an example of a configuration for establishing reliable insertion of a document in a document feeder of the invention.

Accordingly, the front end of the document conveyed by the feed roller 34*a*, can surely be introduced to the gap 'd', even if it is small, as being guided by the white sheet 3*d* of the pressing mat 3*a*, toward the original table 2. This structure lends itself to prevent the front end of a document from being stuck and jammed when the document is delivered to the original table. FIG. 21 is a plan view showing a positional relation between the white sheet 3*d* to be applied to the pressing mat 3*a* and the feed roller 34*a*. As shown in the figure, the white sheet 3*d* has flaps extending to the vicinity of the shaft 340 of the feed roller in areas between the feed roller elements 34*aa*.

Thus, in accordance with the second embodiment of the invention, since a simple document feeder is provided which includes a feeding means disposed on one side of the original table for delivering documents into between the closed original cover and the original table, it is possible to reduce the cost as of a copier with a document feeder.

In the above embodiment, since the original cover is adapted to be spaced from the original table by using the linking mechanism with the rotation of the feeding means when the document is fed to the original table by the document feeder, it is possible to create a gap between the original cover and the original table at the time of conveyance, thus assuring the conveyance of documents. Accordingly, there is no need for a special timing means for separating the original cover from the original table. Further, there is no need for providing a special driving means in the original cover or any other site for separating the original cover from the original table.

Still more, it is possible to bring the original cover into close contact with the original table by reversing the feeding means. Accordingly, it is possible to make the most of the original cover in order to correct wrinkles and irregularity of the document inserted, whereby images free from shadows caused by wrinkles and irregularity can be obtained when the document is copied.

Further, in the above embodiment, if and only if the rotational member for guiding documents is set in place after the original cover is closed, the document feeder is made active. Accordingly, when the operator effects copying operation by manually handling the original cover, the feeding means will not be activated, thus preventing the operator from jeopardy. Since there is no driving means provided on the original cover side, it is possible to reduce the total weight of the original cover. Accordingly, discharging operation of documents can be reliably effected even if the document is pressed against the original table by the original cover.

Furthermore, since an inclined surface for creating a clearance between the original cover and the original table is provided in the inserting end for documents, it is possible to prevent the front end of the conveyed document from being stuck and from conveyance jamming and the like.

Next, a third embodiment of the invention will hereinafter be described.

Figure 22:
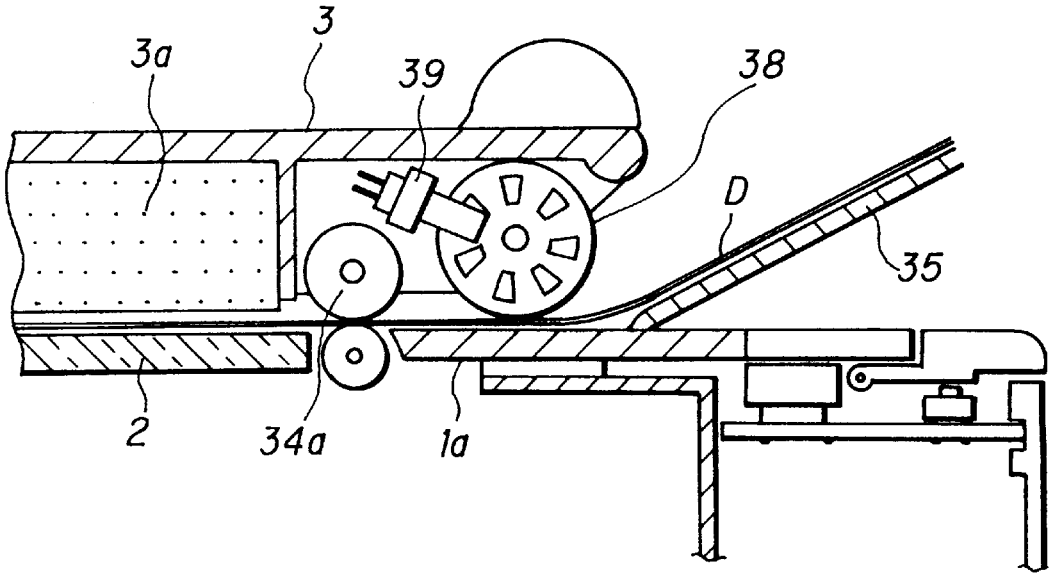
FIG. 22 is a sectional view showing essential components of an original feeder, especially a configurational example of a means of recognizing document conveying conditions in a document feeder of the invention.

In this embodiment, a slit disc having many slits formed in the peripheral part thereof is provided as an rotary encoder (to be referred to as an encoder) 38, in order to check the state of the document being conveyed. This encoder 38 is, as shown in FIG. 22, substantially aligned with the document detecting lever 33 in the sectional view, but set off the lever as viewed from the width-direction. The encoder 38 is rotatably disposed on the original cover 3 so that part of peripheral side opposed to the original cover 3 abuts the top outer plate 1*a* of the copier body. The encoder is supported movable in some degree in the direction perpendicular to the rotational axis thereof so that when a document D is inserted into a nip between the top outer plate and the rotatable encoder 38, the encoder may be placed on the surface of the document D by its weight.

Accordingly, as the inserted document D is inserted and conveyed between the encoder 38 and the top outer plate 1*a*, the encoder 38 is rotated. This rotation is detected by a slit detecting sensor 39 consisting of light emitting and light receiving elements opposed to each other with the encoder 38 therebetween. In this arrangement, the sensor 39 detects positions of slits, and the detection signals are counted to recognize the length of the document and the conveying speed and time. The encoder 38 and the detecting sensor 39 constitute a recognizing means of the conveyed state of the document conveyed by the means of the invention.

Referring next to a flowchart shown in FIG. 23, the operation of the copier and the document feeder 30 of the invention will be explained. FIGS. 11 and 12 show a state where the original cover 3 is closed with the document stocker 35 positioned over the original cover 3. From this setting, the document stocker 35 is rotated to this side to be opened. By this operation, the hook portion 37*a* of the catching member 37 meshes the engaging member 35*c*, as shown in FIGS. 9 and 10, so that the original cover 3 is lifted upward to separate the document pressing mat 3*a* from the original table 2 by a gap 'd'.

In the above setting, the document feeder 30 is made operative, and when a document D is inserted along the upper surface of the document stocker 35 from the document feeding port 32, the document D raises the detecting lever 33, to thereby turn the document detecting switch on (Step S31).

At the time of inserting the document, if, for example the left edge of the original table 2 in FIG. 11 is assumed to be a referenced position for the placement of the document, the left side of the bending portion 35*a* of the document stocker 35 is adapted to coincide to the referenced position, whereby it is possible to use the bending portion 35*a* to guide the front part of the document. By this arrangement, it is possible to deliver the document to the original table 2 in place with its front side aligned with the referenced position.

As the document detecting switch is activated through the detecting lever 33 by the inserted document, the feed roller 34*a* starts to rotate in the forward direction or in the document feeding direction (in the clockwise direction in FIG. 9) (Step S32), the document D is fed into a gap 'd' between the document pressing mat 3*a* and the original glass table 2. In this case, the opposed face of the document pressing mat 3*a* to the original table 2 serves as a document guide. The gap 'd' is preferably 0.1 mm or more by considering that a typical paper sheet is about 0.08 mm thick. The clearance 'd' can easily be adjusted as stated before.

In synchronization with the start of the rotation of the feed roller 34*a*, a timer T1 and a counter C1 are reset. The counter C1 is to count the number of output signals from the detection sensor 39, that is, the number of slits passing by as the encoder 38 rotates. The counter C1 counts as the document D is conveyed while the timer T1 starts time counting from the reset state. The timer T1 is reset after a predetermined time (predetermined period) 'ta' and restarts counting (S33).

Then, the operation goes to Step S34 and checks the output signal from the detecting sensor 39 for detecting slits of the encoder 38. Specifically, the detecting sensor 39 changes its state from turn-off state to turn-on state and outputs a signal (S34) when the light receiving element detects light emitted from the light emitting through one of the slits. Then, in Step S35, the counter C1 for counting the number of slits adds one (+1) to the present count number (C1←C1+1). Then, in Step S36, judgment is made on whether the timer T1 has counted the predetermined time 'ta'; if it is negative, the operation goes back to Step S34.

That is, in the above steps S34 to S36, as the encoder 38 rotates, the counter C1 counts the number of slits during the predetermined time 'ta'. If the feed roller 34*a* is driven at a constant speed, the count number during the time 'ta' takes a constant value Ca. In Step S37, if the count number of the counter C1 is smaller than the constant count number Ca, the system judges that the conveyed state of the document is anomalous, and turns on a warning lamp for indicating the anomaly of document conveyance, such as document jam, to warn the user of the anomaly and stops the rotation of the feed roller 34*a* (S39).

Thus, while the timer T1 repeatedly counts time up to the predetermined time 'ta', the counter C1 counts the number of slits of the encoder 38 during the time 'ta'. If the counter C1 counts the predetermined number Ca during the predetermined time 'ta', the system recognizes that the document is conveyed properly. Particularly, on the premise that the feed roller 34*a* is driven at a constant speed, if the document D is conveyed without any anomaly, the encoder 38 also rotates in synchronism with the rotation of the feed roller 34*a*. Therefore, the number of slit signals outputted from the detecting sensor 39 of the encoder 38 during the predetermined time 'ta' must take the predetermined value. If the count number of the counter C1 during the predetermined time 'ta' is smaller than Ca, the system recognizes that an unusual situation has occurred in conveying the document D.

When the document D conveyed becomes stuck in, for example, the gap 'd' between the original table 2 and the mat 3*a* of the original cover 3, the rotation of the encoder 38 does not synchronize with that of the feed roller 34*a*. Accordingly, the count number of the counter C1 during the predetermined time 'ta' does not become equal to Ca, so that the system recognizes the anomaly of the conveyance of the document and stops the operation of the feed roller 34*a* in order to prevent the document D, especially, the front end of it from damaging as well as warns the user of the situation.

Accordingly, the above steps S33 through S37 in cooperation with the encoder 38 and the detecting sensor 39, constitute the recognizing means for recognizing the conveyed state of the document. When this recognizing means recognizes anomaly, the system stops the operation of the feed roller 34*a* in order to eliminate or reduce the damage on the document and warns the user.

If no anomaly occurs in conveying the document, the system checks, at Step S40, whether the rear end of the document D has passed through the detecting lever 33 or whether the document detecting switch is turned off. That is, if the rear end of the document D has already passed through, the document detecting switch is off and the system will detect it. If the system does not detect the turn-off state, the operation returns to Step S33 and enters the steps of recognizing the conveyed state of document as already stated and the system repeatedly confirms the conveyed state of the document every interval of the predetermined time 'ta'. When the rear end of the document D is detected by the document detecting switch, that is, the switch is turned off, the rotation of the feed roller 34*a* is stopped (Step S41), so that the document D stops with its rear end nipped by the feed roller 34*a*.

In this way, as the document D is automatically fed onto the document table 2, the copier starts to perform the same copying operation as will be effected when the copy button 223 is pressed, whereby the copier effects reproducing procedures from the exposure to the discharge of copy paper (Step S43). In this case, the copying operation is carried out with the rear end of the document D nipped by the feed roller 34*a*. Therefore, the placement of the document differs by, for example, about 10 mm, as shown in FIG. 9, from the reference edge 2*a* on the original table 2 where the usual operation is done without using the document feeder 30. Since the rear end of the document is kept nipped by the feed roller 34*a*, the difference is the distance between the nipped edge and one reference side of the original table 2. To cancel this difference, in this embodiment, the lens 4*e* in the optical system is shifted from a referenced position so that the center of the document D may coincide with the that of the copy sheet.

Specifically, the copier is constructed so that activation of the document switch may start the same copying operation as is effected when the copy button 223 is pressed. Accordingly, with no pressing of the copying button 223, insertion of a document turns the original detecting switch on, to thereby start the copying operation. Before the activation of the copying operation, the lens 4*e* is shifted by about 5 mm by means of an unillustrated solenoid or motor for lens-shifting, so that the nipped document D may be image-formed on the photoreceptor 105 with the focused image of the edge shifted by 10 mm. Accordingly, it is possible to make the focused image on the photoreceptor coincide with the feed reference position of the copy sheet delivered as usual (Step S42). For this purpose, the lens 4*e* is provided so as to be able to move in the direction perpendicular to the optical axis (in the forward and rearward directions in FIG. 9). When copying operation is done by automatic document handling, the copier is so set up that the lens 4*e* is shifted about 5 mm toward the front side in FIG. 11, or rightward in FIGS. 9 or 10.

In this case, the undersurface of the supporting frame of the original table 2, in particular, the region around the nipped portion of the document where the light is illuminated by the optical system should preferably be white, since the reflected light from this area is projected on the photoreceptor 105. If this area has a dark color, toner would be adhered onto the corresponding area and transferred to the copy sheet, resulting in formation of a black strip.

In this condition, copying operation is effected in Step S43. After the completion of the process, the feed roller 34*a* is turned in the reverse direction by the driving motor (Step S44), the document D is delivered out toward the document feeding port 32. This discharge is performed by previously memorizing the rotating time of the feed roller 34*a* when the document D is inserted and measuring a setup time which is a little shorter (by a time equivalent to about 10 mm in feed distance) than the memorized time (Step S45) and stopping the reverse rotation of the feed roller 34*a* after the passage of the thus setup time (Step S46). At the same time, in order to return the lens in the optical system to the original position, the solenoid for lens-shifting is turned off (S47).

Accordingly, the document D stops at a position where the end of the document D is nipped in some degree by the feed roller 34*a*. In this condition, if another copy is wanted and the copy button is pressed (S48) within a predetermined period (for example, 2 seconds) (S49) after the feed rollers stopped, the feed roller 34*a* starts turning in the forward direction and the system reenters copying operation.

Thus, it is possible to take a multiple number of copies. After the predetermined time passed, the feed roller 34*a* is again reversed (S50). When the document D goes through the feed roller 34*a* and the document detecting switch is turned off, the feed roller 34*a* is stopped (S51). As a result, the document D is discharged to the document stocker 35. It is noted that if the number of copies for a document is specified previously, it is possible to easily obtain a required number of copies in a single operation.

As has been described, duplication of a single document is performed using the document feeder 30. If two or more documents are to be copied, the operator should put the finished document onto the top flat face of the original cover 3 and insert a next sheet document into the document feeding port 32 to effect a similar copying operation to thereby obtain desired copies.

In accordance with this embodiment, the document is fed in a direction perpendicular to the direction in which copy sheets are conveyed. Accordingly, since copying is effected with one side edge of the document nipped, the centers of the copy sheet and the document will not coincide with one another. To avoid this situation, the focusing lens is moved in the direction perpendicular to the optical axis of the lens, whereby the centers of the document and the copy sheet are made coincident.

Nevertheless, it is also possible to convey the document in the same direction as the copy sheet is conveyed. That is, for example, the original cover 3 is hinged on the right side in FIG. 11 while a document feeding port may be formed on the opposite side to the hinged portion. Other than these components, the document feeder 30 having the configuration described above may be provided as it is. In this case, the document is exposed to light with the rear end of the document nipped 10 mm, for example, the front end of the image formed on the photoreceptor is positioned different by 10 mm from the front end of the copy sheet conveyed. To cancel this discrepancy can be easily done by effecting control of opening the stopper 119 shown in FIG. 11 so as to make the timing of delivering the copy sheet, earlier by a time equivalent to about 10 mm in feed distance.

In the configurations described above in which the image of the document is directly projected to the photoreceptor, the deviation of centers between the document and the copy sheet or the difference of the front end of the sheet from that of the image formed is unavoidable. This can be dealt with by using a digital image forming apparatus in which the image of a document placed is picked up digitally so that the picked up data is written onto the photoreceptor with laser beams. In such an image forming apparatus, the aforementioned center difference between the document and the copy sheet or the positional deviation between the copy sheet and the formed image can be modified or corrected when illumination of laser beams is to be done. That is, partial image area which is of the original but is not placed on the original table 2 is assumed to be plain area, whereby the total image containing the plain area may and should be written in on the photoreceptor 105 by laser illumination. To pick up an image digitally, a typical process is effected as follows: That is, a CCD or the like should be disposed after the focusing lens 4*e*. The picked up image data from the document by the CCD is A/D converted to be stored. Then, the laser beams modulated based on the stored digital image data are illuminated on the photoreceptor 105, whereby a static latent image corresponding to the image of the document can be created with dots.

Further, a well-known blank lamp having a great number of lamps arranged along the axial direction of the photoreceptor may be provided in a position around the photoreceptor between the image exposure position and the developing position. In the case where the lens 4*e* is shifted in response to the document-feeder mode, there must be an unnecessary area which is exposed to the reflected light from a non-image area of the original table 2. In such a case, it is possible to turn on the blank lamp to erase charges on the unnecessary area corresponding to the non-image area. In this configuration, there is neither need for whitening the undersurface of the non-image area that corresponds to the reference edge 2*a*, nor need for making the undersurface flat.

Specifically, the focusing lens 4*e* should be set up at an arbitrary position within the movable range while unnecessary region can be erased by the blank lamp. For this purpose, a pulse motor etc., for example, is used to shift the lens 4*e*, in place of the solenoid. With this, it is possible to arbitrarily set up a specific shift position of the lens 4*e*, for each of different machines after the assembly of the copier.

Figure 24:
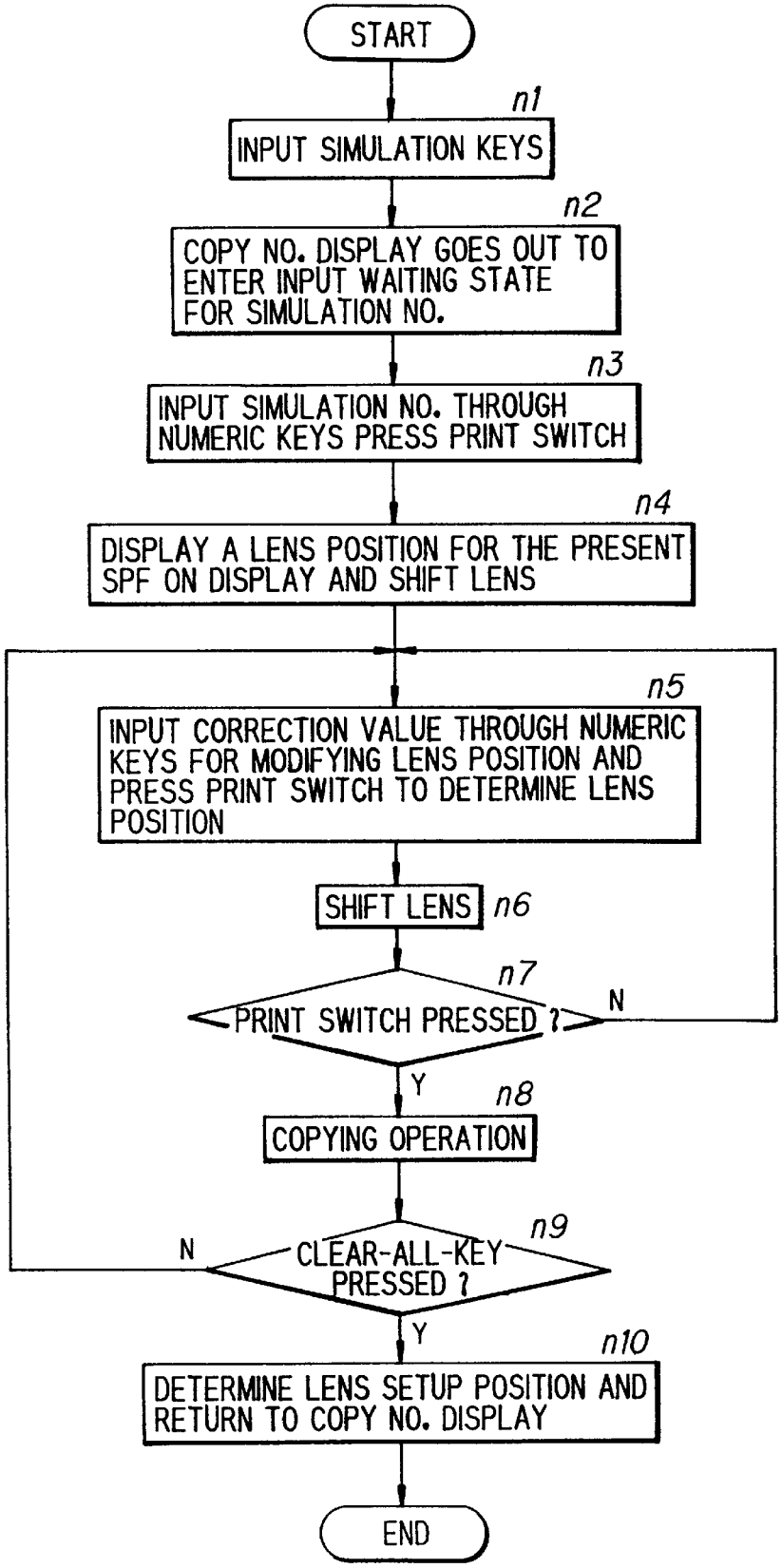
FIG. 24 is a flowchart showing a configurational example of setting up a focusing lens in an arbitrary position in order to make a fed sheet coincide with the image position focused.

For specific setup of the shift position of the lens 4*e*, it is necessary to set up a simulation mode in the system. This is the well-known mode for driving each component in the apparatus, individually to confirm the operating state of each component. FIG. 24 shows a typical example of this setup. As the simulation mode is set up by a specified key operation (n1), the display changes from the copy number indication into an input state in which a specific number for designating the simulation mode is inputted (n2). As the simulation mode number for setting up a shift amount of the lens 4*e* is inputted, the print switch (copy switch) is pressed (n3) in order to effect a simulation.

After the above operation, a shift amount of the lens 4*e* for a specific document feeder (SPF) attached at present is displayed on the display portion (n4). Then, if the shift amount of the lens 4*e* must be changed or modified, the modification value can be inputted by operating numeral input keys. After this input, the print switch is operated (n5), so that the motor for lens-shifting is activated to move the lens 4*e* in accordance with the input value (n6). When the lens is set up in a designated position, the system check the operation state of the printing switch (n7) in order to start the copying operation (n8). Specifically, the document is actually fed; the rear end is detected by the detecting switch; and the document is placed on the original table 2 with the feeding operation stopped. In this condition, actual copying is carried out with the lens 4*e* placed at a position designated by the modified shift amount. If the resulting copy is qualified, the clear key should be pressed (n9), so that the above input value may be memorized as the shift amount for the lens 4*e* (n10). If the resulting copy is not good, the shift amount for the lens 4*e* should be modified at Step n5, to repeat the same procedure.

When the clear key is pressed, this activates the discharging operation of the document fed on the original table 2. The correction of the illuminating control of the blank lamp may be done at the same time the shift amount for the lens 4*e* is set up. That is, when the shift amount of the lens 4*e* is inputted at n5, the region to be erased by the blank lamp may and should be inputted at the same time. By this procedure, it is possible for the operator to modify the input parameters as checking the erased region in association with the shift amount of the lens 4*e*.

As described heretofore, the document feeder 30 of this embodiment can be constructed by the simple means, so that it is possible to markedly contribute to reducing the cost. In the above description, the document stocker 35 for creating a gap 'd' between the original cover 3 and the original table 2 is configurated as holding documents etc., but this is not a must but a mere rotational member can be used, in place of the document stocker 35. However, since, in the above embodiment, the document stocker 35 has both functions, it is advantageous that the member can be used as a storage if the document feeder is not used.

In the embodiment of the invention, the original cover 3 is adapted to rise from the original table 2 by the lifting mechanism in link with the rotation of the document stocker 35 when the stocker is set to be used as the document guide. However, the invention should not be limited to this configuration. That is, it also possible to make the same operation by a lifting mechanism in which the original cover 3 is lifted up when a document is inserted.

For example, the means shown in FIG. 5 may be used. The means include: a moving piece 25 disposed in a position outside the document inserting region for the maximum-width document, for lifting the original cover 3 up; and a solenoid 24 disposed between the handgrip of the original cover 3 and the outer top face 1*a* of the copier body, for operating the moving piece 25. The moving piece 25 for lifting is rotatably supported by the outer plate 10*b* and the opposite part abuts the grip portion of the original cover 3 while the central portion is jointed to the solenoid 24.

When the solenoid 24 is not energized or not supplied with electric power, the moving piece 25 stays a little inclined in the counterclockwise direction. In this condition, no clearance 'd' is created between the original table 2 and the document mat 3*a*. That is, the document pressing mat 3*a* is in close contact with the original table 2. As the solenoid 24 is energized by electric power, the moving piece 25 moves to a position shown in FIG. 5 so that the original cover 3 is raised to create a gap 'd' between the document mat 3*a* and the original table 2.

In the above arrangement, in the case where the document stocker 35 is rotated to be used as the original guide; if a document is inserted, the detecting switch is activated through the detecting lever 33. Accordingly, the solenoid 24 is energized to rotate the moving piece 25, whereby the original cover 3 can be raised. In this condition, the feed roller 34*a* is activated to convey the sheet document to the original table 2.

This operation will be explained using the above-described flowchart of operation control, shown in FIG. 23.

As a document is detected at S31, this activates the solenoid 24 so as to lift up the original cover 3 from the original table 2 by a gap 'd', as shown in FIG. 5. Then the steps after S32 are effected. When the operation reaches Step S41, the feed roller 34*a* is stopped. In this situation or in a state where the rear end of the document stopped is nipped by feed roller 34*a*, the lens is shifted at S42 and at the same time, the solenoid 24 is deactivated.

The deactivation causes the original cover 3 to press down the fed document with its rear end nipped so that the copied surface of the document may be brought into close contact with the original table 2. Then, copying operation is effected at S43. As the copying operation is complete, the feed roller 34*a* is reversely rotated at S44 in order to discharge the document. Before this rotation, the solenoid 24 should be energized to space the document pressing mat 3*a* from the original table 2. As the above steps are successively repeated, it is possible to effect copying operation for a desired number of original documents, by using the document feeder 30. Since, in the document feeder 30 of the invention, the original cover 3 presses the document inserted against the original table, some wrinkles and irregularity of the sheet document, if any, can be smoothed, whereby it is possible to create qualified copies free from shadows due to the wrinkles and irregularity.

Before the reverse rotation (S44) of the feed roller 34*a* to discharge the document, the original cover 3 can be lifted up. That is, if the solenoid 24 is energized at the time of Step S44, the original cover 3 is raised from the original table 2. Since the system starts to discharge the document D in this condition, the advance of the document will not be disturbed by the original cover 3. As a result, it is possible to convey the document D smoothly. In this case, if the conveying force by the feed roller 34*a* is enough great as compared to the pressing force, it is possible to discharge the document even if the original cover 3 is not lifted up from the original table 2 or in one word, the document is pressed. In such a case, only the reverse rotation of the feed roller 34*a* may be enough, without energizing the solenoid 24.

In the above embodiment, in order to recognize the conveyed state of the document, the encoder 38 is used to measure the time or distance in accordance with the conveying speed of the document. That is, the measurement of the rotation of the encoder 38 is smaller than the predetermined value Ca, the operation is determined as jam. In addition, in normal conveyance of the document, if the document is greater than the image forming region of the original table 2, the conveyance of the document become impossible, and the document will be damaged. For example, the document is registered at its front end, therefore, the document gradually becomes pressed and creased from the front end. Consequently, the document becomes wrinkled and could be torn. Anyway, the document becomes damaged.

In order to prevent the document from being damaged, the system detects a state in which the rear end of the conveyed document does not pass through the document detecting lever 33 (ON-state), and stops the conveyance of the document if this state is recognized in a certain condition. That is, if a document having lager dimensions than those of the document placement area on the original table 2 (regain which can be image-formed) is fed, the system of the invention recognizes it and stops the feeding operation.

To attain the above purpose, the operation is carried out as follows: That is, as the system starts to feed a document; if the document is conveyed in the normal condition, it takes a predetermined time for conveying the distance corresponding to the size (length) of the image forming region of the original table 2. Suppose that, for example, the maximum size of documents to be placed on an original table 2 is B4. If a B4 document is placed with its long-side along the scanning direction of document, the B4 document should be inserted in the direction along the short-side. In this case, when the document is conveyed by about 250 mm, the document passes through the document detecting lever 33. Therefore, the document is stopped by deactivation of the feed roller 34*a*.

In the above situation, let us consider a case where a document having a size greater than the maximum size is inserted. If, for example, an A4 document is inserted along the longitudinal direction, the document would stick out of the image area of the original table 2. Accordingly, the document cannot pass out through the document detecting lever 33 even after being conveyed in a predetermined time. That is, the detection of the document remains on. Without taking any measure, if the document detecting switch detects the document after the conveyance by the feed roller 34*a* in a certain time (a predetermined period), the system would continue to convey the document. This would cause the document to become pressed and creased from the front end, whereby the document could be broken.

In the present invention, when the maximum-sized document which can be placed on the original table 2 is assumed, as stated above, to be the shorter side of a B4 document, the system counts a time for conveying a document by about 250 mm, from the start of feeding. If, after having counted this time, the system still does not detect the deactivation of the document detecting lever 33, or if the rear end of the document have not yet passed out from the detecting lever 33, the system stops conveying the document. Accordingly, the system determines that the whole image of the document can not be duplicated and indicates that, or rejects the document, to thereby discharge the document.

Now, description will be made on a specific configuration to attain the above operation, but before the explanation, another counter C2 and another specific time Cb should be defined. That is, the counter C2 is to measure the total feeding time of a document, and is reset in synchronization with Step S32 where the feed roller 34*a* is activated to rotate in the forward direction. The counter C2 counts the number of output signals from the detection sensor 39 or the number of slits of the encoder 38, in the same manner as the counter C1 does. However, the difference of the counter C2 from C1 is that the latter is reset at Step S33 but, the former will not be reset at Step S33 and continue to count up until the operation reaches Step S41 where the feed roller 34*a* is stopped. On the other hand, the time Cb is a period to be taken for feeding a maximum-sized document for the specific copier. Based on these definitions, consider now the specific configuration. That is, the process includes the steps of: counting the feeding time of a document, based on the number of output signals from the detecting sensor 39 of slits on the encoder 38 to set up the counter C2; comparing the counted value of C2 with a predetermined time Cb as defined above; and recognizing the conveyed state based on the compared result.

Figure 23:
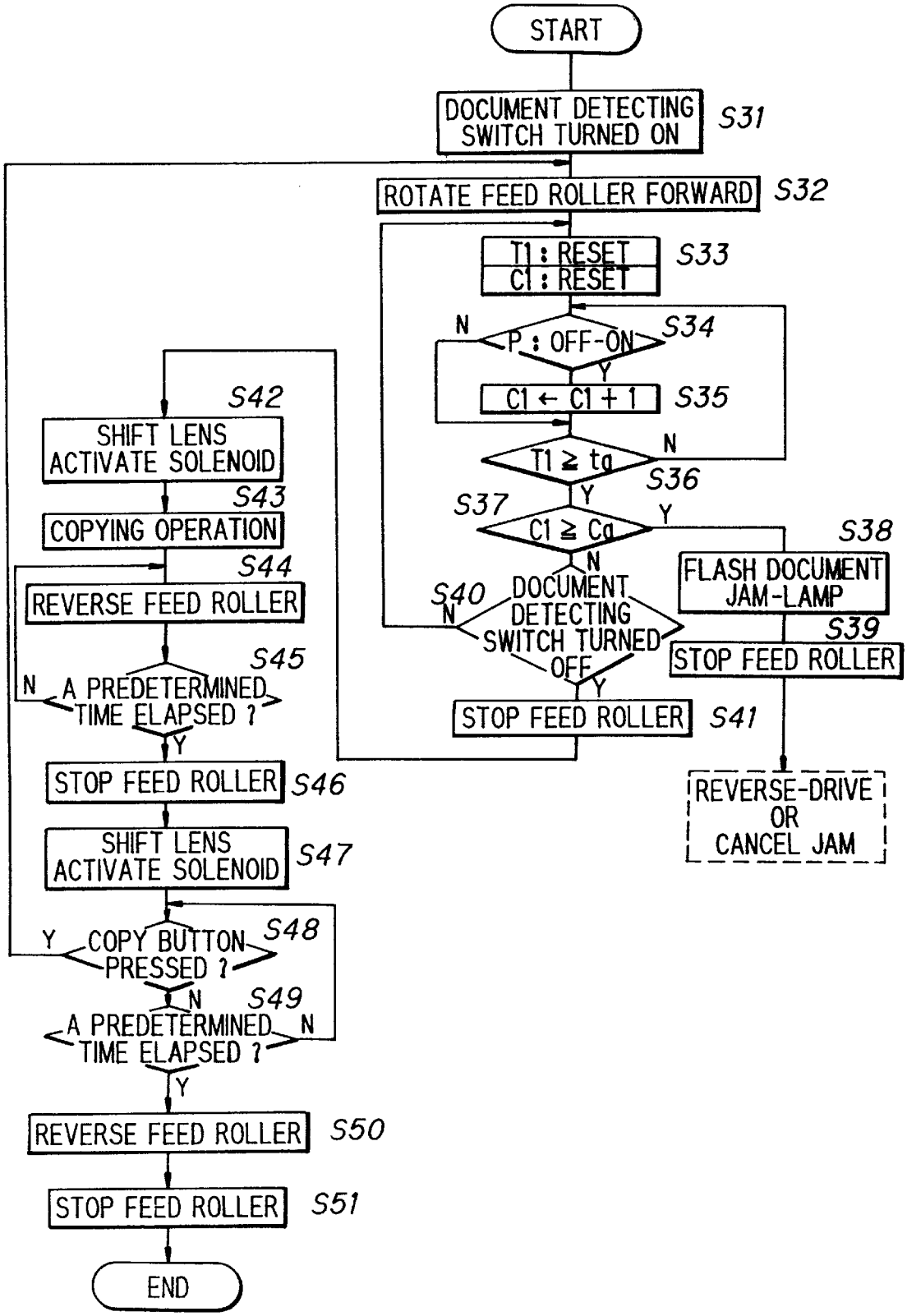
FIG. 23 is a flowchart showing the operation of controlling image forming and control of a document feeder of the invention.

That is, the other counter C2 as defined above is provided separately from the counter C1 of the flowchart shown in FIG. 23. The counter C2 is cleared simultaneously at Step S33 in FIG. 23 and starts to count the number of signals from the detecting sensor 39 when the feeding operation of a document is started. The counter C2 adds one (+1) to the present counter number (C2←C2+1) at the same time the counter C1 is added with one (C1←C1+1) at Step S35.

After the counting, the system compares C2 with Cb or whether C2≦Cb holds or not. If the content of the counter C2 is less than Cb which corresponds to the feeding time required for conveying a document having a specified maximum size, the operation goes to Step 36. In Steps S36 and S37, the system makes discrimination on whether the count of the counter C1 in the predetermined period 'ta' is equal to or greater than the determined value Ca, to thereby check the conveyed state of the document. Thereafter, the count value of the counter C2 is equal to or greater than the value Cb, the system check the operation state of the document detecting switch.

If the content of the counter C2 is less than the predetermined value Cb and the document detecting switch has already detected the passage of the rear end of the document (the switch is in OFF-state), the system, on the premise that the document was recognized as being conveyed properly in Steps S36 and S37, discriminates that the document is fed normally and enters Step S41 in the flowchart FIG. 23, where the system stops rotation of the feed roller 34*a*. In this condition, the document fed is delivered appropriately on the original table 2, with its rear end nipped by the feed roller 34*a*.

On the contrary, if the content of the counter C2 becomes greater than the value Cb corresponding to the maximum size of documents to be handled and the document detecting switch detects the presence of the document (the switch is in ON-state), the system determines that the document fed to the original table 2 is greater than the specified maximum size, and enters Step 39 in the flowchart in FIG. 23, where the system stops the feed roller 34*a*.

If the rear end of the document is not detected and the content of the counter C2 becomes greater than Cb, the system may stop conveying the document and make a copy of the image that is placed on the original table 2, provided that any anomaly of conveying the document was not detected at S36 and S37. Therefore, in this case, it is impossible to duplicate the whole document but is possible to reproduce part of the document that is fed on the original table 2.

If only the copy of the whole document is desired, it is effective to discharge the document after the system stops conveying the document. In this case, the discharging operation of the document may be determined by the user. That is, after the stop of the feeding operation at Step S39, if the user presses the copy switch, the system effects a reproducing operation in Step S42 and the following steps in the flowchart in FIG. 23. On the other hand, if no duplication is desired, the operator should press the clear key etc., whereby it is possible to effect Steps S50 and S51 to discharge the document.

Thus, when the discharge of the document is desired; if the user noticed that the inserting direction of the document was wrong, it is possible to replace the document so that the document may be conveyed in the direction along the short-side. For example, if an A4-sized document is inserted along its longitudinal direction, the document is fed as the system operating as stated above. When the content of the counter C2 becomes greater than the value Cb which corresponds to the short-side of B4 document as the maximum size, the document detecting switch detects the rear end of the document and the state of the switch changes from ON-state to OFF-state. Accordingly, when the A4-document is inserted in the direction along the short-side, the count value of the counter C2 will not become equal to or greater than Cb, on the condition that the document detecting switch is turned from ON to OFF. Accordingly, the document is stopped with its rear end nipped by the feed roller 34*a*, whereby the whole area of the document can be copied.

The above counter C2 will not be reset at Step S33 to restart counting, but is reset when the feed roller 34*a* is rotated forward. While the document is conveyed (fed forward), the counter C2 counts up the number of signals from encoder 38 at S35 in the manner as the counter C1 does. The counter C2 will not be reset at Step S33 as the counter C1 is done if the document detecting switch detects the presence of the document at Step S40. That is, the counter C2 will continue to count up and will not be reset until the feed roller 34*a* is stopped at Step S41.

In this way, by providing the encoder 38 which is in direct contact with the document D conveyed and rotates as the document being fed, it is possible to successively recognize the conveyed state of the document, for every unit time (predetermined time) 'ta'. Further, if a document having a size greater than the maximum size allowed in the system is inserted and conveyed by the feed roller 34*a*, the system is able to easily detect that an over-sized document has been fed, based on the combination of the detection result by the document detecting lever 33 for detecting the insertion of a document and the comparison of the count number of output signals from the encoder 38 by the counter C2 with the predetermined time Cb corresponding to a certain feed length.

In the description heretofore, the time during which the document D is conveyed by the feed roller 34*a*, or the feed length is counted as an output time (or a length of the document) by directly checking the state of the document being conveyed using the encoder 38. In place of this method, it is possible to measure the document length by using a mere timer T. That is, if the feed roller 34*a* can be assumed to convey a document at a constant speed, the time required for conveying a document having a specified maximum size, for example, a B4 document, should be constant. Accordingly, this constant time is stored, in advance, as 'tb' and if the document detecting switch continues to detect the document (does not detect the rear end) even after the predetermined time 'tb' elapsed, the system is able to recognize that the fed document is greater than the maximum size. As a result, the system stops the feed roller 34*a* in order to stop conveying the document.

In this case, unlike the case where the encoder 38 is provided, the system cannot always check the conveyed state of the document, but discriminates the feeding operation as normal when the document detecting switch detects the rear end of the document (when the switch is turned off) within the time 'tb' corresponding to the maximum size. As this discrimination is made, the system stops conveying the document to effect the copying operation after Step 42 in FIG. 23. On the other hand, if the time counted by the timer T exceeds the predetermined time 'tb' before the rear end of the document is detected, the system discriminates that the document being fed exceeds the maximum size. However, the same situation occurs in a case where the document becomes stuck in the middle of feeding. That is. the system cannot discriminate the document jam from the over-sized document feeding. Accordingly, since it cannot be recognized by the system whether the conveyed state of the document is normal or anomalous before the timer T counts up to the predetermined time 'tb', it becomes important that the system forcibly feeds the document in the reverse direction to discharge it. In other words, in order to reduce the damage which would occur to the document, the system stops the document so that the process may not enter the copying operation.

Figure 25:
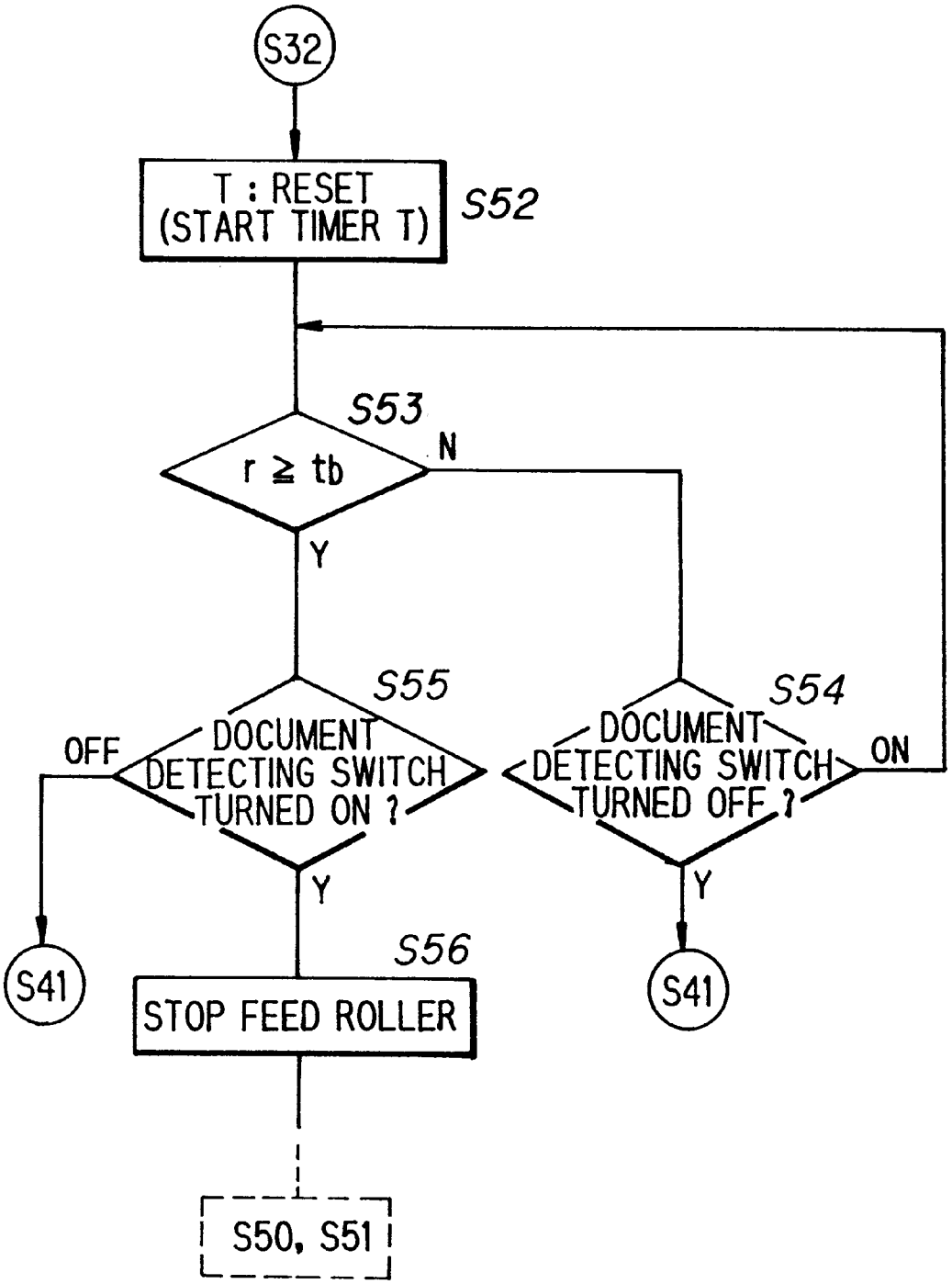
FIG. 25 is a flowchart for illustrating the control operation of recognizing document conveying conditions in another means of the invention.

FIG. 25 shows a flowchart of operation control in order to attain the above object. That is, Steps S33 to S40 in the flowchart shown in FIG. 23 should be replaced by the steps shown in FIG. 25.

As the feed roller 34*a* is activated to rotate, the timer T described above is reset and the timer T starts counting time (S52). Then the counted time by the timer T is compared with the time 'tb' corresponding to the feeding time for the maximum-size document (S53). Based on the comparison, if the timer T has not reached the time 'tb', the system checks whether the document detecting switch has already detected the rear end of the document (whether the switch is in OFF-state) (S54). That is, while the timer T counts up to the time 'tb', the system checks the detected state of the document detecting switch. If the document detecting switch detects the rear end of the document (the switch is turned off) within the time 'tb', the system recognizes that the document feeds the document normally, whereby the system effects the copying operation in Step S41 and the following steps in FIG. 23.

When the counted value of the timer T becomes 'tb' or greater, the system checks the operating state of the document detecting switch (S55). At that moment, if the switch has not yet detected the rear end (the switch is turned on), the system discriminates that the feeding is anomalous and stops the feed roller 34*a* to stop the conveyance (S56). Thus, the feeding of the document is stopped, whereby it is possible to prevent the document from being damaged by the anomalous feeding.

The system can recognize anomaly during conveying the document, but cannot discriminate whether the conveying anomaly is due to the document jam or due to the over-sized document. Therefore, the system just discharges the document in order to remove the anomalous document. In this case, the system effects the operation of Steps S50 and S51 in FIG. 23 after Step S56. That is, the system is able to prohibit the copying operation for the anomalous document, especially, even if the operator presses the copy switch, intentionally.

In FIG. 25, when the system recognizes the conveying anomaly of the document at Step S55, the original is stopped (S56). Thereafter, the system effects the operation of S50 and S51 in FIG. 23, but if the original document was creased and warped with wrinkles in this stage, the document could further be damaged if the document is reversely discharged. To deal with such a case, the system, after stopping the feed roller 34*a*, sends out a message indicating the conveying anomaly, to warn the user that the user should remove the document by releasing the original cover 3. Accordingly, it is possible for this configuration to avoid the document from being damaged by the reverse conveyance.

Figure 26:
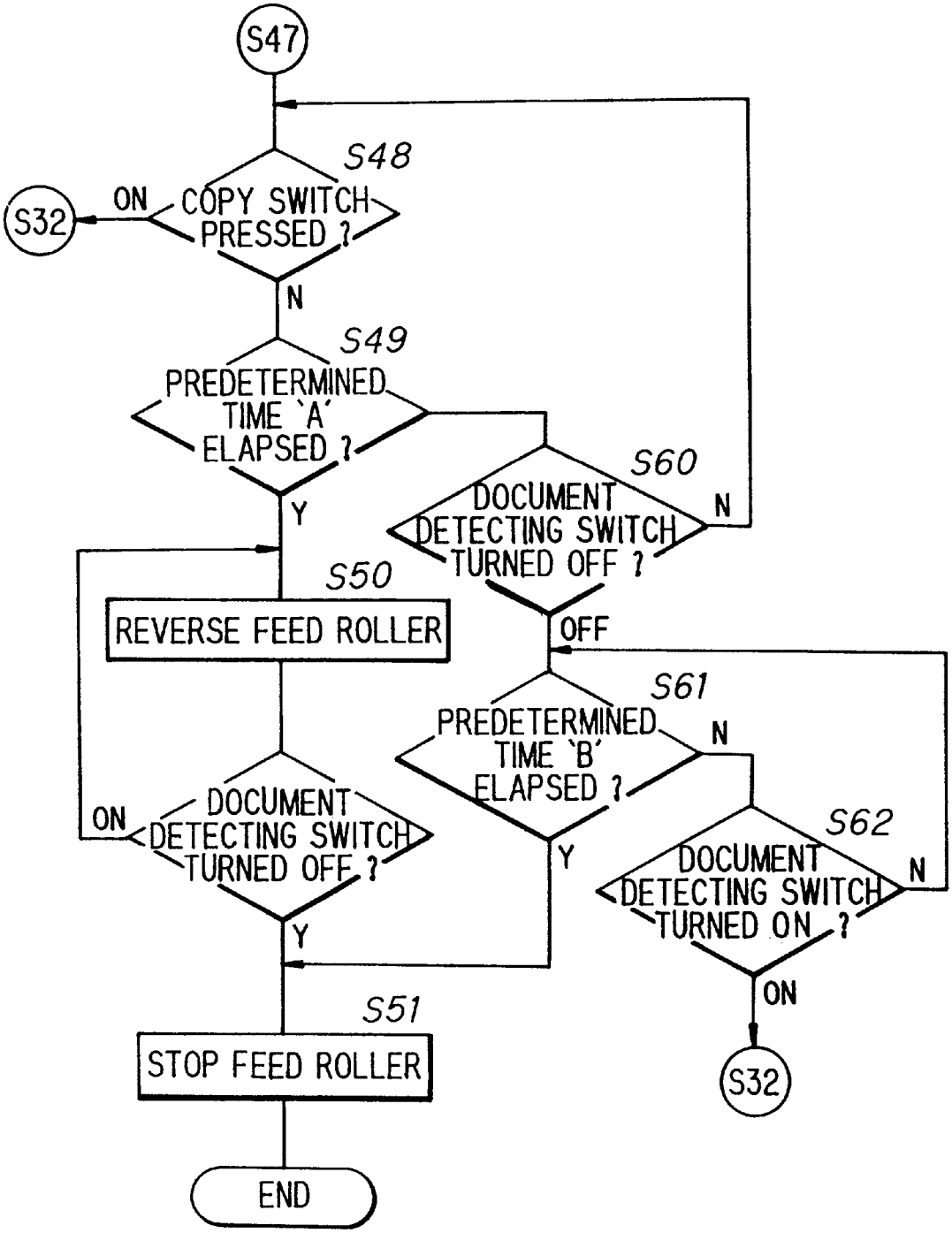
FIG. 26 is a flowchart of document conveying control and copying control in discharging a document in a document feeder.

In the flowchart shown in FIG. 23, the system counts up to a predetermined time at Step 45 so that the paper may be discharged by the feed roller. After the counting is complete, the feed roller 34*a* is stopped. Then, the system waits a predetermined time (for example 2 sec.) at S48 as expecting the print switch to be pressed (S49). If the time elapsed without the print switch pressed, the system discharges the document onto the document stocker 35. In this case, as shown in FIG. 26, while the system waits a predetermined time A at S49, the document detecting switch detects whether the document is detected, at S60. In a condition that the document is recognized (the switch is turned on) at this step, if the copy switch 223 is pressed at S48, the aforementioned copying operation in FIG. 23 is repeated.

While waiting the predetermined time A, if the document is intentionally removed and therefore the detecting switch does not detect the document (the switch is turned off), the system enters another waiting mode for waiting a predetermined time B, for example, about 10 seconds, at S61, and then checks the operating state of the document detecting switch again at S62. This situation will occur in a situation as follows: Suppose that a document greater in its feeding direction than the depth of the original table 2 is fed, the document is returned by the system. In this situation, if the operator noticed that the document was fed along a wrong direction (such as a long-side direction), the operator would manually take out the document which has been discharged out and is nipped by the feed roller 34*a* and re-inserts the document along the short-side direction. The document detecting switch detects the document re-inserted within the predetermined time B at S62, then the system is able to start the copying operation of the document without pressing of the print switch 223.

Here, while waiting the predetermined time B at S61, if the document detecting switch does not detect the insert of the document, the system proceeds by stopping the rotation of the feed roller 34*a* (S51) and ends the copying mode to return to S31.

While the system is waiting the predetermined period A at Step S49, if the document detecting switch detects the document at S60 and the copy switch is pressed, the operation goes from S49 to S50 after the passage of the predetermine time A. Thereafter, as explained with the flowchart FIG. 23, the feed roller 34*a* rotates in the reverse direction (S50). Then, as the discharge of the document is detected by the document detecting switch, the feed roller 34*a* is stopped (S51).

Here, in order to construct a means for recognizing the conveyed state, as shown in FIG. 25, the timer T is provided. This timer T is operated to recognize anomaly based on whether the timer T counts up to the predetermined feeding time 'tb' required for a maximum-size document for the original table 2. In this case, the timer T merely counts the time and does not necessarily operate in synchronism with the rotation of the feed roller 34*a*. More specifically, if the rotational speed of the feed roller 34*a* is made low due to the voltage change of the power supply or any other reason, the document detecting switch will not detect the rear end of the document at the due timing (at the time 'tb'), and consequently, the system misjudges that anomaly conveying occurs, even if the document is conveyed normally by the feed roller 34*a*.

For example, if the feed roller conveys a document in a proper way in a time longer than usual, the timer T counts up to the time 'tb' so that the system determines that the conveyance is anomalous and effects the operation against the anomalous situation after Step S55 in the flowchart in FIG. 25. That is, the operation flow shown in FIG. 25 is very effective when the feed roller 34*a* is driven at a regular conveying speed. In such a system, if the conveying speed of the feed roller 34*a* is made lower, as stated above, under the influence of the voltage drop of the power supply or any other reason, the system should deal with such a situation.

Figure 27:
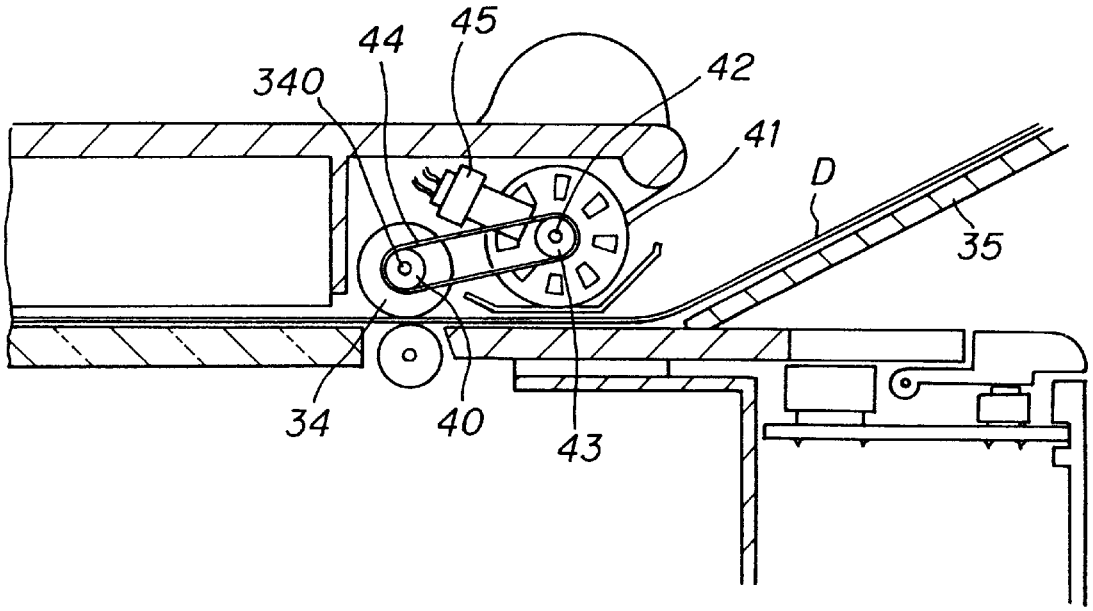
FIG. 27 is a sectional view showing another configurational example of a means of recognizing document conveying conditions in a document feeder of the invention.

For this purpose, if the system is able to check the conveyed state of the document using a parameter or signal which is always in synchronism with the rotational speed of the feed roller 34*a*, it is possible for the system to recognize the conveyed state of the document in a proper manner, without regarding to the variation of the rotational speed of the feed roller 34*a*. FIG. 27 shows a specific embodiment of a means for achieving the purpose. In FIG. 27, the means includes: a slit disc having many slits formed on the periphery thereof, for example, a rotary encoder 41; a gear 43 fixed on a rotary shaft 42 of the rotary encoder 41; another gear 40 fixed on the rotary shaft 340 of the feed roller 34*a*; a timing belt 44 wound around between the two gears 40 and 43; and a detecting sensor 45 for detecting the slits of the rotary encoder 41. Here, the rotary encoder 41 is rotatably provided on the original cover 3 and will not be rotated directly by the conveyed document D.

As the number of the detection signals from the detecting sensor 45 detecting the slits of the rotary encoder 41 rotating are counted, the system is able to directly recognize the conveyed length of a document fed by the feed roller 34*a*, in place of the time measurement described above. That is, in order to measure or estimate the conveyed length of a document, two ways are possible one way directly measures the rotation of the feed roller 34*a* and the other way uses a timer T for measuring time 'tb' from the start of the rotation of the feed roller 34*a* in order to estimate the conveyed length. If and only if the feed roller 34*a* rotates at a strictly regular speed, both the time count 'tb' by the timer T and the slit count by means of the rotary encoder 41 have the same functions and the same effects. This is why the timer T can be used in the above embodiment, in place of the rotary encoder 41 Furthermore, since the rotary encoder 41 rotates all the time, in synchronism with the feed roller 34*a*, the rotary encoder is able to output a determined number of slit signals in a determined length of a document conveyed, even if the rotational speed of the feed roller 34*a* is varied or becomes low. More clearly, if the feed roller turns at a regular conveying speed, the time 'tb' and the count number Cb should indicate the same distance, In practice, however, the feed roller 34*a* may turn at varying or lower speeds, and therefore, the entire document may not have been conveyed after the passage of time 'tb'. Accordingly, the timer T would misjudge a situation free from error as an anomalous event.

In this respect, the encoder 41 counts or measures the actual conveyed length of the document, in place of measuring the time 'tb', so that the encoder, when a document having a predetermined length has been completely fed, is able to count the predetermined count number Cb which is determined by the document having the predetermined length, and stop the feeding of the document, correctly. Accordingly, the configuration using the encoder 41 will not misjudge the situation as anomalous event, regardless of the fluctuation in the rotational speed of the feed roller 34*a*.

Particularly, since the rotary encoder 41 turns in synchronism with the rotation of the feed roller 34*a*, the encoder outputs the corresponding number of slit signals to the fed length. This is why the rotary encoder is able to make a precise recognition of the conveyed state. As to the arrangement, it is possible to directly provide the rotary encoder 41 onto the shaft 340 of the feed roller 34*a*. Such an arrangement is able to omit the timing belt, gears, rotary shaft and the like, resulting in reduced cost.

Meanwhile, it is effective to set up an increased rotational rate of the feed roller 34*a* when a document inserted is discharged as compared to the rate when the document is fed to the original table 2. That is, such a configuration not only reduces the discharging time but also makes earlier the start of copying operation for a next document. Particularly, setting up a low conveying speed of a document when the document is conveyed onto the original table 2, is very advantageous since it is possible to reduce occurrences of anomalous events.

Figure 28:
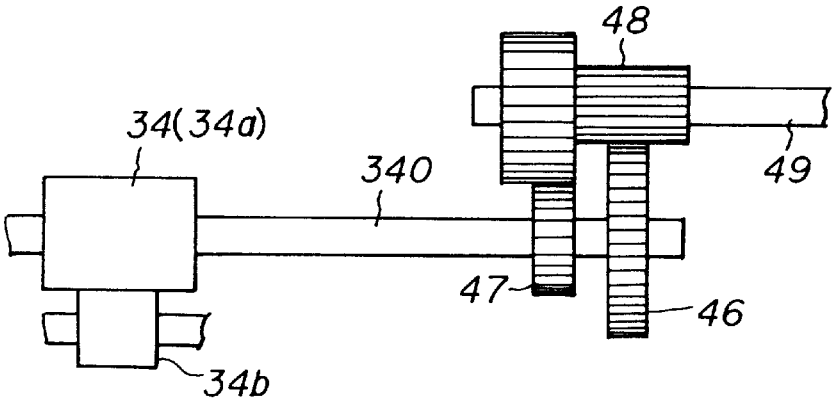
FIG. 28 is a front view showing an example of a shift-driving mechanism for changing the conveying speed of a document between when a document is inserted into an original table and when discharged therefrom.

A typical configuration of switching the document conveying speed is constructed such that, as shown in FIG. 28, two gears 46 and 47 having different numbers of teeth are attached through respective one-way clutches on the rotary shaft 340 of the feed roller 34*a*. The gear 46 has a greater number of teeth and a one-way clutch which allows the gear 46 to turn in the document feeding direction. The gear 47 has a less number of teeth and a one-way clutch which allows the gear 47 to turn in the document discharging direction.

The above gears 46 and 47 mesh double-step driving gear 48 which is rotated by a transmitted driving force from a driving motor. The gear 46 meshes the driving gear having a less number of teeth, whereas the gear 47 meshes the driving gear having a greater number of teeth.

Accordingly, when the document is fed to the original table 2, the rotational force of the driving gear 48 is transmitted to the rotary shaft through the gear 46 to drive the feed roller 34*a*. At that moment, the gear 47 idles due to the function of the one-way clutch. As the driving gear 48 turns in the document discharging direction, the rotational force is transmitted to the rotary shaft through the gear 47 to drive the feed roller 34*a* at a higher rate. In this time, the gear 46 idles due to the one-way clutch, so as not to disturb the driving by the driving gear 48 or transmit the rotation of the feed roller shaft to the driving gear, either.

In consequence, it is possible to make the conveying speed different between when the document is fed and discharged. In the above case, the change of the turning direction of the driving gear 48 makes it possible to vary the speed, thus there is no need for controlling the rotational rate of the shaft 49 that turns the driving gear 48. That is, it is possible to effect switching control of the document feeding and discharging rates with a very simple structure In the embodiment shown in FIG. 22, since the rotary encoder 38 presses the top side of an inserted document D by its self-weight, the rotary encoder 38 turns by a certain angle when the document is inserted This rotation enables the detecting sensor 39 to detect the insertion of the document. That is, it is possible to detect the document, based on the signal from the detecting sensor 39 that detects the rotation of the rotary encoder 38, without arranging the detecting lever 33 for the document detecting switch, before the feed roller 34*a*. Thus, the document detecting switch can be omitted resulting in reduced cost.

Therefore, the system can be constructed so that the operation of S32 in the flowchart in FIG. 23 is started when the inserted document D rotates the rotary encoder 38 and is detected by the detecting sensor 39. Then, the signals from the sensor 39 that detects the slits of the rotary encoder 38 will be counted, whereby it is possible to control the system in the same manner as before, even if the document detecting switch is not provided separately.

As has been described heretofore, according to the third embodiment of the invention, since a simple document feeder is provided which includes a feeding means disposed on one side of the original table for delivering documents into between the closed original cover and the original table, it is possible to reduce the cost as of a copier with a document feeder.

In this case, when a document is fed to the original table using the document feeder of this embodiment, the state of the document can be checked by the means for detecting the conveyed state of the document. Accordingly, the document can be fed to the proper position on the original table, based on the recognition of the normal condition of the document. If any anomaly in feeding is recognized, the conveyance of the document is stopped in order to prevent a further damage to the document, and the anomalous state may be displayed, as required, to warn the user.

Accordingly, it is possible for such a simple document feeder to check whether a document is conveyed normally or anomalously, to thereby reduce damages to the document as much as possible.

Since a rotary disc which rotates in synchronism with the conveyance of the document is provided as a means for recognizing the conveyed state of the document and the rotation of the disc is detected, the conveyed state of the document can be recognized in its early stage by detecting the signals from the rotating rotary disc, in every predetermined period of time. Accordingly, it is possible to reduce damages occurring to the document. In this case, if the size of a document fed is greater than the maximum-image size of the original table, the situation can be recognized by counting the number of the detected signals from the rotary disc. Therefore, if the feeding of the document is stopped at that state, it is possible to create a copy of a partial image which is fed on the original table.

Further, in a case where, after the predetermined time of conveyance of a document, the rear end of the document is not detected, the system is able to recognize that the document is greater than the maximum image-size for the original table, thus the document will not be further conveyed. Accordingly, it is possible to reduce damages which would occur to the front end of the document.

In this embodiment, since a rotary disc that rotates in synchronism with the means for conveying documents is provided, it is possible to reliably recognize that a document exceeding in size the original table is being fed, even when the conveying speed of the feeding means fluctuates. This configuration, further contributes to reducing damages that occur to the front end of the document.

Figure 29:
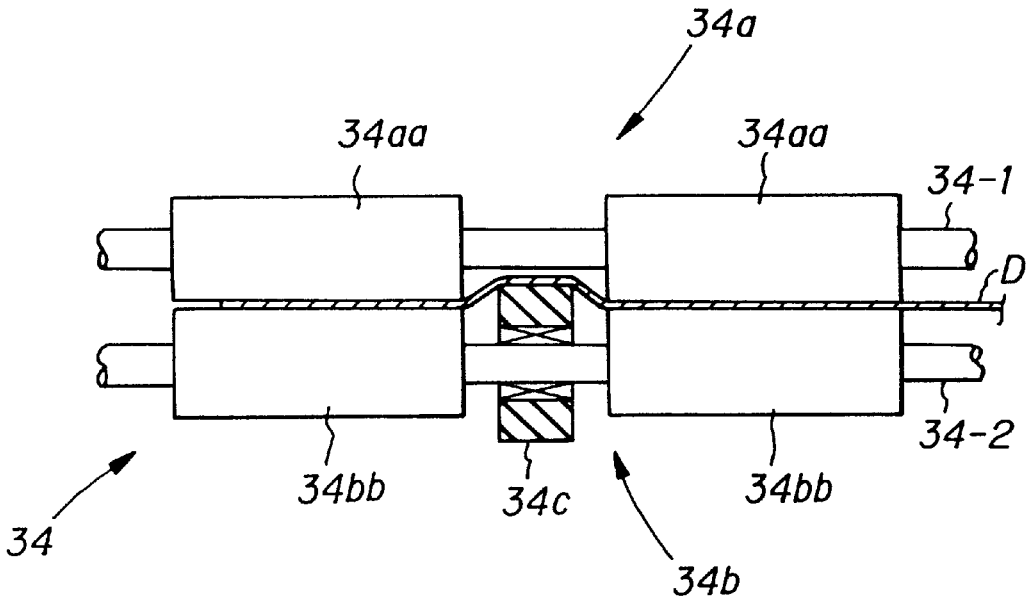
FIG. 29 is a front view showing an example of a bend forming means at a position of a feeding means of the invention.

FIG. 29 shows a fourth embodiment of the present invention, in which conveying performance of a document is improved by enhancing the toughness of the document conveyed in order for the feed roller 34*a* to reliably feed the document.

Referring to FIG. 29, a driving roller 34*a* is composed of a roller shaft 34-1 and a plurality of roller elements 34*aa* fixed on the roller shaft 34-1 with a predetermined distance spaced. A pressing roller 34*b* pressed against the driving roller 34*a* is composed of a roller shaft 34-2 and a plurality of roller elements 34*bb* fixed on the roller shaft 34-2 with a predetermined distance spaced, in the same manner with the driving roller 34*a*. A pair of the upper and lower rollers are pressed against each other, so that the pressing roller 34*b* is turned as the driving roller 34*a* rotates, whereby a nipped sheet document D therebetween is conveyed. These two rollers constitute a feed roller unit 34.

An idle roller 34*c* is disposed rotatably on the roller shaft 34-2, in a position between the roller elements 34*bb* (a portion without roller elements). The idle roller 34*c* is a large-diameter roller slightly greater in diameter than the pressing roller 34*b*, and supported in place rotatably on the roller shaft 34-2 by fixing pieces such as E-rings, so as not to move in the axial direction.

Accordingly, a sheet document D guided by the document stocker 35 serving as a document tray is nipped at its front end by the feed roller unit 34 and starts to be conveyed. At this moment, the sheet document D is curved upward in a portion thereof by the idle roller 34*c* disposed between the roller elements. Therefore, the toughness of the sheet document D is markedly enhanced as compared to that of the sheet conveyed flat. Therefore, the possibility of suffering harm or loss of the front end of the document conveyed becomes markedly less.

Figure 30:
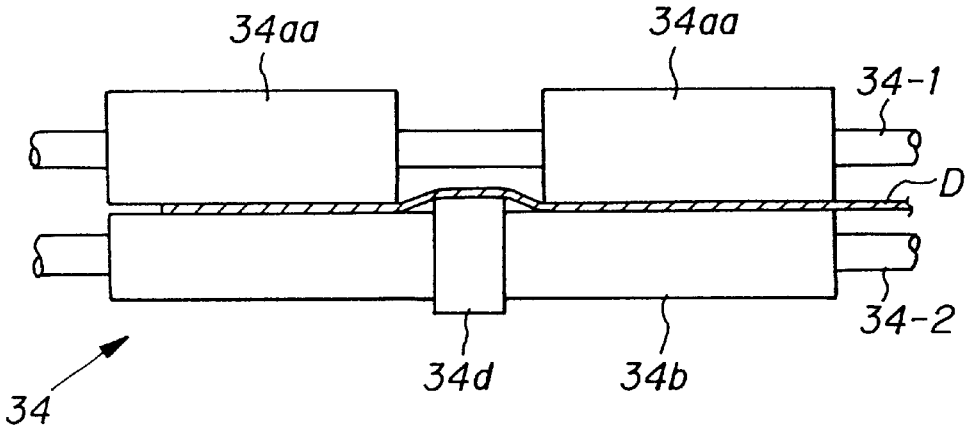
FIG. 30 is a front view showing another example of a bend forming means at a position of a feeding means of the invention.

In the above configuration, although the idle roller 34*c* is supported rotatably on the roller shaft 34-2 of the pressing roller 34*b*, it may be supported rotatably on the roller shaft 34-1 of the driving roller 34*a*. As a variation, it is also possible to form a pressing roller 34*b* as shown in FIG. 30. That is, in place of the idle roller 34*c*, a pressing roller 34*b* is integrally formed and fixed on the roller shaft 34-2 with a large-diameter bulging roller portion 34*d* positioned in correspondence with the spaced portion of the driving roller 34*a*. Use of this pressing roller 34*b* makes it possible, in the same manner as in FIG. 29, to curve a part of the sheet document D upward in the position of the budging roller portion 34*d* when the sheet document D is nipped by the rollers. Accordingly, it is possible to convey the sheet material with the toughness enhanced.

Meanwhile, a document pressing mat 3*a* is provided on the inner side of the original cover 3 and usually comes in close contact with the surface of the original table 2, by the self-weight. Hence, even if the document being inserted is conveyed by the feed roller unit 34, the document can not be inserted in between the document pressing mat 3*a* and the original table 2, but will be stopped and become stuck. Accordingly, it is necessary to lift the original cover 3 up to create such a gap between the original table 2 and the document pressing mat 3*a* as to allow the document to pass therethrough.

As a configuration of the lifting mechanism for lifting the original cover 3 up, a document stocker 35 is rotatably provided on pivot supporters 36 provided for the grip portion 31 on the front part of the outer plate of the original cover 3. The document stocker 35 has a bending portion 35*a* disposed on both sides and the rear side to define a space for accommodating documents etc., between the top face of the original cover 3 and itself. Formed on the front side of the stocker 35 is an opening 35*c* from which documents etc., are inserted into the top surface of the original cover 3.

A pair of pivots 35*b* are formed in the front part of the bending portion 35*a* on both sides of the stocker 35, so as to allow the document stocker 35 to rotate thereon. The pivots 35*b* are inserted into recesses 36*a* of the pivot supporters 36 provided on the front side of the outer plate 3*b* of the original cover 3. Particularly, when the outer plate of the original cover 3 is made of a resilient material such as resins etc., it is possible to fit the pivots into the pivots recesses by utilizing the resiliency. More specifically, the pivots 35*b* can be mated with the pivoting recesses 36*a* by warping the bending portion 35 around the pivots 35*b* so that the distance between the pivots 35*b* may become shorter than that of the pivot supporters 36 and aligning pivots with respective recesses and then releasing the deformation. Accordingly, the pivots 36*b* are fitted into respective pivot recesses 36*a* so that the document stocker 35 is rotatably supported relative to the original cover 3.

Thus, the document stocker 35 is pivoted. When the document stocker 35 is placed over the original cover 3, a space is formed by the top face of the original cover 3 and the bending portion 35*a* of the document stocker 35, so as to allow documents and any other necessary articles to be accommodated therein. This document stocker 35 is constructed in such a size as to accommodate originals having a maximum size, especially, maximum width, capable of being copied, as shown in FIG. 11.

In order for the document stocker 35 to lift up the original cover 3 so as to create a gap between the document pressing mat 3*a* and the original table 2, a pair of catching members 37 are provided on the upper portion of the outer plate 1*a* of the copier body side, in corresponding positions to the pivots 35*b*, as shown in FIG. 10. The catching member 37 protrudes in some degree toward the control panel 222 and has a hook portion 37*a* crooked more or less toward the lower part thereof.

In position with the catching members 37, a pair of engaging portion 35*d* are formed on the side of the document stocker 35 to engage with the catching member 37. The engaging portions 35*d* are formed in the vicinity of the front part of the opening 35*c* of the document stocker 35, especially near the pivots 35*b*. Each engaging portion 35*d* has a projected form so as to be fitted into the hook portion 37*a*. The catching members 37 and the engaging portions 35*d* constitute an engaging mechanism.

Accordingly, when the document stocker 35 which is placed over the original cover 3 as shown in FIGS. 11 and 12 is rotated to this side until the document stocker 35 is positioned over the control panel 222, the one end portion of the document stocker 35 abuts the flat surface of the outer plate 1*a* so that the document stocker 35 may not make a further rotation. In this condition, the projected, engaging portions 35*d* of the document stocker 35 are engaged into the hook portions 37*a* of the aforementioned catching members 37.

At this moment, one side of the peripheral edge portions defining the opening 35*c* of the document stocker 35 is supported by the top face of the outer plate 1*a* of the copier body. In this condition, the hook portions 37*a* of the catching members 37 are engaged with respective engaging portions 35*d*, whereby the original cover 3 is lifted upward by the pivots 35*b*. That is, the grip portion 31 opposed to the pivotable hinge on the rear side of the original cover 3 is raised upward on the hinge of the original cover 3 (disposed on the rear side of the copier shown in FIGS. 11 and 12)

through the pivots 35*b* as the original stocker 35 is rotated. As a result, a gap 'd' is created between the original table 2 and the document pressing mat 3*a*.

In this arrangement, as a sheet document is inserted along the top surface of the document stocker 35 thus rotated, the inserted document can be conveyed by the feed roller 35 and guided through the gap between the original table 2 and the document mat 3*a* onto the original table 2.

The above gap 'd' is determined depending upon a distance between the engaging site of the catching member 37 and the engaging portion 35*c*, and the pivot 35*b*, and upon an angle formed between a line jointed between the pivots 35*b* and the engaging site, and the horizontal plane. That is, it is possible to obtain a desired gap 'd' by setting up these positional relations, properly.

One of the sides of the bending portion 35*a* of the document stocker 35 is used as a guide for guiding one side edge of an inserted document. That is, the document is registered by the two reference edges, one of which is the above-mentioned reference edge 2*a* on the original table 2 and the other is perpendicular to the reference edge 2*a*. One of the sides of the bending portion 35*a* of the document stocker 35 is formed so as to correspond to the latter reference edge. The opposite side of the bending portion 35*a* is spaced from the corresponding side of the bending portion 35*a* to the reference edge, by such a distance as to accommodate maximum-sized documents specified.

Figure 31:
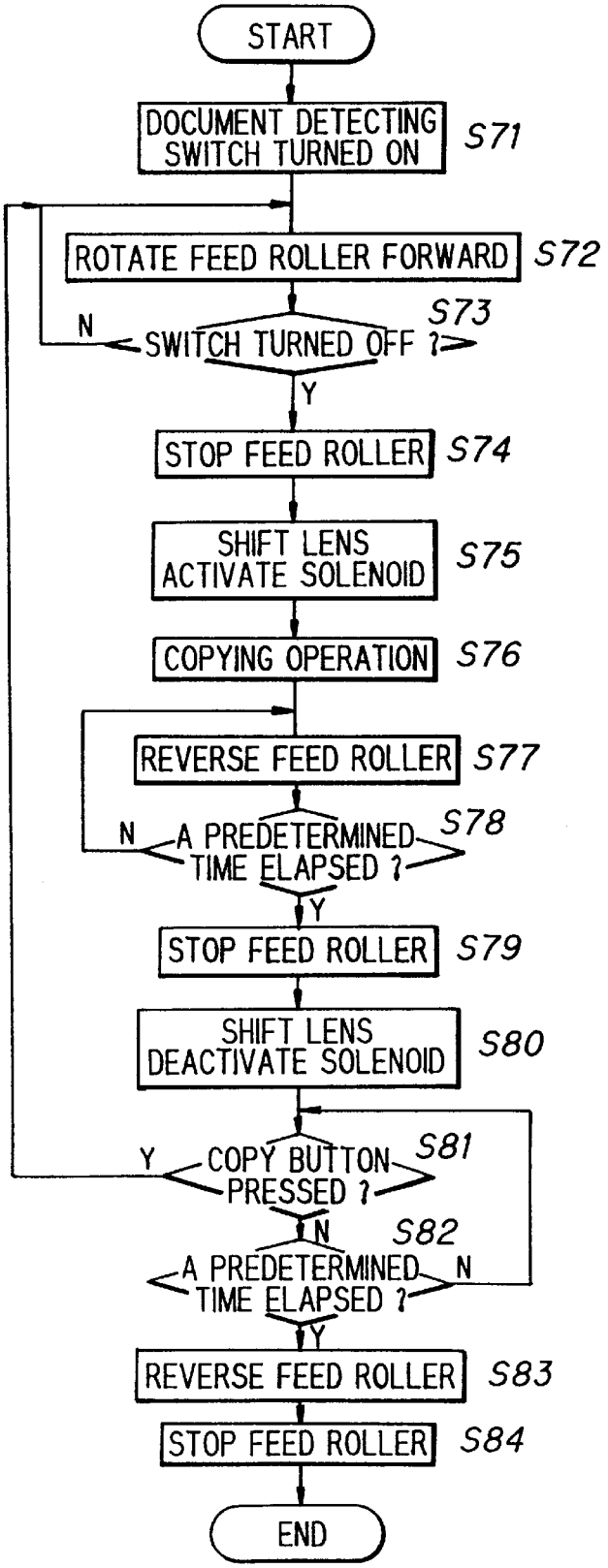
FIG. 31 is a flowchart showing the operation of controlling image forming and control of a document feeder of the invention.

Referring next to a flowchart shown in FIG. 31, the operation of the copier and the document feeder 30 will be described. FIGS. 11 and 12 show a state where the original cover 3 is closed with the document stocker 35 positioned over the original cover 3. From this setting, the document stocker 35 is rotated to this side to be opened. By this operation, the hook portion 37*a* of the catching member 37 meshes the engaging member 35*c*, as shown in FIGS. 9 and 10, so that the document stocker 35 is lifted upward, creating the gap 'd' between the document pressing mat 3*a* and the original table 2.

In the above setting, when a document D is inserted along the upper surface of the document stocker 35 from the document feeding port 32, the document D raises the detecting lever 33, to thereby turn the document detecting switch on (Step S71).

At the time of inserting the document, if, for example the left edge of the original table 2 in FIG. 11 is assumed to be a referenced position for the placement of the document, the left side of the bending portion 35*a* of the document stocker 35 is adapted to coincide to the referenced position, whereby it is possible to use the bending portion 35*a* to guide the front part of the document. By this arrangement, it is possible to deliver the document to the original table 2 in place with its front side aligned with the referenced position.

As the document detecting switch is activated by the inserted document, the feed roller 34*a* starts to rotate in the forward direction or in the document feeding direction (in the clockwise direction in FIG. 9) (Step S72), the document D is fed into a gap 'd' between the document pressing mat 3*a* and the original glass table 2. In this case, the opposed face of the document pressing mat 3*a* to the original table 2 serves as a document guide. The gap 'd' is preferably 0.1 mm or more by considering that a typical paper sheet is about 0.08 mm thick. The clearance 'd' can easily be adjusted as stated before.

At that moment, as the front end of the sheet document D is held and conveyed by the feed roller unit 34, a part of the sheet document D is arched or curved upward so that the toughness of the sheet document D is enhanced, as described referring to FIG. 29. Accordingly, the sheet document D is conveyed as if it were thick paper, or the conveying force from the feed roller unit 34 is transmitted through the sheet up to front end to allow the paper to progress reliably without its front end bent. Further, the sheet document D is fed into the gap so that the front end of the sheet may abut the surface of the original table 2. The thus abutting sheet D is conveyed as pressed down from the upper side, whereby the arched swelling portion formed at the nipping position by the feed roller unit 34 is canceled and consequently, the document can be delivered onto the original table 2 with the image surface thereof in close contact with the original table 2.

Thereafter, when the rear end of the document D goes through the detecting lever 33 and the document detecting switch turns off (Step S73), the feed roller unit 34 stops turning (Step S74) while the rear end of the document D is kept nipped by the feed roller unit 34.

In this ways as the document D is automatically fed onto the document table 2, the copier starts to perform the same copying operation as will be effected when the copy button 223 is pressed, whereby the copier effects reproducing procedures from the exposure to the discharge of copy paper (Step S76). In this case, the copying operation is carried out with the rear end of the document D nipped by the feed roller unit 34. Therefore, the placement of the document differs by, for example, about 10 mm, as shown in FIG. 9, from where the usual operation is done without using the document feeder 30. Since the rear end of the document is kept nipped by the feed roller unit 34, the difference is the distance between the nipped edge and one reference side of the original table 2. To cancel this difference, in this embodiment, the lens 4*e* in the optical system is shifted from a referenced position so that the center of the document D may coincide with the that of the copy sheet P.

SpecIfically, the copier is constructed so that activation of the document switch may start the same copying operation as is effected when the copy button 223 is pressed. Accordingly, with no pressing of the copying button 223, insertion of a document turns the original detecting switch on, to thereby start the copying operation. Before the activation of the copying operation, the lens 4*e* is shifted by about 5 mm by means of an unillustrated solenoid or motor for lens-shifting, so that the nipped document D may be image-formed on the photoreceptor 105 with the focused image of the edge shifted by 10 mm.

Accordingly, it is possible to make the focused image on the photoreceptor coincide with the feed reference position of the copy sheet delivered as usual (Step S75). For this purpose, the lens 4*e* is provided so as to be able to move in the direction perpendicular to the optical axis (in the forward and rearward directions in FIG. 9). When copying operation is done by automatic document handling, the copier is so set up that the lens 4*e* is shifted about 5 mm toward the front side in FIG. 11, or rightward in FIGS. 9 or 10. In this case, the undersurface of the supporting frame of the original table 2, in particular, the region around the nipped portion of the document where the light is illuminated by the optical system should preferably be white, since the reflected light from this area is projected on the photoreceptor 105. If this area has a dark color, toner would be adhered onto the corresponding area and transferred to the copy sheet, resulting in formation of a black strip of about 10 mm in width.

In this condition, copying operation is effected in Step S76. After the completion of the process, the feed roller unit 34 is turned in the reverse direction by the driving motor (Step S77), the document D is delivered out toward the document feeding port 32. This discharge is performed by previously memorizing the rotating time of the feed roller unit 34 when the document D is inserted and measuring a setup time which is a little shorter (by a time equivalent to about 10 mm in feed distance) than the memorized time (Step S78) and stopping the reverse movement of the feed roller unit 34 after the passage of the thus setup time (Step S79).

Accordingly, the document D stops at a position where the end of the document D is nipped in some degree by the feed roller unit 34. In this condition, if another copy is wanted and the copy button is pressed within a predetermined period (for example, 2 seconds) after the feed rollers stopped, the feed roller unit 34 starts turning in the forward direction and the system reenters copying operation.

Thus, it is possible to take a multiple number of copies. After the predetermined time passed, the feed roller unit 34 is again reversed, whereby the document D is discharged to the document stocker 35. It is noted that if the number of copies for a document is specified previously, it is possible to easily obtain a required number of copies in a single operation.

As has been described, duplication of a single document is performed using the document feeder 30. If two or more documents are to be copied, the operator should put the finished document onto the top flat face of the original cover 3 and insert a next sheet document into the document feeding port 32 to effect a similar copying operation to thereby obtain desired copies.

In accordance with this embodiment, the document is fed in a direction perpendicular to the direction in which copy sheets are conveyed. Accordingly, since copying is effected with one side edge of the document nipped, the centers of the copy sheet and the document will not coincide with one another. To avoid this situation, the focusing lens is moved in the direction perpendicular to the optical axis of the lens, whereby the centers of the document and the copy sheet are made coincident.

Nevertheless, it is also possible to convey the document in the same direction as the copy sheet is conveyed. That is, for example, the original cover 3 is hinged on the right side in FIG. 11 while a document feeding port may be formed on the opposite side to the hinged portion. The other components may be configurated in the same manner as described above. In this case, the document is exposed to light with the rear end of the document nipped 10 mm, for example, the front end of the image formed on the photoreceptor is positioned different by 10 mm from the front end of the copy sheet conveyed. To cancel this discrepancy can be easily done by effecting control of driving so as to make the timing of delivering the copy sheet, earlier by a time equivalent to about 10 mm in feed distance. Specifically, the timing or opening the stopper 119 shown In FIG. 11 may and should be made earlier by a time equivalent to about 10 mm in feed distance.

In the configurations described above in which the image of the document is directly projected to the photoreceptor, the deviation of centers between the document and the copy sheet or the difference of the front end of the sheet from that of the image formed is unavoidable. This can be dealt with by using a digital image forming apparatus in which the image of a document placed is picked up digitally so that the picked up data is written onto the photoreceptor with laser beams. In such an image forming apparatus, the aforementioned center difference between the document and the copy sheet or the positional deviation between the copy sheet and the formed image can be modified or corrected when illumination of laser beams is to be done. That is, partial image area which is of the original but is not placed on the original table 2 is assumed to be plain area, whereby the total image containing the plain area may and should be written in on the photoreceptor 105 by laser illumination. To pick up an image digitally, a typical process is effected as follows: That is, a CCD or the like should be disposed after the focusing lens 4*e*. The picked up image data from the document by the CCD is A/D converted to be stored. Then, the laser beams modulated based on the stored digital image data are illuminated on the photoreceptor 105, whereby a static latent image corresponding to the image of the document can be created with dots.

As described heretofore, the document feeder 30 of this embodiment can be constructed by the simple means, so that it is possible to markedly contribute to reducing the cost. In the above description, the document stocker 35 for creating a gap 'd' between the original cover 3 and the original table 2 is configurated as holding documents etc., but this is not a must but a mere rotational member can be used, in place of the document stocker 35. However, since, in the above embodiment, the document stocker 35 has both functions, it is advantageous that the member can be used as a storage if the document feeder is not used. When the document stocker 35 is used for the document feeder, the document stocker 35 not only serves the bottom guide of inserted documents, but also serves as a discharge tray when documents are discharged.

In the embodiment of the invention, the original cover 3 is adapted to rise from the original table 2 by the lifting mechanism in link with the rotation of the document stocker 35 when the stocker is set to be used as the document guide. However, the invention should not be limited to this configuration. That is, it also possible to make the same operation by a lifting mechanism in which the original cover 3 is lifted up when a document is inserted.

For example, the means shown in FIG. 5 may be used. The means include: a moving piece 25 disposed in a position outside the document inserting region for the maximum-width document, for lifting the original cover 3 up; and a solenoid 24 disposed between the handgrip of the original cover 3 and the outer top face 1*a* of the copier body, for operating the moving piece 25. The moving piece 25 for lifting is rotatably supported by the outer plate 10*b* and the opposite part abuts the grip portion of the original cover 3, while the central portion is jointed to the solenoid 24.

When the solenoid 24 is not energized or not supplied with electric power, the moving piece 25 stays a little inclined in the counterclockwise direction. In this condition, no clearance 'd' is created between the original table 2 and the document mat 3*a*. That is, the document pressing mat 3*a* is in close contact with the original table 2. As the solenoid 24 is energized by electric power, the moving piece 25 moves to a position shown in FIG. 5 so that the original cover 3 is raised. In consequence, a gap 'd' is formed between the document mat 3*a* and the original table 2, as shown in FIG. 5.

In the above arrangement, in the case where the document stocker 35 is rotated to be used as the original guide; if a document is inserted, the detecting switch is activated through the detecting lever 33. Accordingly, the solenoid 24 is energized to rotate the moving piece 25, whereby the original cover 3 can be raised. In this condition, the feed roller 34*a* is activated to convey the sheet document to the original table 2.

This operation will be explained using the above-described flowchart of operation control, shown in FIG. 31. As a document D is detected at S71, this activates the solenoid 24 so as to lift up the original cover 3 from the original table 2 by a gap 'd', as shown in FIG. 5. Then the steps after S72 are effected. When the operation reaches Step S74, the operation of the feed roller unit 34 is stopped. In this situation, the document D is partially curved upward by the idle roller 34*c* in the feed roller unit 34. As a result, the sheet document D is substantially enforced as to toughness and conveyed so as to be brought into contact with the original table 2. That is, the conveying performance is improved so that it is possible to prevent the front end of the document from being damaged by jamming and the like.

In the condition as stated above where the conveyance of the document is stopped or the operation of the feed roller unit 34 is stopped, the solenoid 24 is deactivated at Step S75 simultaneously with the movement of the lens. As a result, the sheet document D with its rear end nipped by the feed roller unit 34 is pressed onto the original table 2 by the original cover 3 falling due to its own weight. At the moment, the sheet document D, which has been placed on the original table 2 as undulated by the curvature formed in the feed roller unit 34, is smoothed so that the whole document surface comes into close contact with the original table 2.

Then, the system goes to Step S76 where copying operation is effected. As the copying operation completes, the feed roller unit 34 is reversely operated at Step S77 in order to discharge the sheet document D. Before the reverse operation of the feeder roller unit 34, the solenoid 24 is activated to separate the original mat 3*a* from the original table 2. Thereafter, the aforementioned discharging operation is effected. As the above steps are successively repeated, it is possible to effect copying operation for a desired number of original documents, by using the document feeder.

In the above embodiment, in order to substantially enhance the toughness of a sheet document D, part of the sheet document is curved in the position of the feed roller unit 34. Such a curve-forming means, however, should not be limited to the feed roller unit 34. For example, it is possible to provide a rotatable roll or the like, above the passage of the sheet document D between the feed roller unit 34 and the original table 2, so that the roll may press the upper surface of the sheet document downward. As a configuration of the roll or roller, a pair of roll elements may be disposed at both side-edge portions of the sheet document D so as to lower both side-edge portions of the document D as compared to the central part. That is, it is possible to substantially enhance the toughness of the sheet document D by creating an upward-convex curvature.

It is also possible to provide a rotatable roll or roller in the central part of the sheet document conveyed, so as to lower the central part of the sheet document. That is, it is possible to substantially enhance the toughness of the sheet document D by creating a down-convex curvature.

Further, rotatable roll or roller elements are provided in both side-edge portions of the sheet document conveyed to lower both side-edge portions of the sheet document while a rotatable roll or roller is provided below the document in the central part of the sheet document to raise the central part from the lower portion. This configuration positively creates a curving portion, thus making it possible to substantially enhance the toughness of the sheet document D.

Here, when a sheet document, guided using the document stocker 35, is conveyed by the feed roller 34*a* toward the original table 2, as shown in FIG. 9, the sheet document will be fed into the gap 'd' with its sheet face in parallel with the original table 2. That is, the sheet document D conveyed is not guided or slid on the surface of the original table 2.

Figure 32:
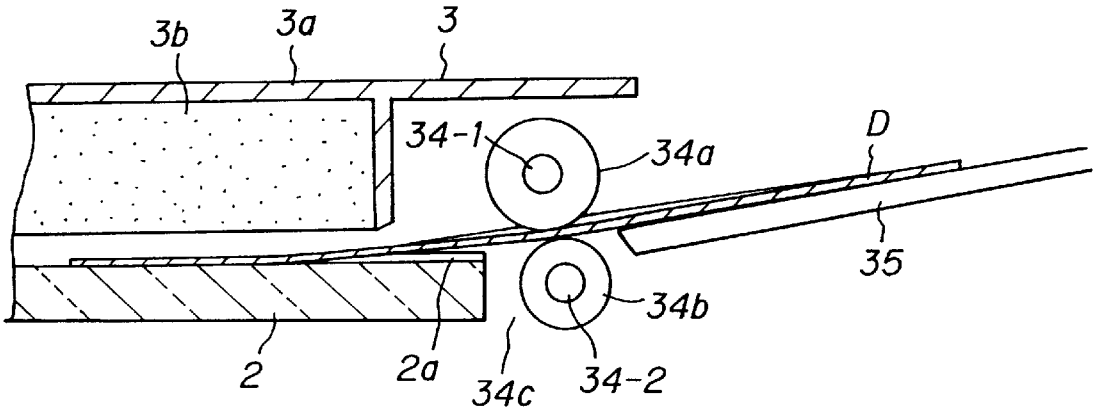
FIG. 32 is a sectional view showing another example of a feeding means in a document feeder of the invention.

To deal with this, as shown in FIG. 32, the feed roller unit 34 are positioned in such a manner that the contact between the driving roller 34*a* and the pressing roller 34*b* may be above the surface of the original table 2 while the tangent of the contact between the pair rollers 34 may intersect the surface of the original table 2. In other words, the driving roller 34*a* is adapted to abut the pressing roller 34*b* in such a position that a line joined between the centers of the roller shaft 34-1 of the roller 34*a* and the roller shaft 34-2 of the roller 34*b* (the line orthogonal to the above tangent) may be inclined slightly to the left in the figure, relative to the vertical line.

By this arrangement, the sheet document D guided along the document stocker 35 is delivered by the feed roller unit 34 so that the front end of the document first abuts the original table 2 and thereafter comes into contact with the surface of the original table 2. In this while, since part of the sheet document D is arched by the feed roller unit 34, the document is conveyed so as to come into close contact with the original table 2 with its conveyability improved.

FIGS. 29 and 30 show configurational examples in which part of the sheet document D is arched by the feed roller unit 34. In FIG. 29, the sheet document is conveyed by upper and lower rollers 34*a* and 34*b* as nipped therebetween. In this case, the pressing roller 34*b* rotates as being driven by the driving roller 34*a*. The large-diameter idle roller 34*c* disposed between shafts of the above rollers 34*a* and 34*b* is rotatably provided on the roller shaft 34-2. Accordingly, conveying speeds on the upper and lower positions of the sheet document D become the same and the conveying force by the idle roller 34*c* does not act on the undersurface of the sheet document. As a result, no wrinkles will appear along the feeding direction, or perpendicular to the aforementioned curvature, thereby making it possible to establish stable feeding.

In this respect, when the feed roller unit 34 has a structure as shown in FIG. 30, the large-diameter roller 34*d* opposite to the space between the roller elements of the driving roller 34*a* which drives the pressing roller 34*b*, acts a conveying force on the underside of the sheet document D. Consequently, the large-diameter roller 34*d* could generate wrinkles etc. on the document D in the direction perpendicular to the curvature of the sheet document D.

To solve the above defect, the pressing roller 34*b* abutting the driving roller 34*a* is constructed so that roller elements 34*bb* are rotatably disposed on the roller shaft 34-2 while a roller 34*e* having a greater diameter than the pressing roller element 34*bb* and the same diameter with that of the driving roller 34*a* is fixed on the roller shaft 34-2 in a position opposite to the space between the roller elements of the driving roller 34*a*. This roller 34*e* is to form upward curvature to the sheet document conveyed.

Figure 33:
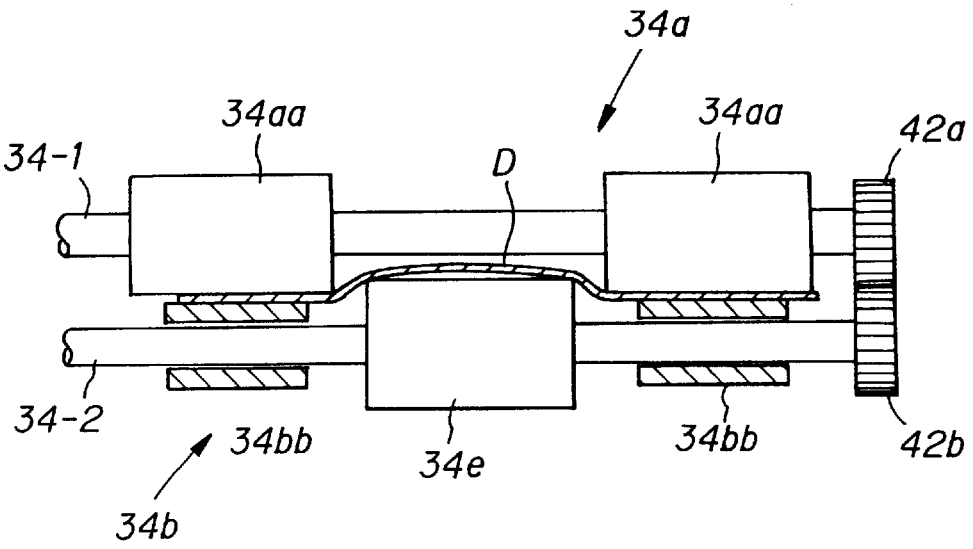
FIG. 33 is a front view showing another example of a bend forming means at a position of a feeding means of the invention.

In the configuration shown in FIG. 33, the pressing roller elements 34*bb* rotate as following the driving roller 34*a* so that the conveying speeds of the document on the upper and lower sides are the same. Meanwhile, the roller shaft 34-2 is linked with the roller shaft 34-1 of the driving roller 34 through a pair of driving and driven gears 42*a* and 42*b* which have the same diameter and are fixed on the roller shafts 34-1 and 34-2, respectively. Accordingly, the roller

34*e* rotates at the same rate as the driving roller 34*a*, whereby the defect relating to the configuration of FIG. 30 can be eliminated.

In accordance with any of the feed roller units 34 as described with reference to FIGS. 29, 30 and 33, part of a sheet document D conveyed can be arched upward to enhance the toughness of the sheet document D, attaining improved conveyability of the sheet document D. Therefore, when a sheet document D is conveyed into the gap 'd' formed by lifting up the original cover 3 from the original table 2, the front end of the sheet document D thus enhanced in its toughness is able to effectively advance into the gap, whereby the conveying performance can be markedly improved so that it is possible to prevent the front end of the document from being damaged by jamming and the like. Particularly, when the curve-forming means is provided, as stated above, in the course between the feed roller unit 34 and the original table 2, in place of the feed roller unit 34, the conveying force is given separately to the sheet. Accordingly, the sheet having passed through the position in question, has a stronger tendency to return to the original state, or flat state, due to its own toughness, resulting in halved disadvantage.

Figure 34:
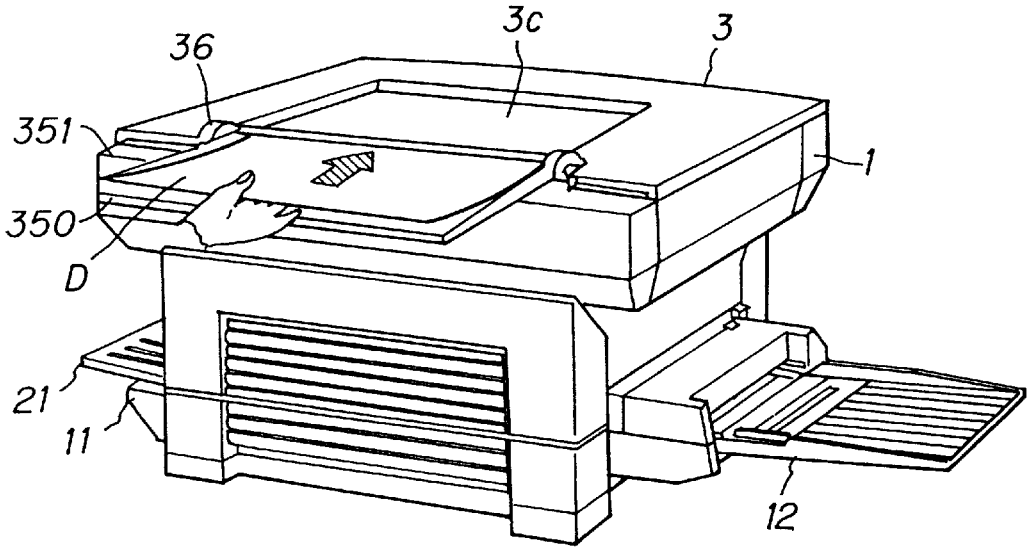
FIG. 34 is a perspective view showing another example of an image forming apparatus equipped with a document feeder of the invention.

FIG. 34 shows another embodiment in which the original cover 3 is formed with a recessed portion 3*c* to make a holding portion of documents etc. Also, a rotational member 350 may be provided which is rotatable to mate with the recessed portion 3*c*. This configuration, in which the rotational member 350 is fitted in the recessed portion 3*c* of the original cover 3, has no protrusion on the surface of the original cover 3, this makes it possible to put documents etc. on the top. A guiding piece 351 may and should be formed for the rotational member 350 on, at least, the side corresponding to the reference position of the original table 2. This guiding piece can and should also be accommodated into the recessed portion 3*c*.

As has been described heretofore, according to the fourth embodiment of the invention, since a simple document feeder is provided which includes a feeding means disposed on one side of the original table for delivering documents into between the closed original cover and the original table, it is possible to reduce the cost as of a copier with a document feeder.

Particularly, since, when a sheet document is conveyed into a gap formed between the original table and the original cover, part of the sheet document is arched upward to improve the conveyability, the document can reliably be fed into the gap.

Since part of a sheet document is arched in the position where the sheet is conveyed, it is possible to improve the conveyability of the document. As a result the feeding operation becomes reliable and it is possible to eliminate jamming and the like of the document at its front end.

Further, the sheet document fed is conveyed so that the front end is oriented to the original table, it is possible to improve contact of the document with the original table as well as the conveyability of the document. Since the document can be conveyed along the surface of the original table, the sheet document can be conveyed exactly and reliably. In this case, since the contact of the document with the original table is improved, it is possible to prevent the rise of the document from the original table. This feature is markedly effective in the image forming process.

Figure 35:
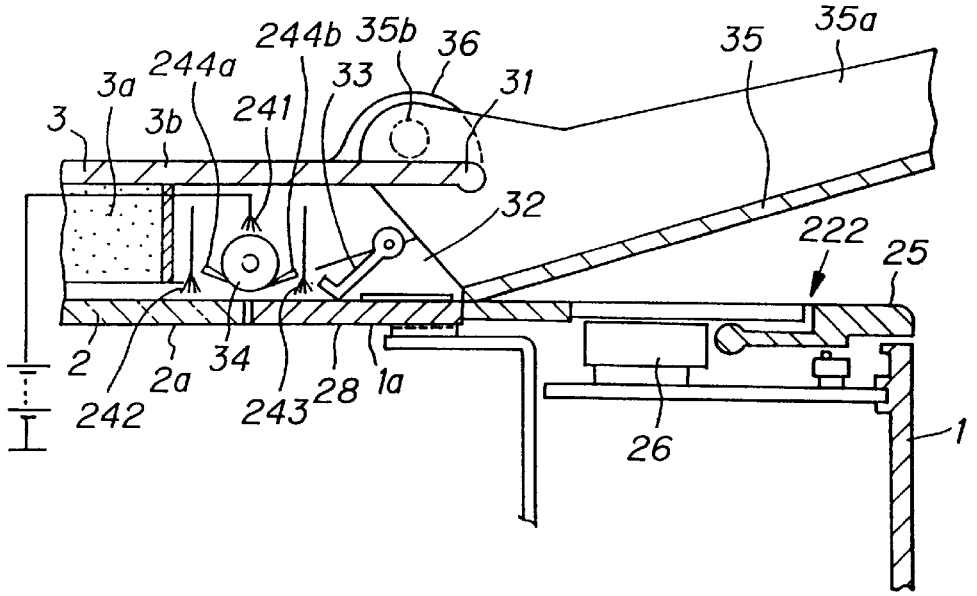
FIG. 35 is a schematic sectional view showing an embodiment of a document feeder in accordance with the invention.

Next, a fifth embodiment of the invention will be described. In this embodiment, a document detecting means and a feeding means of the document feeder, as shown in FIG. 35, is disposed in front of the document pressing mat 3*a* under a front grip portion 31 of the original cover 3 and includes: a document feeding port 32 through which original documents are inserted; a document detecting lever 33 which is pressed up by the document inserted to turn on a document detecting switch; a feed roller 34 for feeding the inserted document onto an original table 2; and the like. The aforementioned document feeding port 32 is formed between the grip portion 31 of the original cover 3 and flat portion of a top outer plate 1*a* of the copier body 1 for mounting the original table 2 of the copier body 1.

Figure 36:
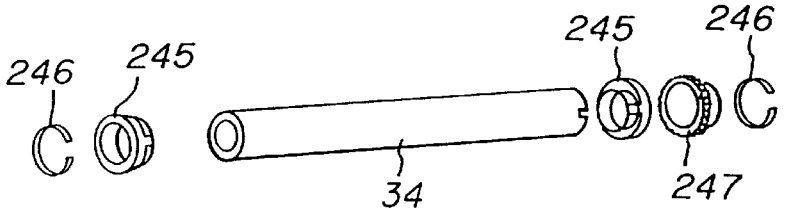
FIG. 36 is an exploded view showing a feed roller of the document feeder shown in FIG. 35.
Figure 37:
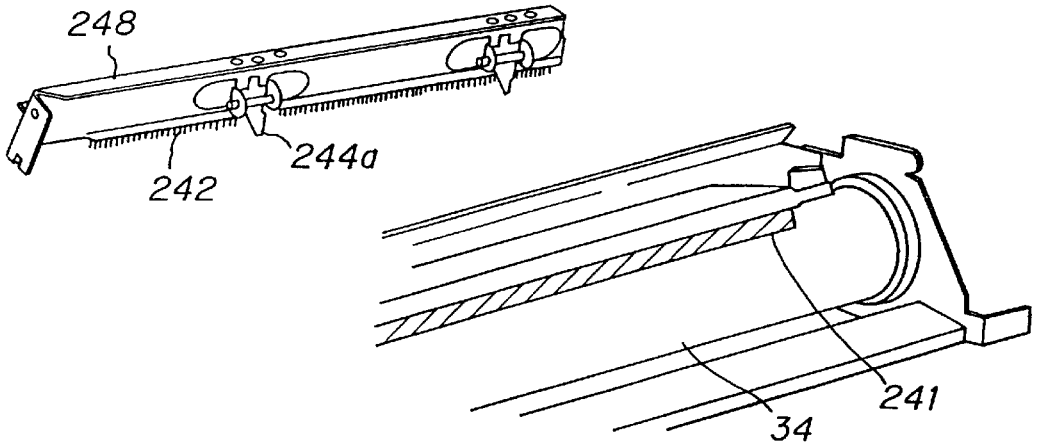
FIG. 37 is a perceptive view showing the document feeder shown in FIG. 35.

The feed roller 34 is composed of a high-dielectric material such as epoxy, and disposed between the original table 2 and the control panel 222 in the flat portion of the top outer plate 1*a* of the copier body 1. As shown in FIG. 36, the feed roller 34 has a cylindrical shape and has a bearing 245 and a roller stopper 246 in either side thereof. Provided on one end of the roller 34 is a feed-roller gear 247 between the bearing 245 and the roller stopper 246. The feed roller 34 is supported on the side of the original cover 3 so that the rotational shaft of the roller is rotatable. Driving force for the roller is transmitted through the roller gear 247 from an unillustrated driving motor disposed in a site of the original cover 3. The rotational shaft of the feed roller 34 is not grounded. As shown in FIG. 37, a roller-charging brush 241 is placed on the upper part of the feed roller 34 in parallel with and in contact with the feed roller 34. A pair of document-charge eraser brushes 242 and 243 for erasing charges on the document are paralleled before and behind the feed roller 34. The roller-charging brush 241 and document-charge eraser brushes 242 and 243 are composed of bundled bristles of, for example, conductive fibers arranged in such lengths as to touch the feed roller 34. The roller-charging brush 241 is impressed with a d.c. voltage of some kV through a supplying lines from the pivoting side of the original cover 3 to the inside of the original cover 3. The brush tips of the roller-charging brush 241 is in contact with the feed roller 34 so as to supply positive charges to the roller 34. As shown in FIG. 37, a feed guide plate 248 for regulating the feed direction of the document is provided with separation claws 244*a* for peeling the document off the surface of the feed roller 34 and the document-charge erasing brush 242. This assembly is disposed in the vicinity of the feed roller 34 on the side of the original cover 3. Similarly, another feed guide having separation claws 244*b* and the document-charge erasing brush 243 attached thereon is disposed in the vicinity of the feed roller 34 on the side of the control panel 222.

The detecting switch as well as the detecting lever 33 for detecting an inserted document into the feed area toward the feed roller 34 also is disposed on the side of original cover 3. When the original cover 3 is closed (or placed in the pressing state) over the original table 2, the detecting lever 33 is placed in an unillustrated depressed portion formed in the top outer plate 1*a* of the copier body 1. When a document is inserted, the lever 33 is lifted up above the outer plate 1*a*. This movement activates or turns on the document detecting switch, to thereby recognize the document.

In order for the document stocker 35 to lift up the original cover 3 so as to create a gap between the document pressing mat 3*a* and the original table 2, a pair of catching members 37 are provided on the upper portion of the outer plate 1*a* of the copier body 1, in corresponding positions to the pivots 35*b*, as shown in FIG. 10. The catching member 37 protrudes in some degree toward the control panel 222 and has a hook portion 37*a* crooked more or less toward the lower part thereof.

In position with the catching members 37, a pair of engaging portion 35*d* are formed on the side of the document stocker 35 to engage with the catching member 37. The engaging portions 35*d* are formed in the vicinity of the front part of the opening 35*c* of the document stocker 35, especially near the pivots 35*b*. Each engaging portion 35*d* has a projected form so as to be fitted into the hook portion 37*a*. Thus, the catching members 37 and the engaging portions 35*d* constitute an engaging mechanism for using the document stocker 35 as the document guide.

Accordingly, when the document stocker 35 which is placed over the original cover 3 is rotated to this side until the document stocker 35 is positioned over the control panel 222, the one end portion of the document stocker 35 abuts the flat surface of the outer plate 1*a* so that the document stocker 35 may not make a further rotation. In this condition, the projected, engaging portions 35*d* of the document stocker 35 are engaged into the hook portions 37*a* of the aforementioned catching members 37. At this moment, one side of the peripheral edge portions defining the opening 35*c* of the document stocker 35 is supported by the top face of the outer plate 1*a* of the copier body 1. In this condition, the hook portions 37*a* of the catching members 37 are engaged with respective engaging portions 35*d*, whereby the original cover 3 is lifted upward by the pivots 35*b*. That is, the grip portion 31 opposed to the pivotable hinge on the rear side of the original cover 3 is raised upward on the hinge of the original cover 3 through the pivots 35*b* as the original stocker 35 is rotated. As a result, a gap 'd' is created between the original table 2 and the document pressing mat 3*a*.

The above gap 'd' is determined depending upon a distance between the engaging site of the catching member 37 and the engaging portion 35*c*, and the pivot 35*b*, and upon an angle formed between a line jointed between the pivots 35*b* and the engaging site, and the horizontal plane. That is, it is possible to obtain a desired gap 'd' by setting up these positional relations, properly.

One of the sides of the bending portion 35*a* of the document stocker 35 is used as a guide for guiding one side edge of an inserted document. That is, the document is registered by the two reference edges, one of which is the above-mentioned reference edge 2*a* on the original table 2 and the other is perpendicular to the reference edge 2*a*. One of the sides of the bending portion 35*a* of the document stocker 35 is formed so as to correspond to the latter reference edge. The opposite side of the bending portion 35*a* is spaced from the corresponding side of the bending portion 35*a* to the reference edge, by such a distance as to accommodate maximum-sized documents specified.

Figure 38:
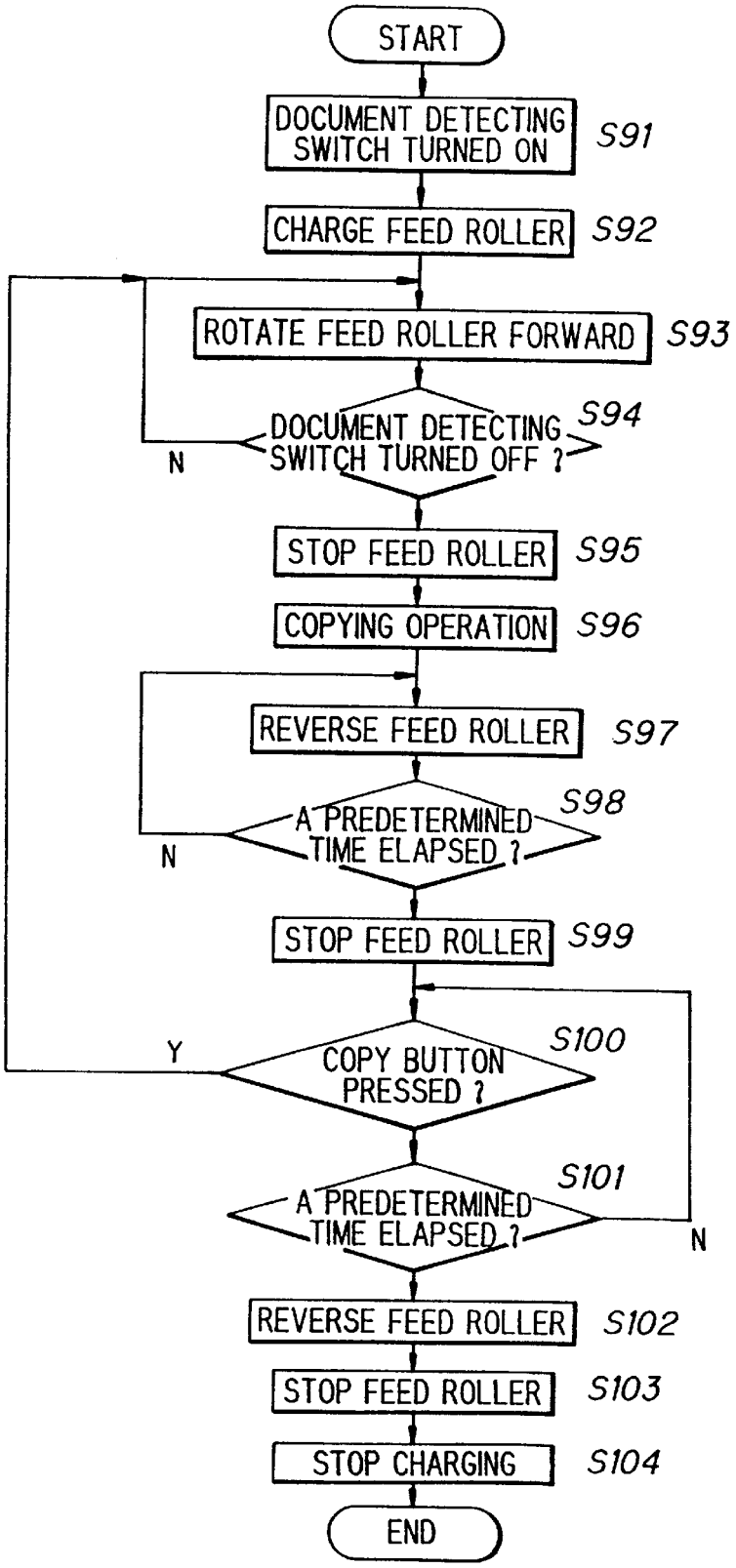
FIG. 38 is a flow chart for illustrating the operation of a document feeder of the invention.

Referring next to a flowchart shown in FIG. 38, the operation of the copier and the document feeder 30 will be described.

As the original cover 3 is closed with the document stocker 35 positioned over the original cover 3, the document stocker 35 is rotated to this side to be opened. From this setting, when a document D is inserted along the upper surface of the document stocker 35 from the document feeding port 32, the document D raises the detecting lever 33, to thereby turn the document detecting switch on (Step S91).

Figure 39:
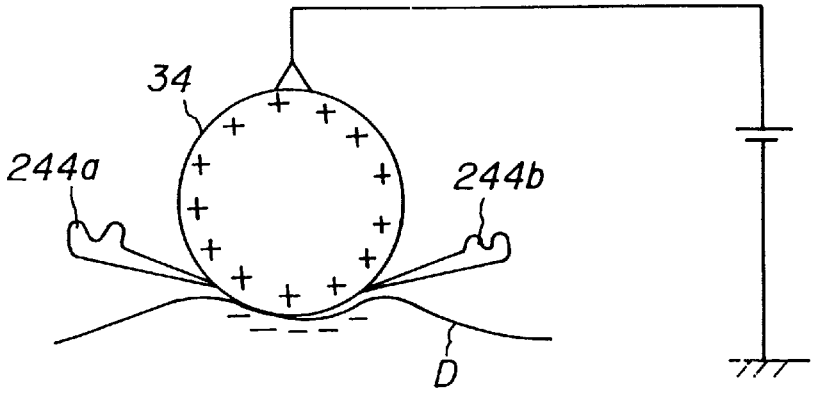
FIG. 39 is an illustrative view for explaining the operation of the document feeder shown in FIG. 35.

As the detecting switch is activated by the inserted document, the feed roller 34 is supplied with positive charges from the charging brush 241 (Step S92), and starts to rotate in the forward direction, whereby the feed roller 34 is uniformly charged as a whole (Step S93). The document D is inserted into a gap between the document pressing mat 3*a* and the original table 2. In this case, the opposed face of the document pressing mat 3*a* to the original table 2 serves as a document guide. The gap is preferably 0.1 mm or more by considering that a typical paper sheet is about 0.08 mm thick. As the document comes near to the feed roller 34 positively charged, the document becomes negatively charged. Thus, as shown in FIG. 39, the document D is attracted onto the feed roller 34 by electrostatic force and adheres onto the feed roller 34. Since the document D adheres to the feed roller 34 as wrapping the roller, the contact area between the document and the roller becomes large. Accordingly, an attracting force of about 100 g can be obtained by the application of a voltage of about 10 kV. Since there is little resistance in the document feeding direction as compared to the attracting force, it is possible to obtain an attracting force strong enough to convey the document.

The document conveyed as adhering to the feed roller 34 is peeled off the feed roller 34 by he separation claws 244*a*, and right after, charges on the document are erased by the charge-erasing brush 242. The erasure of charges prevents the document from adhering to the original cover 3 and/or the original table 2 due to static charges when the document is inserted into the gap. As the rear end of the document D goes through the detecting lever 33 and the document detecting switch turns off (Step S94), the feed roller unit 34 stops turning (Step S95) while the rear end of the document is kept nipped by the feed roller 34.

In this way, as the document D is automatically fed onto the document table 2, the copier starts to perform the same copying operation as will be effected when the copy button 223 is pressed, whereby the copier effects reproducing procedures from the exposure to the discharge of copy paper (Step S96). After the completion of the copying process, the feed roller 34 is turned in the reverse direction by the driving motor (Step S97), the document D is delivered out toward the document feeding port 32. At this moment, charges on the document are erased by the charge-erasing brush 243 disposed on the discharging side. This discharge is performed by previously memorizing the rotating time of the feed roller 34 when the document D is inserted and measuring a setup time which is a little shorter (by a time equivalent to about 10 mm in feed distance) than the memorized time (Step S98) and stopping the reverse movement of the feed roller 34 after the passage of the thus setup time (Step S99). Accordingly, the document D stops at a position where the end of the document D is nipped in some degree by the feed roller 34. In this condition, if another copy is wanted and the copy button is pressed within a predetermined period (for example, 2 seconds) after the feed rollers stopped (Steps S100 and S101), the feed roller 34 starts turning in the forward direction and the system reenters copying operation. By this function, it is possible to make a plurality of duplications from a single document.

After a lapse of a certain time, the feed roller again makes a reverse rotation (Step S102) to discharge the document to the document stocker 35 and thereafter stops (Step S103). After the roller stops, the charger is stopped (Step S104).

As described, the feed roller 34 is charged during the series of operations, which enables the single roller to effect the feeding operation. Besides, by arranging the feed roller 34 right above the document reference edge (the glass edge) of the original table 2, it is possible to position the document edge at the document reference edge as to be the exposure edge, with the rear end of the document nipped by the roller. The positioning of the edge can be made by measuring the time of rotation of the roller after the document detecting switch is turned off. The conventional feeder, however, requires a pair of upper and lower rollers for nipping the document. In this condition, the nipped portion cannot be exposed to light, causing image loss for that part. In contrast, this embodiment has no lower roller, so that it is possible to expose the portion right below the feed roller to light, thus no image loss occurs.

Figure 40:
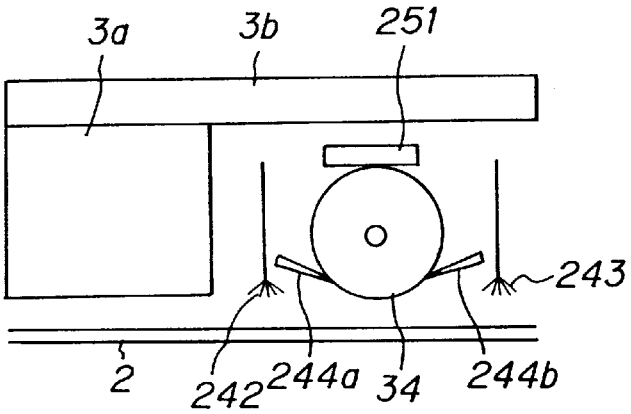
FIG. 40 is a structural view showing another variation of the document feeder shown in FIG. 35.

FIG. 40 is a configurational view showing a variation of the above embodiment. The following description will be made on a method of charging the feed roller. Here, the structure and control system used are the same with those in the above embodiment. In FIG. 40, as the feed roller 34 rotates, electric charges are produced by friction between the feed roller 34 and a charging member 251 of rubber etc., in contact with the roller, frictional electrons transfer from the feed roller 34 to the charging member 251, or vice versa. Accordingly, one member receiving electrons becomes negatively charged while the other member losing the electrons becomes positively charged. Thus, it is possible to produce static charges on the surface of the feed roller 34, which presents a voltage of some kV. Since this method enables the roller to be electrified without using the charge application from the outside, there is no need for any power source for charging from the copier body, attaining a simplified structure.

Similarly to the above embodiment, as a document is fed and comes in contact with the feed roller 34 thus charged, dielectric polarization occurs, so that opposite charges arise on the surfaces of the document and the feed roller 34. Accordingly, the roller 34 and the document attract each other, whereby the document can be conveyed.

Figure 41:
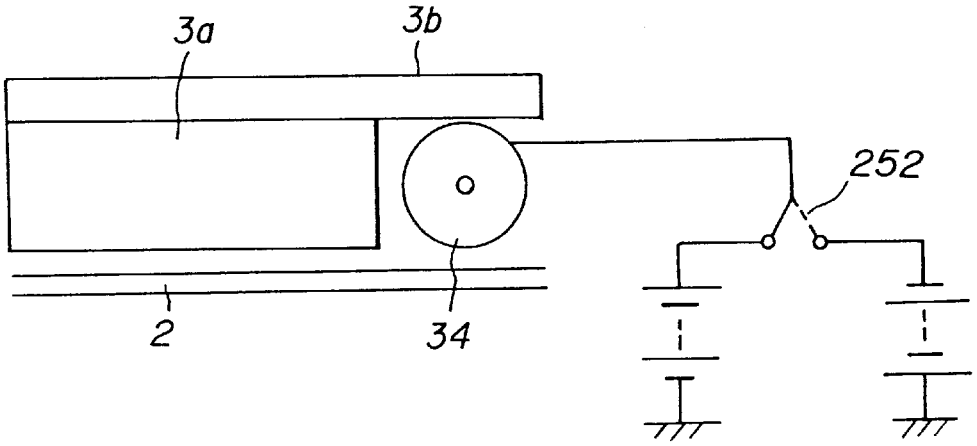
FIG. 41 is a structural view showing a further variation of the document feeder shown in FIG. 35.

FIG. 41 is a configurational view showing another variation of the above embodiment. Here, the structure and control system used are the same with those in the above embodiment, therefore corresponding components are designated by the same reference numerals and the description of those is omitted.

In FIG. 41, if the document detecting switch will not turn off after a predetermined period of time (about one and half the maximum time required for conveyance), the copier will assume that document paper jam should occur, and will stop the feed roller 34. Thereafter, the charged feed roller is supplied with the equipotential but opposite charges, so that the document adhered to the roller can easily be peeled off the feeding passage, thus improving the removability of the jammed paper.

Figure 42:
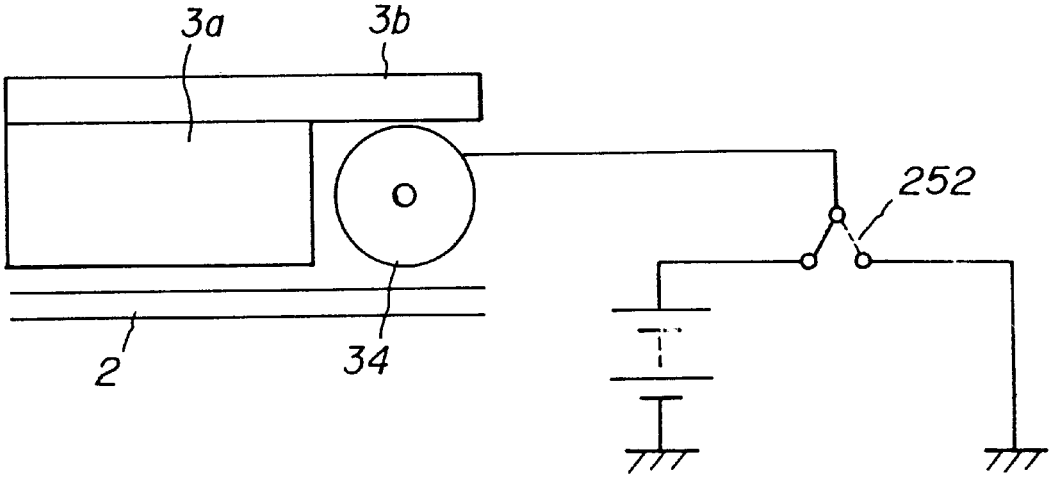
FIG. 42 is a structural view showing still another variation of the document feeder shown in FIG. 35.

Specifically, after the document jam is detected, the roller-charging brushes are supplied with opposite charges by changing the changeover switch 252. As charges on the feed roller 34 electrified are canceled, the voltage application to the feed roller is stopped (after the roller makes one revolution). By this operation, it is possible to quickly and reliably erase charges and therefore the jammed document can be easily peeled off the feed roller 34, attaining eased or improved removability of the document FIG. 42 is a view showing a modified configuration of the above variational configuration. The following description will be made as to the feed roller when document paper jam occurs. Here, the structure and control system used are the same with those in the above variational configuration.

In FIG. 42, after the document jam is detected, the roller-charging brushes are connected to GND earth such as frame etc., by changing the changeover switch 252. This operation makes the feed roller 34 equipotential with the frame earth, to thereby erase charges on the roller. Accordingly, the document can be easily peeled off the feed roller 34, attaining improved removability of the document. This means, as different from the means shown in FIG. 41, requires no power source which supplied an opposite voltage to the voltage applied to the roller-charging brushes. Accordingly, it is possible to simplify the configuration still more.

Thus, in accordance with the fifth embodiment, since the feed roller is charged to attract the document to be conveyed, it is possible to use a single roller for conveying the document. Accordingly, the structure can be simplified resulting in reduced cost. Since charges on the conveyed document can be erased by using charge-erasing brushes, the document will not adhere to the original cover or the original table. Therefore, no paper jam occurs, resulting in improved operation performances. Only a single roller constitutes the feed roller, that is, this configuration does not require two rollers for nipping the fed document as used in the conventional configuration. Accordingly, the part of the document adhering to the feed roller can be exposed to light, whereby no image loss will not occur.

When the feed roller is electrified by friction between a charging member and the feed roller, no outside power source is needed to charge the feed roller. Accordingly, it is possible to simplify the device structure, making it possible to further reduce the cost.

Since charges on the feed roller are erased when document jam occurs, the document does not adhere to the components inside the device when the sheet is taken out. As a result, it is possible to remove the paper quickly and easily. Since an opposite voltage to the applied voltage to charge the conducive brushes is applied when charges are to be erased, it is possible to erase charges quickly and reliably. Alternatively, since the conductive brushes are connected to the ground when the charges are to be erased, there is no need for any power source for erasing charges, thus resulting in a simplified structure.

What is claimed is:

1. A document feeder for use in an image forming apparatus which includes: an original table where an original document is placed and exposed to light; and an original cover for pressing the original document onto the original table, said document feeder comprising:

a single original document detector, said single original document detector for detecting a document inserted from the outside;

a single feed roller unit upstream from an edge of said original table where the original document would be manually placed, for feeding an inserted document into a space between said original table and said original cover, in response to the detection of a document by said single original document detector; and original cover lifting means for automatically lifting said original cover to create a gap between said original table and said original cover.

2. A document feeder according to claim 1 wherein said feed roller unit includes a feed roller, and further wherein said original document detector detects that the original document has passed into the gap, causing said feed roller to stop with the rear end of the original document nipped thereby.

3. A document feeder according to claim 1, wherein said feed roller unit includes a single feed roller, said single feed roller being immediately adjacent said original document detector.

4. A document feeder according to claim 1, wherein said original document detector includes rotary encoder.

5. A document feeder according to claim 4, wherein said rotary encoder includes a rotary encoder wheel for engaging an inserted original document and for rotating due to friction between said rotary encoder wheel and the inserted original document.

6. A document feeder according to claim 4, wherein said feed roller unit includes a feed roller and said rotary encoder includes a rotary encoder wheel operatively connected to said feed roller, such that said feed roller and said rotary encoder wheel start and stop rotating simultaneously.

7. A document feeder according to claim 6, wherein said rotary encoder wheel and said feed roller are disposed on respective, non-collinear axes, said document feeder further comprising:

a timing belt operatively connecting said rotary encoder wheel to said feed roller.

8. A document feeder according to claim 1, wherein said feed roller unit includes a feed roller, said document feeder further comprising:

a speed controller for controlling said feed roller to insert the original document into the gap at a first speed, and to discharge the original document from the gap at a second speed different from the first speed.

9. A document feeder according to claim 8, wherein the image forming apparatus further includes first and second drive gears, said speed controller including:

a first feed gear connected concentrically with said feed roller, the first feed gear having a first diameter and engaging the first drive gear;

a second feed gear connected concentrically with said feed roller, the second feed gear having a second diameter different from the first diameter and engaging the second drive gear; and one-way clutches respectively provided for said first and second feed gears and operative to permit said first and second feed gears to rotate in opposite directions.

10. A document feeder according to claim 1, wherein the only original document feeding mechanism contained in said document feeder is said single feed roller unit.

11. A document feeder for use in an image forming apparatus which includes: an original table where an original document is placed and exposed to light; and an original cover for pressing the original document onto the original table, said document feeder comprising:

original document detecting means for detecting a document inserted from the outside;

a feed roller disposed for feeding an inserted document into a space between the original table and the original cover, in response to the detection of a document by said original document detecting means; and original cover lifting means for automatically lifting said original cover to create a gap between the original table and the original cover, and further wherein, when the original document is discharged from the gap, said feed roller stops with the front end of the original document nipped thereby.

12. An image forming apparatus comprising:

an original table where an original document is placed and exposed to light;

an original cover hinged to be opened and closed for pressing the original document onto said original table;

feeding means including a feed roller unit disposed upstream of said original table and at a position where a document feeding port is formed, the document feeding port being for insertion of the original document from the outside and being formed between said original cover in its closed position and the top surface of the image forming apparatus body, for feeding an inserted original document toward said original table;

detecting means disposed before said feeding means for detecting an inserted original document;

controlling means controlling the operation of said feeding means in response to the detection by said detecting means so as to control insertion and discharge of an inserted original document; and lifting means for automatically lifting said original cover up from said original table, thereby forming a gap into which the inserted original document is fed.

13. An image forming apparatus according to claim 12, further comprising:

a rotational member rotatable between a first position over the original cover and a second position over a top plate of the image forming apparatus body, said rotational member serving as a guide for guiding an inserted original document toward said feeding means when placed in said second position; and a linking mechanism for linking said feeding means with a driving means in the image forming apparatus body when said rotational member is placed in said second position.

14. An image forming apparatus according to claim 13 wherein said lifting means is linked to the operation of said feeding means and lifts the original cover when said feeding means operates in a forward direction to deliver the document into the gap, and cancels the lifted state of the original cover and allows the original cover to press against the original table when said feeding means is driven in the discharge direction.

15. An image forming apparatus according to claim 14 wherein a bent portion is formed in the original cover to create an inclined clearance between the original cover and the original table, on the side to which a document is conveyed by said feeding means.

16. An image forming apparatus according to claim 13 wherein a bent portion is formed in the original cover to create an inclined clearance between the original cover and the original table, on the side to which a document is conveyed by said feeding means.

17. An image forming apparatus according to claim 12 wherein said lifting means is linked to the operation for said feeding means and lifts the original cover when said feeding means operates in a forward direction to deliver the document into the gap, and cancels the lifted state of the original cover and allows the original cover to press against the original table when said feeding means is driven in the discharge direction.

18. An image forming apparatus according to claim 17 wherein a bent portion is formed in the original cover to create an inclined clearance between the original cover and the original table, on the side to which a document is conveyed by said feeding means.

19. An image forming apparatus according to claim 12 wherein a bent portion is formed in the original cover to create an inclined clearance between the original cover and the original table, on the side of the gap where the original document is first fed by said feeding means.

20. An image forming apparatus according to claim 12, further comprising a control panel having top and front plates disposed on the top and front faces of the image forming apparatus body, and wherein said detecting means, said feeding means and said lifting means are formed on the top plate of said control panel.

21. An image forming apparatus according to claim 12, wherein said detecting means consists of only one document sensor between said document feeding port and said original table.

22. An image forming apparatus according to claim 12, wherein the only original document feeding mechanism contained in said image forming apparatus is said feed roller unit.

23. An original cover for pressing an original document onto an original table of an image forming apparatus, the original document being manually placed at an imaging area of the original table for image reproduction, said cover comprising:

a cover lifter for automatically lifting said cover relative to the original table, so as to form a gap between the original table and said cover;

a first feed roller for feeding an original document into the gap; and a feed mechanism-free region which contains no original document feed mechanism and, when said cover is installed on the image forming apparatus, overlies the entire imaging area.

24. The cover of claim 23, further comprising:

a second feed roller operatively associated with said first feed roller, the original document being fed between said first and second feed rollers into the gap.

25. The cover of claim 23, further comprising:

a document sensor for sensing an original document to be fed by said first feed roller, said cover lifter automatically lifting said cover relative to the original table when said document sensor senses the original document.

26. The cover of claim 23, wherein the image forming apparatus includes a hook portion on a surface adjacent said cover, said cover lifter including:

a rotational member manually rotatable between a non-lifting position and a lifting position, said rotational member including an engaging portion for engaging the hook portion when said rotational member is rotated to the lifting position, the engagement of the hook portion and said engaging portion causing a clearance between said cover and the original table.

27. The cover of claim 26, said rotational member further including:

a flat plate connected to said engaging portion and sized to support documents, said flat plate extending substantially horizontally when said rotational member is rotated to the lifting position such that documents may be supported on said flat plate.

28. The cover of claim 23, said cover lifter further including:

an eccentric cam operatively connected to said first feed roller, said eccentric cam providing a pressing force against the image forming apparatus when said first feed roller operates to feed an original document into the gap so as to lift said cover.

29. The cover of claim 28, wherein said eccentric cam pivots to lower said cover toward the original table when the original document has been fed to an imaging position on the original table.

30. The cover of claim 23, wherein said first feed roller is a passive roller driven by a drive mechanism included in the image forming apparatus.

31. The cover of claim 30, further comprising:

a transmission gear operatively connected to said first feed roller, for driving said first feed roller;

a linking lever connected to said transmission gear, for displacing said transmission gear between operative and non-operative positions, said transmission gear engaging the drive mechanism when displaced to the operative position.

32. The cover of claim 31, said cover lifter including:

a rotational member rotatable between first and second positions, said rotational member displacing said linking lever when rotated to the second position such that said linking lever places said transmission gear in the operative position.

33. The cover of claim 32, wherein the image forming apparatus further includes a hook portion at a surface adjacent said cover, said rotational member including an engaging portion for engaging the hook portion when said rotational member is rotated to the second position, the engagement of the engaging portion and the hook portion causing a clearance between said cover and the original table.

34. The cover of claim 23, wherein said first feed roller is disposed at an edge of said cover where original documents are inserted, said cover further comprising:

a sheet disposed on a broad surface of said cover, for pressing the original document toward the original table, said sheet including an inclined portion adjacent the edge and spaced from the original table, the inclined portion acting as a document guide for guiding the original document into the gap.

35. The cover of claim 23, further comprising a second roller, the original document simultaneously engaging said second roller and said first feed roller at non-coplanar positions such that a curvature is imparted to the original document.

36. The cover of claim 35, further comprising:

a third feed roller, said second roller being arranged coaxial with and between said first feed roller and said third feed roller.

37. The cover of claim 23, wherein the gap between the original table and said cover is approximately 0.1 mm.

38. The cover of claim 23, further comprising:

charging means for imparting an electric charge to said first feed roller.

39. The cover of claim 38, wherein said charging means includes a charger brush.

40. The cover of claim 38, wherein said charging means includes a rubber member in frictional contact with said first feed roller.

41. The cover of claim 38, further comprising:

switching means for changing a polarity of the electric charge applied to said first feed roller.

42. The cover of claim 41, wherein said switching means selectively applies a positive electric charge or a negative electric charge to said first feed roller.

43. The cover of claim 41, wherein said switching means selectively applies a positive electric charge or ground to said first feed roller.

44. The cover of claim 23, further comprising:

sheet charging means for erasing an electric charge from the original document.

45. The cover of claim 23, further comprising:

a handle for manually raising and lowering said cover when said cover is installed on the image forming apparatus, wherein said first feed roller is adjacent said handle.

46. The cover of claim 45, wherein said cover lifter is adjacent said handle.

47. The cover of claim 23, further comprising:

a hinge portion for enabling said cover to be rotated, about a hinge axis, between open and closed positions when installed on the image forming apparatus; and a front edge distal from said hinge portion, the front edge being the edge of said cover having the greatest radial distance from the hinge axis;

wherein said first feed roller is mounted immediately adjacent said front edge.

48. The cover of claim 47, wherein said cover lifter is adjacent said front edge.

49. The cover of claim 23, wherein said cover lifter includes a shaft, said shaft supporting said first feed roller.

50. The cover of claim 23, further comprising a pressing mat, said pressing mat occupying said feed mechanism-free region.

51. An image reproducing apparatus, comprising:

an original table for supporting an original document at an imaging position for image reproduction;

only one feed roller unit, said feed roller unit being upstream from a region of said original table where an original document would be manually placed, for feeding an inserted original document from an insertion port to the imaging position on said original table, the insertion port allowing insertion of a document from the outside;

a cover for covering the imaging position on said original table, the insertion port being formed between said cover and a surface of said image reproducing apparatus; and a gap creator for automatically creating a gap between said original table and said cover at the imaging position.

52. The image reproducing apparatus of claim 51, said feed roller unit including a first feed roller for feeding the original document to the imaging position, said first feed roller nipping the original document when the original document has reached the imaging position.

53. The image reproducing apparatus of claim 52, said feed roller unit further including:

a second feed roller disposed opposite said first feed roller such that the original document is fed between said first and second feed rollers.

54. The image reproducing apparatus of claim 53, wherein an axis of said first feed roller is parallel to an axis of said second feed roller, and a line intersecting and perpendicular to both axes is substantially perpendicular to a plane of said original table.

55. The image reproducing apparatus of claim 53, wherein said first and second feed rollers are both mounted on said cover.

56. The image reproducing apparatus of claim 53, further comprising an apparatus body on which said original table is mounted, wherein said first roller is mounted on said cover and said second feed roller is mounted on said apparatus body.

57. The image reproducing apparatus of claim 51, further comprising:

an apparatus body on which said original table is mounted;

a drive mechanism included in said apparatus body, said feed roller unit including a passive feed roller driven by said drive mechanism;

a transmission gear operatively connected to said passive feed roller, for driving said passive feed roller; and a linking lever connected to said transmission gear, for displacing said transmission gear between operative and non-operative positions, said transmission gear engaging and being driven by said drive mechanism when displaced to the operative position.

58. The image reproducing apparatus of claim 57, further comprising:

a rotational member rotatable between first and second positions, said rotational member displacing said linking lever when rotated to the second position such that said linking lever places said transmission gear in the operative position.

59. The image reproducing apparatus of claim 58, further comprising:

a hook portion disposed on a surface of said apparatus body adjacent said cover, wherein said rotational member further includes:

an engaging portion for engaging said hook portion when said rotational member is rotated to the second position, the engagement of said engaging portion and said hook portion causing a clearance between said cover and the original table.

60. The image reproducing apparatus of claim 51, wherein said cover is selectively positionable in an open position or a closed position, said cover covering said original table in the closed position and exposing said original table in the open position.

61. The image reproducing apparatus of claim 60, further including a second imaging position used when an original document is placed on said original table with said cover in the open position, the imaging position being offset from the second imaging position, said apparatus further comprising:

an optical system for reproducing an image provided on the original document when placed in the imaging position or in the second image position;

a sheet feed mechanism for feeding a sheet onto which the reproduced image is to be formed; and timing means for adjusting a feed time of a sheet by said sheet feed mechanism when the imaging position is used, in order to compensate for the offset between the imaging position and the second imaging position.

62. The image reproducing apparatus of claim 51, further comprising:

a document sensor for detecting an original document to be fed to the imaging position, said feed roller unit operating in response to said document sensor to feed the detected original document into the gap.

63. The image reproducing apparatus of claim 62, wherein said document sensor includes a lever disposed in the insertion port at an edge of said cover where a handle is located, said lever being for sensing a leading edge of the original document.

64. The image reproducing apparatus of claim 62, wherein said document sensor detects a leading edge and a trailing edge of the original document, said feed roller unit feeding the detected original document into the gap in response to the detection of the leading edge and stopping the feeding in response to the detection of the trailing edge such that said feed roller unit nips the trailing edge of the original document when the feeding stops.

65. The image reproducing apparatus of claim 51, wherein said gap creator includes:

a solenoid mounted adjacent the original table; and a moving piece displaceable by said solenoid between a non-gap-creating position and a gap-creating position, said moving piece providing a pressing force against said cover in the gap-creating position to thereby create the gap.

66. The image reproducing apparatus of claim 51, wherein said gap creator includes a hook portion disposed on a surface of said apparatus body adjacent said cover, and a rotational member rotatable between first and second positions, wherein said rotational member further includes:

an engaging portion for engaging said hook portion when said rotational member is rotated to the second position, the engagement of said engaging portion and said hook portion automatically causing the gap between said cover and said original table.

67. The image reproducing apparatus of claim 51, further comprising:

an optical system for reproducing an image provided on the original document when placed in the imaging position, said optical system including a lens; and means for shifting said lens in response to the original document being fed to the imaging position by said feed roller unit.

68. The image reproducing apparatus of claim 51, wherein said feed roller unit includes:

a first feed roller mounted on said cover; and a second roller, wherein the original document simultaneously engages said second roller and said first feed roller at non-coplanar positions such that a curvature is imparted to the original document.

69. The image reproducing apparatus of claim 68, further comprising:

a third feed roller, said second roller being arranged coaxial with and between said first feed roller and said third feed roller.

70. The image reproducing apparatus of claim 68, further comprising:

a third feed roller disposed opposite said first feed roller such that the original document is fed between said first and third feed rollers, wherein said second roller is arranged coaxial with said third feed roller.

71. The image reproducing apparatus of claim 70, wherein the second roller and said first feed roller have substantially the same diameter.

72. The image reproducing apparatus of claim 70, wherein the second roller has a diameter greater than a diameter of said first feed roller.

73. The image reproducing apparatus of claim 51, wherein said gap creator includes an eccentric cam operative together with said feed roller unit, said eccentric cam providing a pressing force between said cover and a body of said apparatus when said feed roller unit operates to feed an original document into the gap so as to create the gap.

74. The image reproducing apparatus of claim 51, wherein the gap between said original table and said cover is approximately 0.1 mm.

75. The image reproducing apparatus of claim 51, wherein said surface of said image reproducing apparatus is substantially coplanar with said original table.

76. The image reproducing apparatus of claim 51, wherein the insertion port is formed only when said cover is in a closed position covering the imaging position.

77. The image reproducing apparatus of claim 51, wherein said cover includes a continuous unbroken pressing mat for pressing an original document against said original table.

78. An original cover for dressing an original document onto an original table of an image forming apparatus, the original document being placed on the original table for image reproduction, said cover comprising:

a cover lifter for automatically lifting said cover relative to the original table, so as to form a gap between the original table and said cover;

a first feed roller for feeding an original document into the gap; and a hinge portion for enabling said cover to be rotated between open and closed portions when installed on the image forming apparatus, wherein said cover lifter operates, when installed on the image forming apparatus, to lift said cover about said hinge portion.

79. An original cover for pressing an original document onto an original table of an image forming apparatus, the original document being placed on the original table for image reproduction, said cover comprising:

a cover lifter for automatically lifting said cover relative to the original table, so as to form a gap between the original table and said cover; and a first feed roller for feeding an original document onto the gap, wherein said first feed roller is mounted in said cover such that said cover lifter lifts said first feed roller relative to the original table when said cover lifter lifts said cover.

* * * * *